US008074897B2

(12) United States Patent
Hunnicutt et al.

(10) Patent No.: US 8,074,897 B2
(45) Date of Patent: Dec. 13, 2011

(54) SPRINKLER WITH VARIABLE ARC AND FLOW RATE

(75) Inventors: Steven Brian Hunnicutt, Vail, AZ (US); Samuel C. Walker, Green Valley, AZ (US); Rowshan Jahan, Fort Wayne, IN (US)

(73) Assignee: Rain Bird Corporation, Azusa, CA (US)

( * ) Notice: Subject to any disclaimer, the term of this patent is extended or adjusted under 35 U.S.C. 154(b) by 259 days.

(21) Appl. No.: 12/248,644

(22) Filed: Oct. 9, 2008

(65) Prior Publication Data

US 2010/0090024 A1 Apr. 15, 2010

(51) Int. Cl.
*B05B 3/04* (2006.01)

(52) U.S. Cl. ..... 239/222.17; 239/204; 239/222.11; 239/223; 239/231; 239/252; 239/263; 239/457; 239/514; 239/569; 239/581.1

(58) Field of Classification Search ..... 239/203, 239/204, 206, 222.11, 222.17, 222.19, 223, 239/225.1, 231, 252, 263, 520, 522–524, 239/569, 581.1, 451, 457, 505, 514
See application file for complete search history.

(56) References Cited

U.S. PATENT DOCUMENTS

| | | | |
|---|---|---|---|
| 2,634,163 | A | 4/1953 | Double |
| 2,723,879 | A | 11/1955 | Martin |
| 2,875,783 | A | 3/1959 | Schippers |
| 2,935,266 | A | 5/1960 | Coleondro et al. |
| 3,940,066 | A | 2/1976 | Hunter |
| 3,955,764 | A | 5/1976 | Phaup |
| 4,026,471 | A | 5/1977 | Hunter |
| 4,119,275 | A | 10/1978 | Hunter |
| 4,131,234 | A | 12/1978 | Pescetto |
| 4,189,099 | A | 2/1980 | Bruninga |
| 4,198,000 | A | 4/1980 | Hunter |
| 4,253,608 | A | 3/1981 | Hunter |
| 4,272,024 | A | 6/1981 | Kah, Jr. |
| 4,353,506 | A | 10/1982 | Hayes |
| 4,353,507 | A | 10/1982 | Kah, Jr. |

(Continued)

FOREIGN PATENT DOCUMENTS

EP 0724913 A2 7/1996

(Continued)

OTHER PUBLICATIONS

U.S. Appl. No. 12/475,242, filed May 29, 2009, entitled "Sprinkler with Variable Arc and Flow Rate and Method".

(Continued)

*Primary Examiner* — Steven J Ganey
(74) *Attorney, Agent, or Firm* — Fitch, Even, Tabin & Flannery

(57) ABSTRACT

A variable arc sprinkler may be set to numerous positions along a continuum to adjust the arcuate span of the sprinkler. The sprinkler includes a nozzle body and a valve sleeve that helically engage each other to define an arcuate slot that may be adjusted at the top of the sprinkler to a desired arcuate span. The sprinkler may include a flow rate adjustment device that may be adjusted by actuation or rotation of an outer wall portion of the sprinkler. Rotation of the outer wall portion may cause a throttle control member to move axially to or away from an inlet, or may cause one or more restrictor elements to open or close, to control the flow rate of the sprinkler.

49 Claims, 38 Drawing Sheets

U.S. PATENT DOCUMENTS

| | | | | |
|---|---|---|---|---|
| 4,398,666 | A | | 8/1983 | Hunter |
| 4,471,908 | A | | 9/1984 | Hunter |
| 4,501,391 | A | | 2/1985 | Hunter |
| 4,566,632 | A | | 1/1986 | Sesser |
| 4,568,024 | A | | 2/1986 | Hunter |
| 4,579,285 | A | | 4/1986 | Hunter |
| 4,624,412 | A | | 11/1986 | Hunter |
| 4,625,917 | A | | 12/1986 | Torney |
| RE32,386 | E | | 3/1987 | Hunter |
| 4,660,766 | A | | 4/1987 | Nelson et al. |
| 4,669,663 | A | | 6/1987 | Meyer |
| 4,676,438 | A | | 6/1987 | Sesser |
| 4,708,291 | A | | 11/1987 | Grundy |
| 4,718,605 | A | | 1/1988 | Hunter |
| 4,720,045 | A | | 1/1988 | Meyer |
| 4,739,934 | A | | 4/1988 | Gewelber |
| D296,464 | S | | 6/1988 | Marmol et al. |
| 4,752,031 | A | | 6/1988 | Merrick |
| 4,763,838 | A | | 8/1988 | Holcomb |
| 4,796,809 | A | | 1/1989 | Hunter |
| 4,796,811 | A | | 1/1989 | Davisson |
| 4,815,662 | A | | 3/1989 | Hunter |
| 4,834,289 | A | | 5/1989 | Hunter |
| 4,836,449 | A | | 6/1989 | Hunter |
| 4,836,450 | A | | 6/1989 | Hunter |
| 4,840,312 | A | | 6/1989 | Tyler |
| 4,842,201 | A | | 6/1989 | Hunter |
| 4,867,378 | A | | 9/1989 | Kah, Jr. |
| 4,898,332 | A | | 2/1990 | Hunter et al. |
| 4,901,924 | A | | 2/1990 | Kah, Jr. |
| 4,932,590 | A | | 6/1990 | Hunter |
| 4,944,456 | A | * | 7/1990 | Zakai ..... 239/222.19 |
| 4,948,052 | A | | 8/1990 | Hunter |
| 4,955,542 | A | | 9/1990 | Kah, Jr. |
| 4,961,534 | A | | 10/1990 | Tyler et al. |
| 4,967,961 | A | | 11/1990 | Hunter |
| 4,971,250 | A | | 11/1990 | Hunter |
| 4,986,474 | A | | 1/1991 | Schisler et al. |
| 5,031,840 | A | | 7/1991 | Grundy et al. |
| 5,050,800 | A | | 9/1991 | Lamar |
| 5,052,621 | A | | 10/1991 | Katzer et al. |
| 5,058,806 | A | | 10/1991 | Rupar |
| 5,083,709 | A | | 1/1992 | Iwanowski |
| RE33,823 | E | | 2/1992 | Nelson et al. |
| 5,086,977 | A | | 2/1992 | Kah, Jr. |
| 5,098,021 | A | | 3/1992 | Kah, Jr. |
| 5,104,045 | A | | 4/1992 | Kah, Jr. |
| 5,123,597 | A | | 6/1992 | Bendall |
| 5,141,024 | A | | 8/1992 | Hicks |
| 5,148,990 | A | | 9/1992 | Kah, Jr. |
| 5,148,991 | A | | 9/1992 | Kah, Jr. |
| 5,158,232 | A | | 10/1992 | Tyler et al. |
| 5,199,646 | A | | 4/1993 | Kah, Jr. |
| 5,205,491 | A | | 4/1993 | Hadar |
| 5,224,653 | A | | 7/1993 | Nelson et al. |
| 5,226,599 | A | | 7/1993 | Lindermeir et al. |
| 5,226,602 | A | | 7/1993 | Cochran et al. |
| 5,234,169 | A | | 8/1993 | McKenzie |
| 5,240,182 | A | | 8/1993 | Lemme |
| 5,240,184 | A | | 8/1993 | Lawson |
| 5,267,689 | A | | 12/1993 | Forer |
| 5,288,022 | A | | 2/1994 | Sesser |
| 5,299,742 | A | | 4/1994 | Han |
| 5,322,223 | A | | 6/1994 | Hadar |
| 5,360,167 | A | | 11/1994 | Grundy et al. |
| 5,370,311 | A | | 12/1994 | Chen |
| 5,372,307 | A | | 12/1994 | Sesser |
| 5,375,768 | A | | 12/1994 | Clark |
| 5,417,370 | A | | 5/1995 | Kah, Jr. |
| 5,423,486 | A | | 6/1995 | Hunter |
| 5,435,490 | A | | 7/1995 | Machut |
| 5,439,174 | A | | 8/1995 | Sweet |
| RE35,037 | E | | 9/1995 | Kah, Jr. |
| 5,456,411 | A | | 10/1995 | Scott et al. |
| 5,526,982 | A | | 6/1996 | McKenzie |
| 5,544,814 | A | | 8/1996 | Spenser |
| 5,556,036 | A | | 9/1996 | Chase |
| 5,588,594 | A | | 12/1996 | Kah, Jr. |
| 5,588,595 | A | | 12/1996 | Sweet et al. |
| 5,598,977 | A | | 2/1997 | Lemme |
| 5,611,488 | A | | 3/1997 | Frolich |
| 5,642,861 | A | | 7/1997 | Ogi et al. |
| 5,653,390 | A | | 8/1997 | Kah, Jr. |
| 5,662,545 | A | | 9/1997 | Zimmerman et al. |
| 5,671,885 | A | | 9/1997 | Davisson |
| 5,671,886 | A | | 9/1997 | Sesser |
| 5,676,315 | A | | 10/1997 | Han |
| D388,502 | S | | 12/1997 | Kah, III |
| 5,695,123 | A | | 12/1997 | Le |
| 5,699,962 | A | | 12/1997 | Scott et al. |
| 5,711,486 | A | | 1/1998 | Clark et al. |
| 5,718,381 | A | | 2/1998 | Katzer et al. |
| 5,720,435 | A | | 2/1998 | Hunter |
| 5,722,593 | A | | 3/1998 | McKenzie |
| 5,758,827 | A | | 6/1998 | Van Le et al. |
| 5,762,270 | A | | 6/1998 | Kearby et al. |
| 5,765,757 | A | | 6/1998 | Bendall |
| 5,769,322 | A | | 6/1998 | Smith |
| 5,785,248 | A | | 7/1998 | Staylor et al. |
| 5,823,439 | A | | 10/1998 | Hunter et al. |
| 5,823,440 | A | | 10/1998 | Clark |
| 5,826,797 | A | | 10/1998 | Kah, III |
| 5,845,849 | A | | 12/1998 | Mitzlaff |
| 5,875,969 | A | | 3/1999 | Grundy |
| 5,918,812 | A | | 7/1999 | Beutler |
| 5,927,607 | A | | 7/1999 | Scott |
| 5,971,297 | A | | 10/1999 | Sesser |
| 5,988,523 | A | | 11/1999 | Scott |
| 6,019,295 | A | | 2/2000 | McKenzie |
| 6,029,907 | A | | 2/2000 | McKenzie |
| 6,042,021 | A | | 3/2000 | Clark |
| 6,050,502 | A | | 4/2000 | Clark |
| 6,085,995 | A | | 7/2000 | Kah, Jr. et al. |
| 6,109,545 | A | | 8/2000 | Kah, Jr. |
| 6,138,924 | A | | 10/2000 | Hunter et al. |
| 6,145,758 | A | | 11/2000 | Ogi et al. |
| 6,158,675 | A | | 12/2000 | Ogi |
| 6,182,909 | B1 | | 2/2001 | Kah, Jr. et al. |
| 6,227,455 | B1 | | 5/2001 | Scott et al. |
| 6,237,862 | B1 | | 5/2001 | Kah, III et al. |
| 6,241,158 | B1 | | 6/2001 | Clark et al. |
| 6,244,521 | B1 | | 6/2001 | Sesser |
| 6,264,117 | B1 | | 7/2001 | Roman |
| 6,332,581 | B1 | | 12/2001 | Chin et al. |
| 6,336,597 | B1 | | 1/2002 | Kah, Jr. |
| 6,367,708 | B1 | | 4/2002 | Olson |
| D458,342 | S | | 6/2002 | Johnson |
| 6,443,372 | B1 | | 9/2002 | Hsu |
| 6,454,186 | B2 | | 9/2002 | Haverstraw et al. |
| 6,457,656 | B1 | | 10/2002 | Scott |
| 6,464,151 | B1 | | 10/2002 | Cordua |
| 6,488,218 | B1 | | 12/2002 | Townsend et al. |
| 6,491,235 | B1 | | 12/2002 | Scott et al. |
| 6,494,384 | B1 | | 12/2002 | Meyer |
| 6,499,672 | B1 | | 12/2002 | Sesser |
| 6,530,531 | B2 | | 3/2003 | Butler |
| 6,601,781 | B2 | | 8/2003 | Kah, III et al. |
| 6,607,147 | B2 | | 8/2003 | Schneider et al. |
| 6,622,940 | B2 | | 9/2003 | Huang |
| 6,637,672 | B2 | | 10/2003 | Cordua |
| 6,651,905 | B2 | | 11/2003 | Sesser et al. |
| 6,688,539 | B2 | | 2/2004 | Vander Griend |
| 6,695,223 | B2 | | 2/2004 | Beutler et al. |
| 6,732,952 | B2 | | 5/2004 | Kah, Jr. |
| 6,736,332 | B2 | | 5/2004 | Sesser et al. |
| 6,769,633 | B1 | | 8/2004 | Huang |
| 6,814,304 | B2 | | 11/2004 | Onofrio |
| 6,814,305 | B2 | | 11/2004 | Townsend |
| 6,817,543 | B2 | | 11/2004 | Clark |
| 6,827,291 | B2 | | 12/2004 | Townsend |
| 6,834,816 | B2 | | 12/2004 | Kah, Jr. |
| 6,840,460 | B2 | | 1/2005 | Clark |
| 6,848,632 | B2 | | 2/2005 | Clark |
| 6,854,664 | B2 | | 2/2005 | Smith |
| 6,869,026 | B2 | | 3/2005 | McKenzie et al. |
| 6,871,795 | B2 | | 3/2005 | Anuskiewicz |
| 6,883,727 | B2 | | 4/2005 | De Los Santos |

| | | | | |
|---|---|---|---|---|
| 6,921,030 | B2 | 7/2005 | Renquist | |
| 6,945,471 | B2 | 9/2005 | McKenzie et al. | |
| 6,957,782 | B2 | 10/2005 | Clark et al. | |
| 7,017,831 | B2 | 3/2006 | Santiago et al. | |
| 7,028,920 | B2 | 4/2006 | Hekman et al. | |
| 7,028,927 | B2 | 4/2006 | Mermet | |
| 7,032,836 | B2 | 4/2006 | Sesser et al. | |
| 7,032,844 | B2 | 4/2006 | Cordua | |
| 7,040,553 | B2 | 5/2006 | Clark | |
| 7,044,403 | B2 | 5/2006 | Kah, III et al. | |
| 7,090,146 | B1 | 8/2006 | Ericksen et al. | |
| 7,100,842 | B2 | 9/2006 | Meyer et al. | |
| 7,104,472 | B2 | 9/2006 | Renquist | |
| 7,143,957 | B2 | 12/2006 | Nelson | |
| 7,143,962 | B2 | 12/2006 | Kah, Jr. | |
| 7,152,814 | B1 | 12/2006 | Schapper et al. | |
| 7,156,322 | B1 | 1/2007 | Heitzman | |
| 7,159,795 | B2 | 1/2007 | Sesser et al. | |
| 7,168,634 | B2 | 1/2007 | Onofrio | |
| 7,232,081 | B2 | 6/2007 | Kah, Jr. et al. | |
| 7,234,651 | B2 | 6/2007 | Mousavi et al. | |
| 7,240,860 | B2 | 7/2007 | Griend | |
| 7,287,711 | B2 | 10/2007 | Crooks | |
| 7,303,147 | B1 | 12/2007 | Danner et al. | |
| RE40,440 | E | 7/2008 | Sesser | |
| 7,607,588 | B2 | 10/2009 | Nobili | |
| 7,611,077 | B2 * | 11/2009 | Sesser et al. | 239/222.11 |
| 7,621,467 | B1 | 11/2009 | Garcia | |
| 2001/0023901 | A1 | 9/2001 | Haverstraw et al. | |
| 2002/0130202 | A1 | 9/2002 | Kah, Jr. et al. | |
| 2002/0153434 | A1 | 10/2002 | Cordua | |
| 2003/0015606 | A1 | 1/2003 | Cordua | |
| 2003/0075620 | A1 | 4/2003 | Kah, Jr. | |
| 2005/0006501 | A1 | 1/2005 | Englefield | |
| 2007/0181711 | A1 | 8/2007 | Sesser et al. | |
| 2007/0235565 | A1 | 10/2007 | Kah, Jr. et al. | |
| 2008/0169363 | A1 | 7/2008 | Walker | |
| 2008/0257982 | A1 | 10/2008 | Kah et al. | |
| 2009/0014559 | A1 | 1/2009 | Marino | |
| 2009/0072048 | A1 | 3/2009 | Renquist et al. | |
| 2009/0140076 | A1 | 6/2009 | Cordua | |
| 2009/0173803 | A1 | 7/2009 | Kah, Jr. et al. | |
| 2010/0301135 | A1 | 12/2010 | Hunnicutt | |
| 2010/0301142 | A1 | 12/2010 | Hunnicutt | |

FOREIGN PATENT DOCUMENTS

| | | | |
|---|---|---|---|
| EP | 0761312 | A1 | 12/1997 |
| EP | 1043075 | A1 | 11/2000 |
| EP | 2255884 | A1 | 12/2010 |
| WO | WO9735668 | | 10/1997 |
| WO | WO2005099905 | | 10/2005 |

OTHER PUBLICATIONS

Mar. 29, 2011 Office Action, U.S. Appl. No. 12/475,242.

U.S. Appl. No. 12/720,261, filed Mar. 9, 2010, entitled "Sprinkler with Variable Arc and Flow Rate and Method," which is a continuation-in-part application of U.S. Appl. No. 12/475,242.

U.S. Appl. No. 12/952,369, filed Nov. 23, 2010, entitled "Sprinkler with Variable Arc and Flow Rate and Method," which is a continuation-in-part of U.S. Appl. No. 12/720,261.

Aug. 5, 2010 EPO Search Report and Opinion, EPO Application No. 10164085.2.

Office Action mailed Jul. 20, 2011 in U.S. Appl. No. 12/475,242.

Interview Summary mailed Sep. 26, 2011 in U.S. Appl. No. 12/475,242.

Response to Office Action filed Oct. 18, 2011 in U.S. Appl. No. 12/475,242.

Response to Office Action filed Apr. 29, 2011 in U.S. Appl. No. 12/475,242.

Office Action mailed Aug. 24, 2011 in U.S. Appl. No. 11/947,571.

Response to Office Action filed Nov. 24, 2010 in U.S. Appl. No. 11/947,571.

Office Action mailed Apr. 5, 2011 in U.S. Appl. No. 11/947,571.

Response to Office Action filed Jul. 5, 2011 in U.S. Appl. No. 11/947,571.

Advisory Action mailed Jul. 14, 2011 in U.S. Appl. No. 11/947,571.

* cited by examiner

SPRINKLER WITH VARIABLE ARC AND FLOW RATE

FIELD OF THE INVENTION

This invention relates to irrigation sprinklers and, more particularly, to an irrigation sprinkler for distribution of water through an adjustable arc and with an adjustable flow rate.

BACKGROUND OF THE INVENTION

The use of sprinklers is a common method of irrigating landscape and vegetation areas. In a typical irrigation system, various types of sprinklers are used to distribute water over a desired area, including rotating stream type and fixed spray pattern type sprinklers. One type of irrigation sprinkler is the rotating deflector or so-called micro-stream type having a rotatable vaned deflector for producing a plurality of relatively small water streams swept over a surrounding terrain area to irrigate adjacent vegetation.

Rotating stream sprinklers of the type having a rotatable vaned deflector for producing a plurality of relatively small outwardly projected water streams are known in the art. In such sprinklers, one or more jets of water are generally directed upwardly against a rotatable deflector having a vaned lower surface defining an array of relatively small flow channels extending upwardly and turning radially outwardly with a spiral component of direction. The water jet or jets impinge upon this underside surface of the deflector to fill these curved channels and to rotatably drive the deflector. At the same time, the water is guided by the curved channels for projection outwardly from the sprinkler in the form of a plurality of relatively small water streams to irrigate a surrounding area. As the deflector is rotatably driven by the impinging water, the water streams are swept over the surrounding terrain area, with the range of throw depending on the flow rate of water through the sprinkler.

In rotating stream sprinklers of this general type, it is desirable to control the arcuate area through which the sprinkler distributes water. In this regard, it is desirable to use a sprinkler that distributes water through a variable pattern, such as a full circle, half-circle, or some other arc portion of a circle, at the discretion of the user. Traditional variable arc sprinklers suffer from limitations with respect to setting the water distribution arc. Some have used interchangeable pattern inserts to select from a limited number of water distribution arcs, such as quarter-circle or half-circle. Others have used punch-outs to select a fixed water distribution arc, but once a distribution arc was set by removing some of the punch-outs, the arc could not later be reduced. Many conventional sprinklers have a fixed, dedicated construction that permits only a discrete number of arc patterns and prevents them from being adjusted to any arc pattern desired by the user.

Other conventional sprinkler types allow a variable arc of coverage but only for a limited arcuate range. It would be desirable to have a single sprinkler head that covers substantially a full range of arcuate coverage, rather than several models that provide a limited arcuate range of coverage. For rotating stream sprinklers, however, it is difficult to provide coverage for low angles, such as from about 0 degrees to about 90 degrees, because water flow may not be adequate at these low angles to impart sufficient force to the rotating deflector. Thus, it would be desirable to have a single sprinkler head that could provide arcuate coverage from about at least 90 degrees to about 360 degrees.

Because of the limited adjustability of the water distribution arc, use of such conventional sprinklers may result in overwatering or underwatering of surrounding terrain. This is especially true where multiple sprinklers are used in a predetermined pattern to provide irrigation coverage over extended terrain. In such instances, given the limited flexibility in the types of water distribution arcs available, the use of multiple conventional sprinklers often results in an overlap in the water distribution arcs or in insufficient coverage. Thus, certain portions of the terrain are overwatered, while other portions are not watered at all. Accordingly, there is a need for a variable arc rotating stream sprinkler head that allows a user to set the water distribution arc along the continuum from at least substantially 90 degrees to substantially 360 degrees, without being limited to certain discrete angles of coverage.

It is also desirable to control or regulate the throw radius of the water distributed to the surrounding terrain. In this regard, in the absence of a flow rate adjustment device, the irrigation sprinkler will have limited variability in the throw radius of water distributed from the sprinkler, given relatively constant water pressure from a source. The inability to adjust the throw radius results both in the wasteful watering of terrain that does not require irrigation or insufficient watering of terrain that does require irrigation. A flow rate adjustment device is desired to allow flexibility in water distribution and to allow control over the distance water is distributed from the sprinkler, without varying the water pressure from the source. Some designs provide only limited adjustability and, therefore, allow only a limited range over which water may be distributed by the sprinkler.

In addition, it has been found that adjustment of the distribution arc is a commonly used feature of rotating stream sprinklers and other sprinklers. It would be therefore desirable to make this feature accessible from the top of the sprinkler's cap, which is generally more convenient to the user. Conventional rotating stream sprinklers generally do not allow arc adjustment from the top of the sprinkler's cap.

Accordingly, a need exists for a truly variable arc sprinkler that can be adjusted to any water distribution arc from at least about 90 degrees to substantially 360 degrees. In addition, a need exists to increase the adjustability of flow rate and throw radius of an irrigation sprinkler without varying the water pressure, particularly for rotating stream sprinkler heads of the type for sweeping a plurality of relatively small water streams over a surrounding terrain area. Further, a need exists for a rotating stream sprinkler that allows a user to adjust the distribution arc from the top of the sprinkler's cap and to adjust the throw radius by actuating or rotating an outer wall portion of the sprinkler.

DESCRIPTION OF THE PREFERRED EMBODIMENTS

Figure 1:
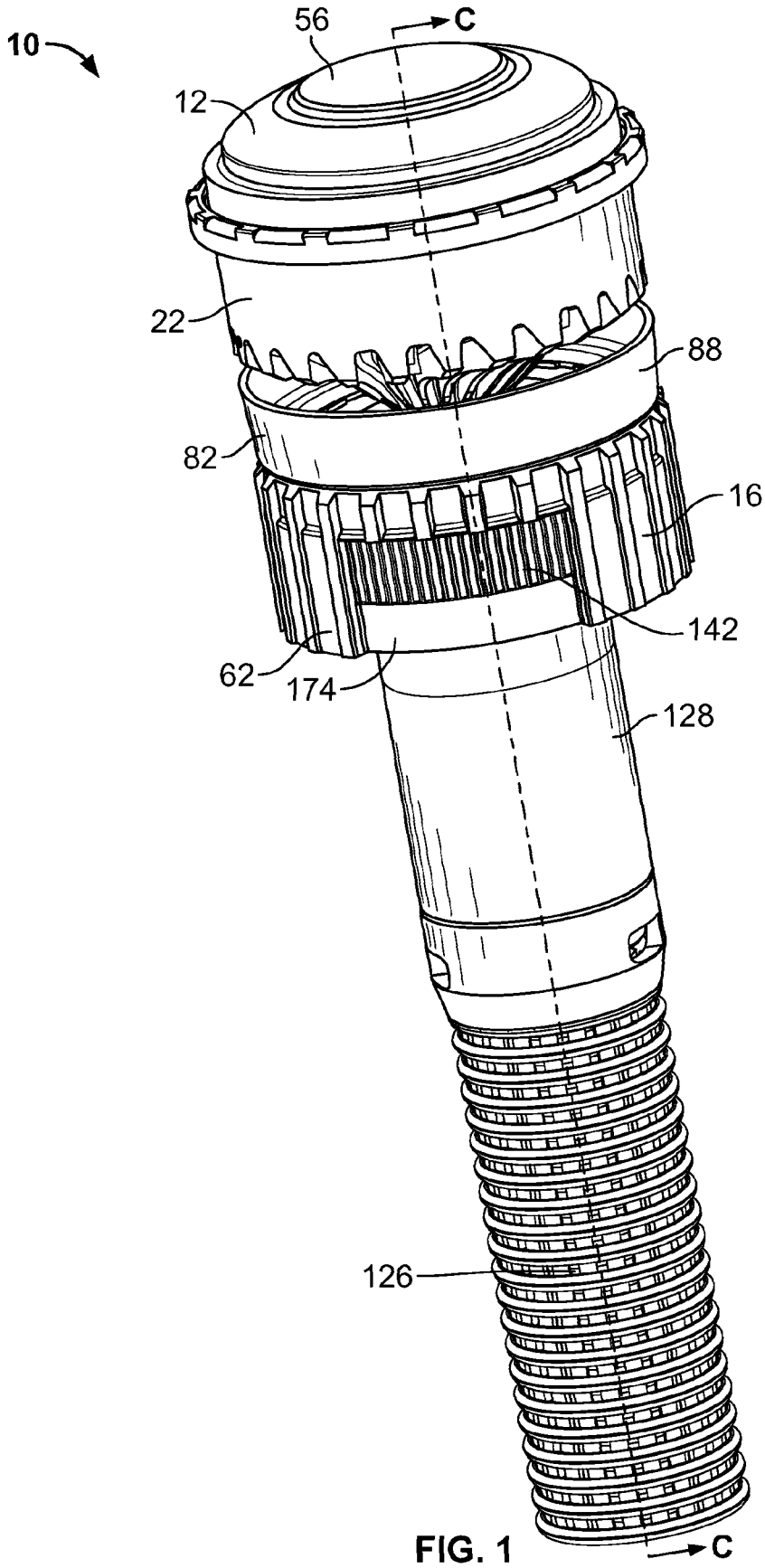
FIG. 1 is a perspective view of a first embodiment of a rotating stream sprinkler embodying features of the present invention.

FIGS. 1-4 show a first preferred embodiment of the rotating stream sprinkler 10. The sprinkler 10 possesses an arc adjustability capability that allows a user to generally set the arc of water distribution to virtually any desired angle between at least about 90 degrees and substantially 360 degrees. The arc adjustment feature is accessible via a cap 12 at the top of the sprinkler 10, such as through the use of a hand tool or a push-down interface, as described further below. The rotating stream sprinkler 10 also preferably includes a flow rate adjustment feature, which is shown in FIGS. 1-4, to regulate flow rate. The flow rate adjustment feature is accessible by rotating an outer wall portion of the sprinkler 10, as described further below.

The rotating stream sprinkler 10 generally comprises a compact unit, preferably made primarily of lightweight molded plastic, which is adapted for convenient thread-on mounting onto the upper end of a stationary or pop-up riser (not shown). In operation, water under pressure is delivered through the riser to a nozzle body 16. The water initially passes through an inlet controlled by an adjustable flow rate adjustment feature that regulates the amount of fluid flow through the nozzle body 16. The water is then directed through an arcuate slot 20 that is generally adjustable between about 0, and 360 degrees and controls the arcuate span of water distributed from the sprinkler 10. Water is directed generally upwardly through the arcuate slot 20 to produce one or more upwardly directed water jets that impinge the underside surface of a deflector 22 for rotatably driving the deflector 22. The arcuate slot 20 is an outlet for the nozzle body 16. Although the arcuate slot 20 is generally adjustable through an entire 360, degree arcuate range, water flowing through the slot 20 may not be adequate to impart sufficient force for desired rotation of the deflector 22, when the slot 20 is set at relatively low angles, and which may result in the sprinkler 10 being in an inoperable condition at these low angles.

Figure 4:
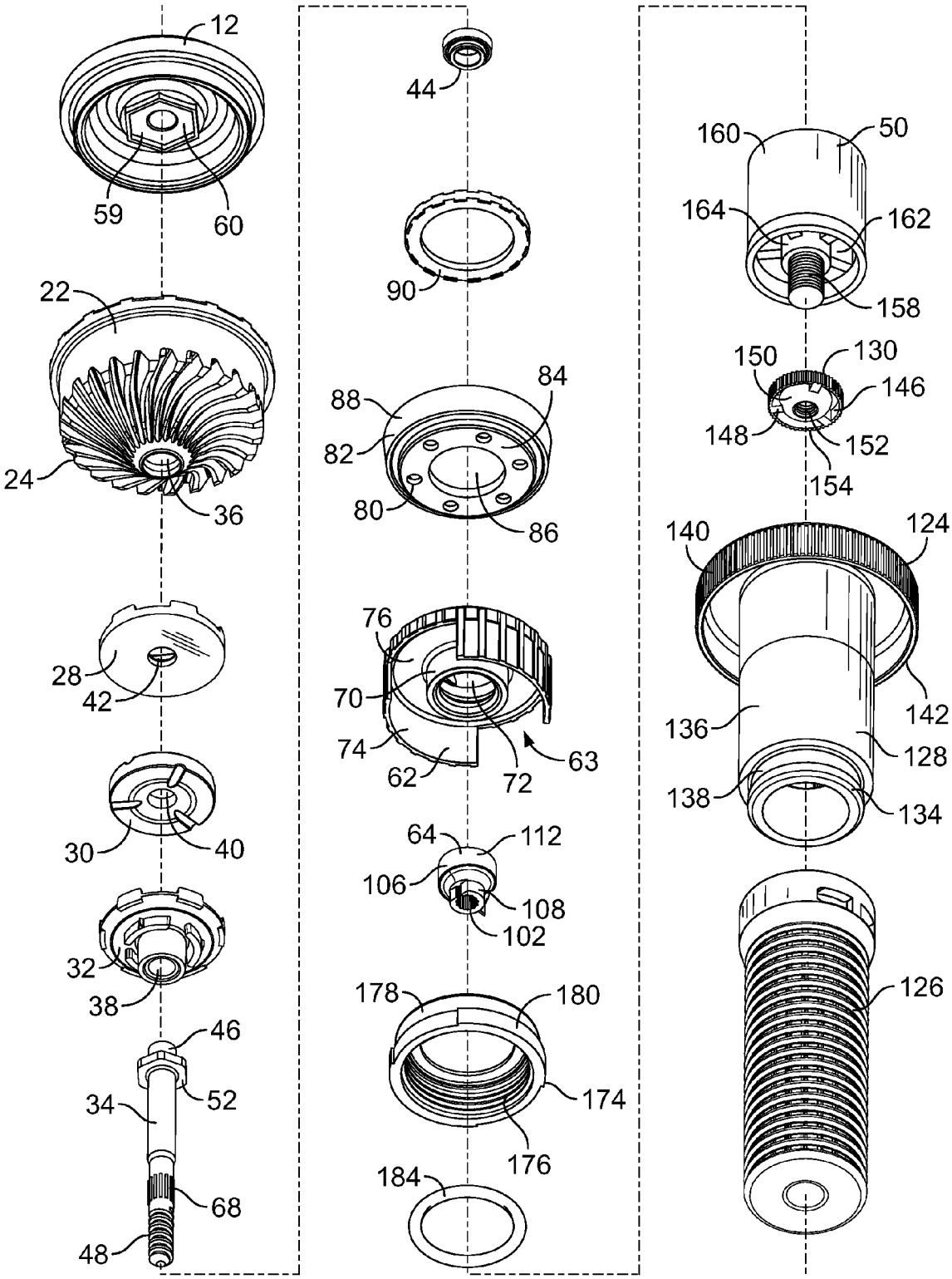
FIG. 4 is a bottom exploded perspective view of the rotating stream sprinkler of FIG. 1.

The rotatable deflector 22 has an underside surface that is contoured to deliver a plurality of fluid streams generally radially outwardly therefrom through an arcuate span. As shown in FIG. 4, the underside surface of the deflector 22 preferably includes an array of spiral vanes 24. The spiral vanes 24 subdivide the water jet or jets into the plurality of relatively small water streams which are distributed radially outwardly therefrom to surrounding terrain as the deflector 22 rotates. The vanes 24 define a plurality of intervening flow channels extending upwardly and spiraling along the underside surface to extend generally radially outwardly with a selected inclination angle. During operation of the sprinkler 10, the upwardly directed water jet or jets impinge upon the lower or upstream segments of these vanes 24, which subdivide the water flow into the plurality of relatively small flow streams for passage through the flow channels and radially outward projection from the sprinkler 10. A deflector like the type shown in U.S. Pat. No. 6,814,304,, which is assigned to the assignee of the present application and is incorporated herein by reference in its entirety, is preferably used. Other types of rotating deflectors used in rotating stream sprinkler heads, however, may also be employed. In addition, non-rotating deflectors used in non-rotating sprinkler heads may be used. Such non-rotating deflectors need not have an underside surface with spiral vanes but do preferably otherwise have the same general shape as deflector 22, including, as described below, having a bore for insertion of an arc adjustment member that can be adjusted by a user from a top surface of the sprinkler.

The deflector 22 also preferably includes a speed control brake to control the rotational speed of the deflector 22, as more fully described in U.S. Pat. No. 6,814,304. In the preferred form shown in FIGS. 3 and 4, the speed control brake includes a brake disk 28, a brake pad 30, and a friction plate 32. The friction plate 32 is rotatable with the deflector 22 and, during operation of the sprinkler 10, is urged against the brake pad 30, which, in turn, is retained against the stationary brake disk 28. Water is directed upwardly and strikes the deflector 22, pushing the deflector 22 and friction plate 32 upwards and causing rotation. In turn, the rotating friction plate 32 engages the brake pad 30, resulting in frictional resistance that serves to reduce, or brake, the rotational speed of the deflector 22. Although the speed control brake is shown and preferably used in connection with sprinkler 10 described and claimed herein, other brakes or speed reducing mechanisms are available and may be used to control the rotational speed of the deflector 22.

Figure 3:
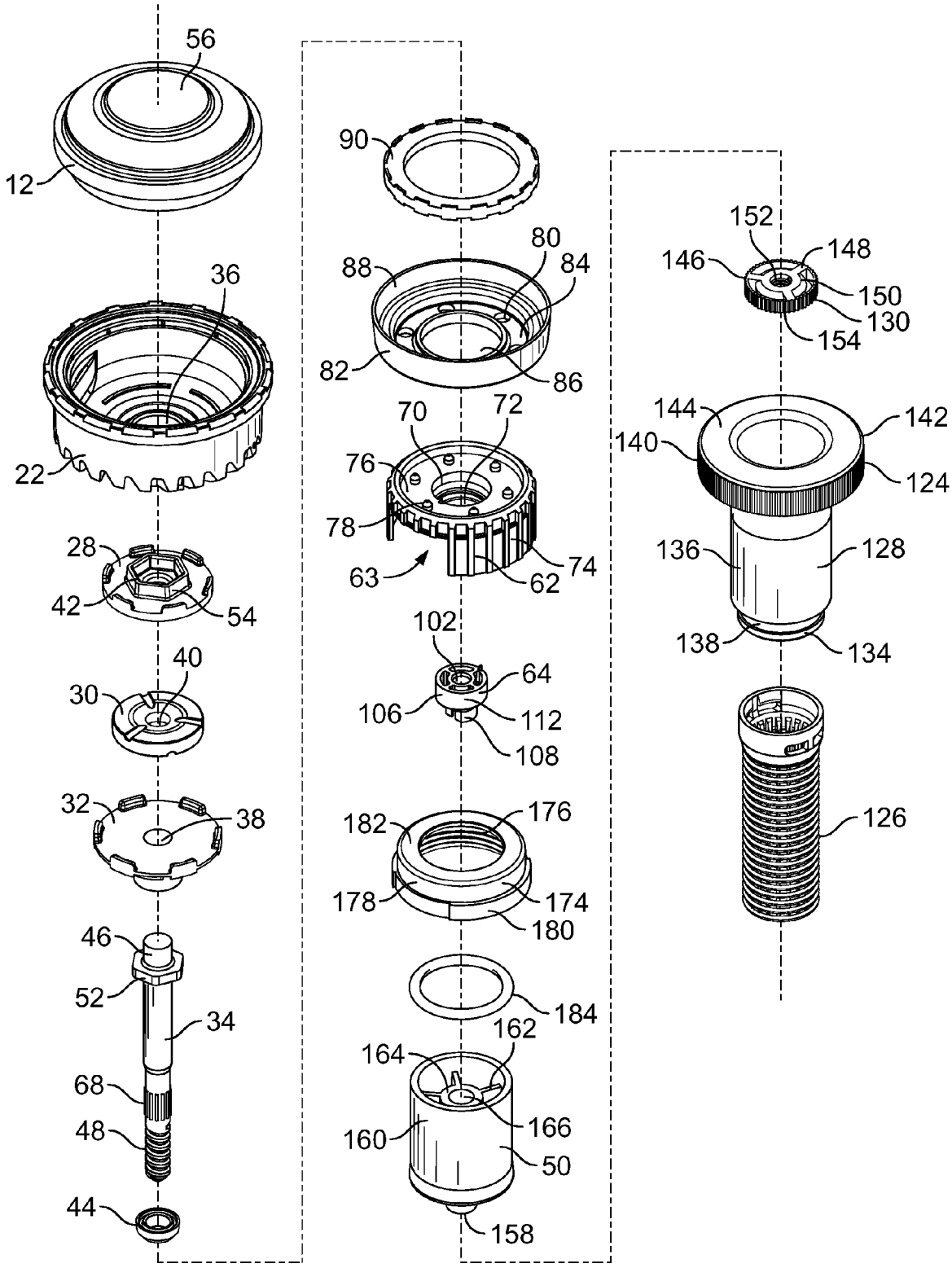
FIG. 3 is a top exploded perspective view of the rotating stream sprinkler of FIG. 1.

The arc adjustment feature of the sprinkler 10 is adjusted through the use of an arc adjustment member 34. The arc adjustment member 34 lies along and defines a central axis C-C of the sprinkler 10, and the deflector 22 is rotatably mounted on an upper end of the member 34. As can be seen from FIGS. 3-4, the arc adjustment member 34 extends through a bore 36 in the deflector 22 and through bores 38, 40, and 42 in the friction plate 32, brake pad 30, and brake disk 28, respectively. The sprinkler 10 also preferably includes a seal member 44, such as an o-ring, about the arc adjustment member 34 at the deflector bore 36 to prevent the ingress of upwardly-directed fluid into the interior of the deflector 22. The arc adjustment member 34 may have a flat top surface at one end 46, as shown in FIGS. 3 and 4, that may be depressed by a user, as described further below, for rotation of the member 34. The other end 48 is threaded for engagement with a hub member 50, as described further below.

As shown in FIGS. 3 and 4, the arc adjustment member 34 also preferably includes a lock flange 52 for engagement with a lock seat 54 of the brake disk 28 when the arc adjustment member 34 is mounted. The flange 52 is preferably hexagonal in shape for engagement with a correspondingly hexagonally shaped lock seat 54, although other shapes may be used. The engagement of the flange 52 within the lock seat 54 prevents rotation of the brake disk 28 during operation of the sprinkler 10.

A cap 12 is mounted to the top of the deflector 22. The cap 12 preferably includes a depressible top surface 56. The cap 12 prevents grit and other debris from coming into contact with the components in the interior of the deflector 22, such as the speed control brake components, and thereby hindering the operation of the sprinkler 10.

The cap 12 preferably includes an interface 59 mounted to the underside surface of the cap 12. The interface 59 preferably defines an aperture 60 for insertion of the upper end 46 of the arc adjustment member 34. The interface 59 preferably has a hexagonal shape and defines a hexagonal recess therein for engagement with the hexagonal lock flange 52 of the arc adjustment member 34. A user depresses the top surface 56 that, in turn, depresses the interface 59 to cause it to engage the lock flange 52. The user may then rotate the arc adjustment member 34 to the desired arcuate span, as described further below. This type of cap 12 eliminates the need for a hand tool to operate the arc adjustment member 34 and the need for an additional seal.

The variable arc capability of sprinkler 10 results from the interaction of two portions of the nozzle body 16 (nozzle cover 62 and valve sleeve 64). More specifically, as shown in FIGS. 2, 5, 8, 10 and 11, the nozzle cover 62 and the valve sleeve 64 have corresponding helical engagement surfaces that may be rotatably adjusted with respect to one another to form an arcuate slot 20. The arcuate slot 20 may be adjusted to any desired water distribution arc by the user through rotation of the arc adjustment member 34. The arc adjustment member 34 has an external splined surface 68 for engagement with and rotation of the valve sleeve 64, as described further below.

Figure 8:
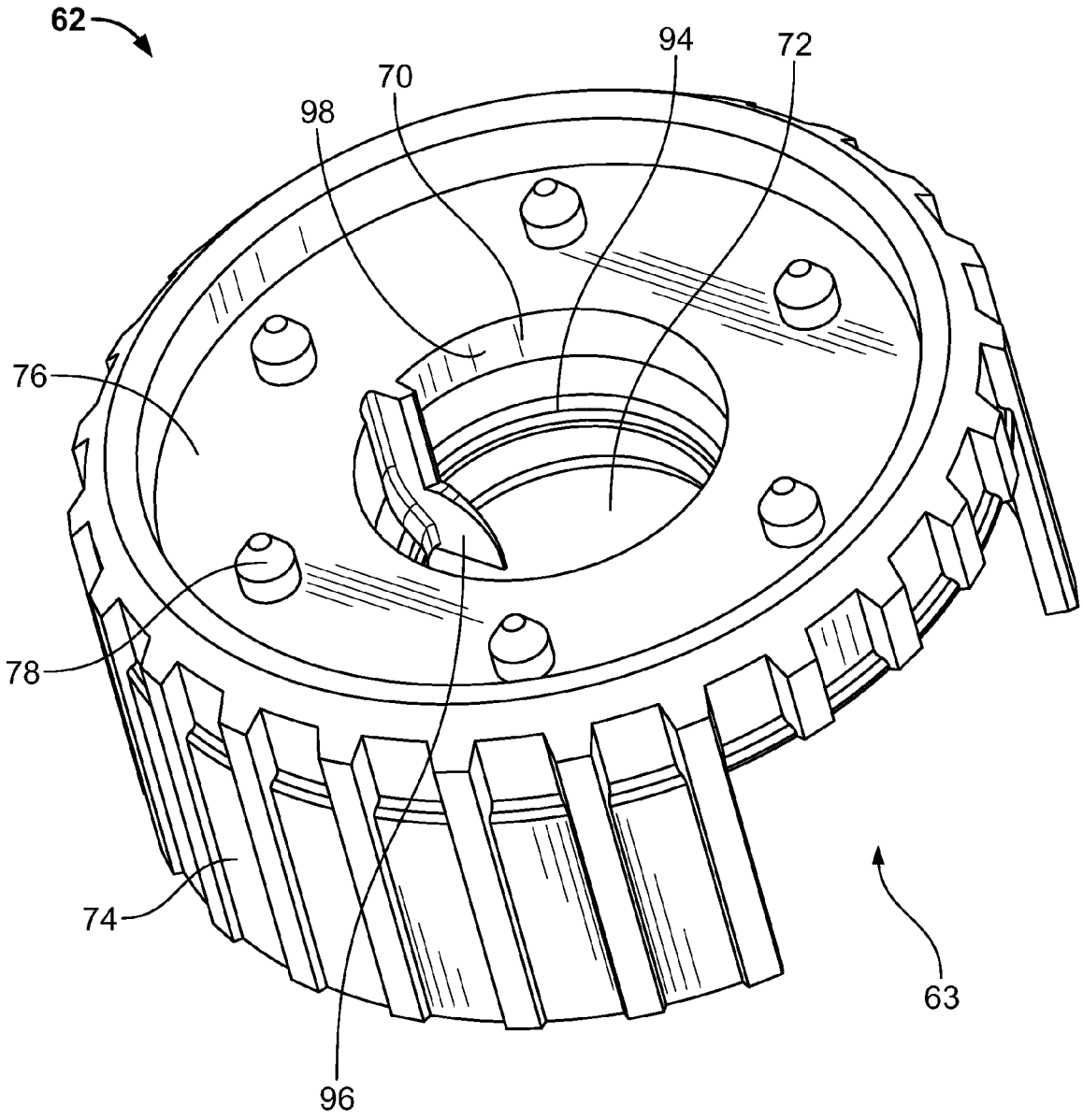
FIG. 8 is a top perspective view of the cover of the rotating stream sprinkler of FIG. 1.
Figure 9:
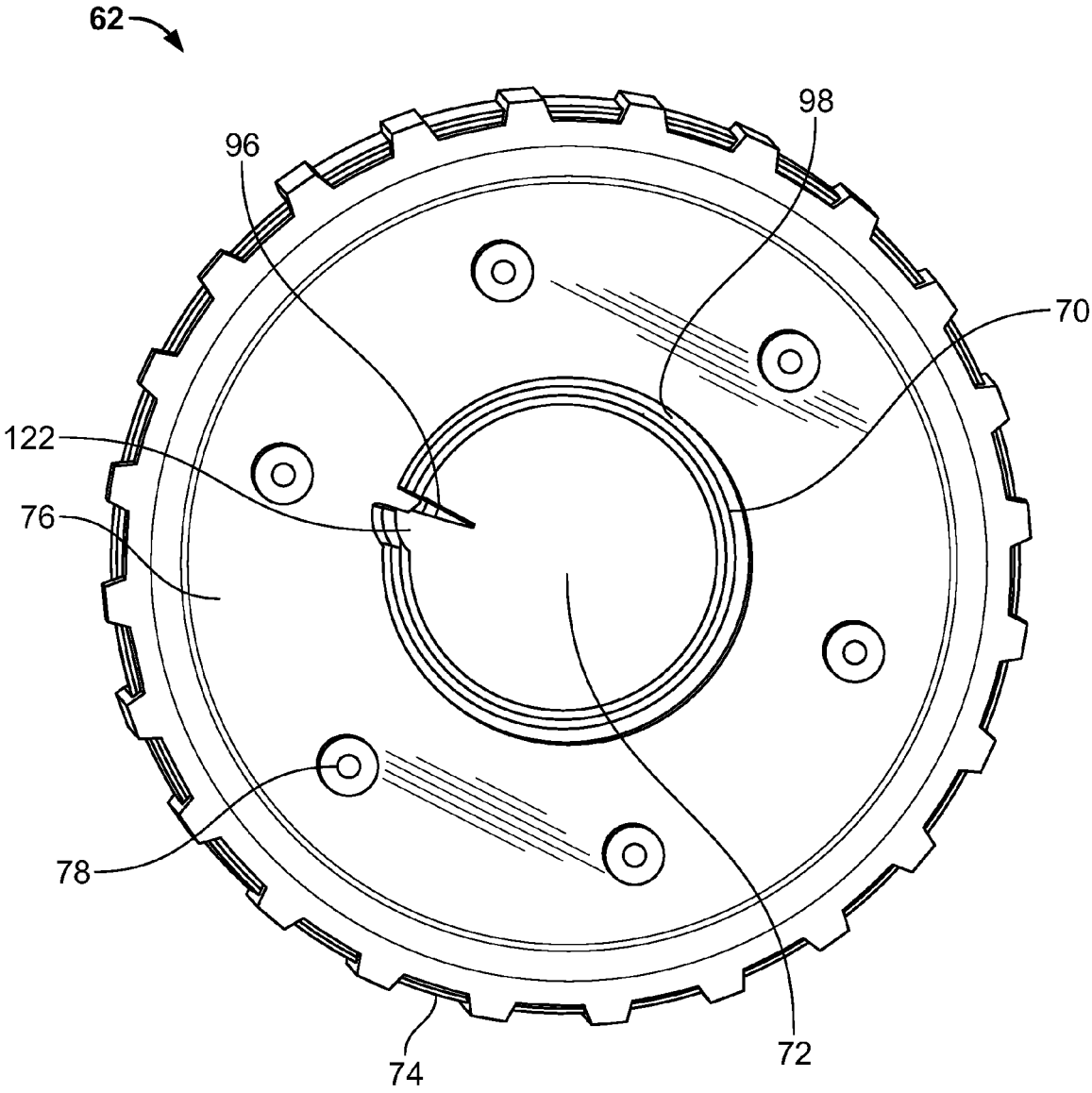
FIG. 9 is a top plan view of the cover of the rotating stream sprinkler of FIG. 1.
Figure 10:
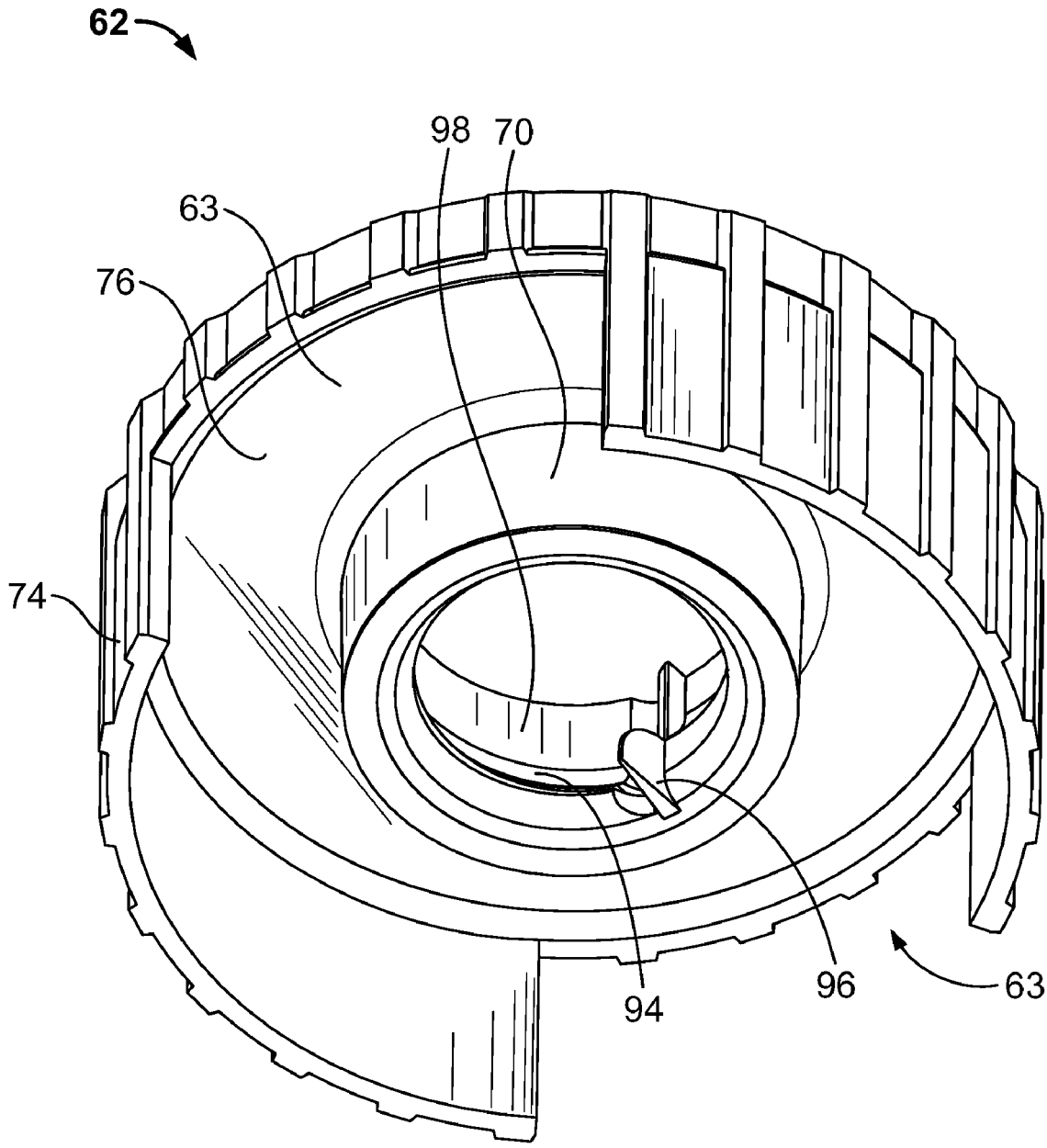
FIG. 10 is a bottom perspective view of the cover of the rotating stream sprinkler of FIG. 1.

As shown in FIGS. 8-10, the nozzle cover 62 is generally cylindrical in shape and includes a central hub 70 that defines a bore 72 for insertion of the valve sleeve 64. The nozzle cover 62 preferably includes an outer cylindrical wall 74 having an external knurled surface for easy and convenient gripping and rotating of the sprinkler 10 to assist in mounting onto the threaded end of a riser. The nozzle cover 62 also preferably includes an annular top surface 76 with circumferential equidistantly spaced bosses 78 extending upwardly from the top surface 76. The bosses 78 engage corresponding circumferential equidistantly spaced apertures 80 in a rubber collar 82 mounted on top of the nozzle cover 62. The rubber collar 82 includes an annular portion 84 that defines a central bore 86, the apertures 80, and a raised cylindrical wall 88 that extends upwardly but does not engage the deflector 22. The rubber collar 82 is retained against the nozzle cover 62 by a rubber collar retainer 90, which is preferably an annulus that engages the tops of the bosses 78.

Figure 11:
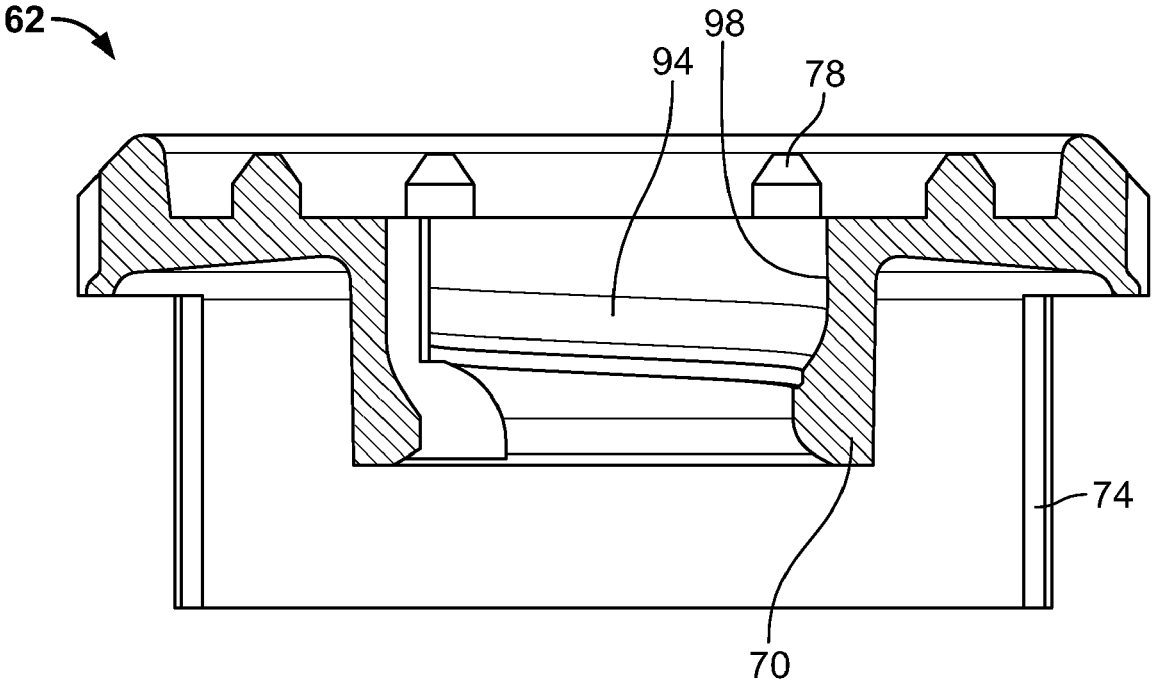
FIG. 11 is a cross-sectional view of the cover of the rotating stream sprinkler of FIG. 1.

As shown in FIGS. 8, 10 and 11, the central hub 70 of the stationary nozzle cover 62 has an internal helical surface 94 that defines approximately one 360, degree helical revolution, or turn. The ends of the helical turn are axially offset and joined by a fin 96, which projects radially inwardly from the central hub 70. The central hub 70 extends upwardly from the internal helical surface 94 into a raised cylindrical wall 98 with the fin 96 extending axially along the cylindrical wall 98.

Figure 5:
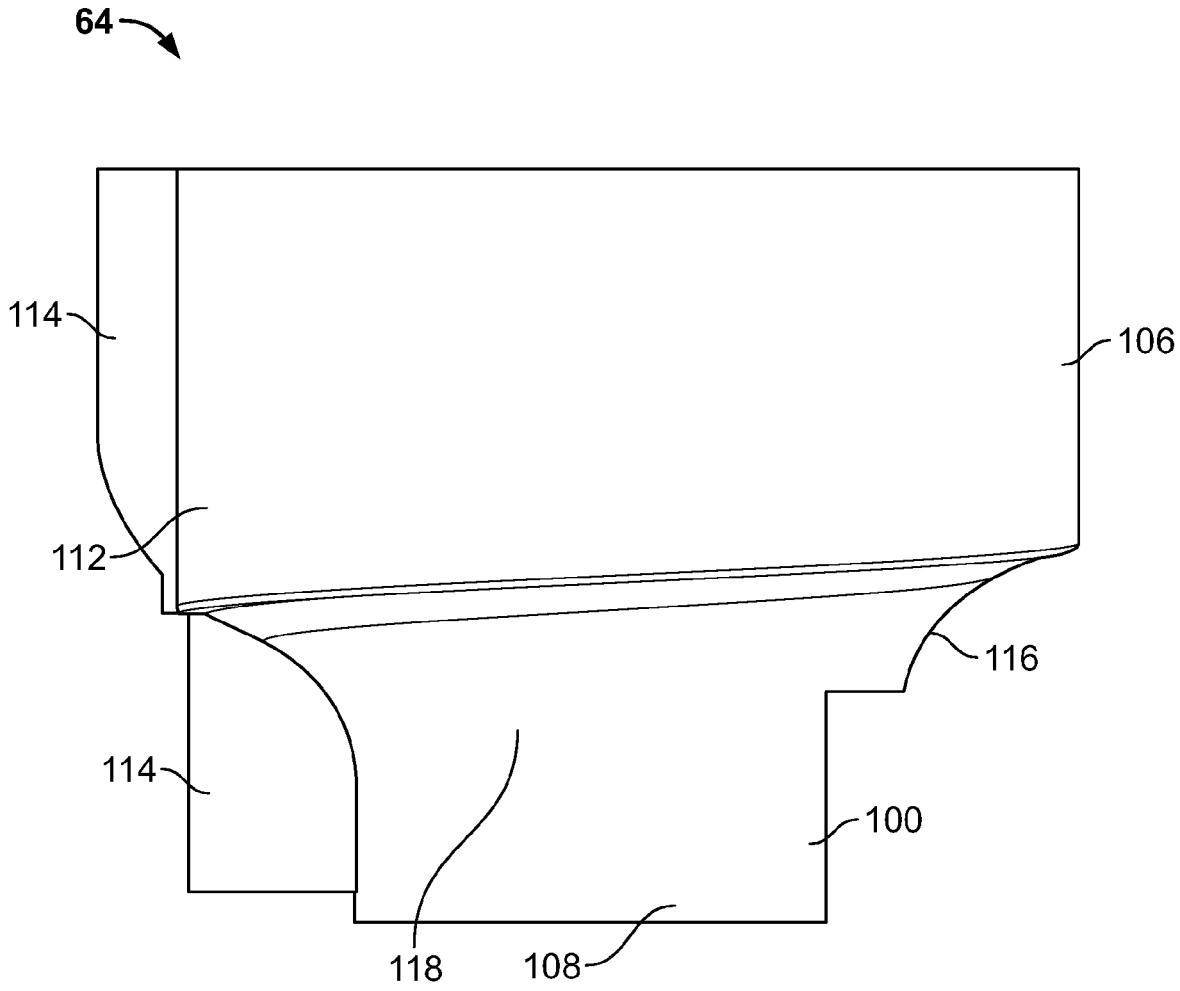
FIG. 5 is a side elevational view of the valve sleeve of the rotating stream sprinkler of FIG. 1.
Figure 6:
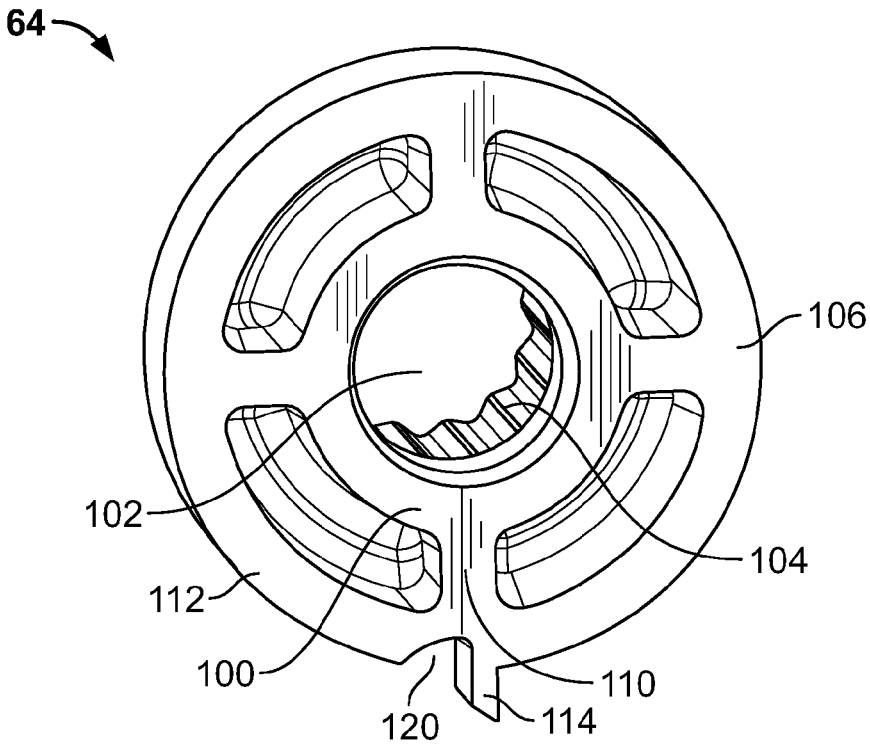
FIG. 6 is a top plan view of the valve sleeve of the rotating stream sprinkler of FIG. 1.
Figure 7:
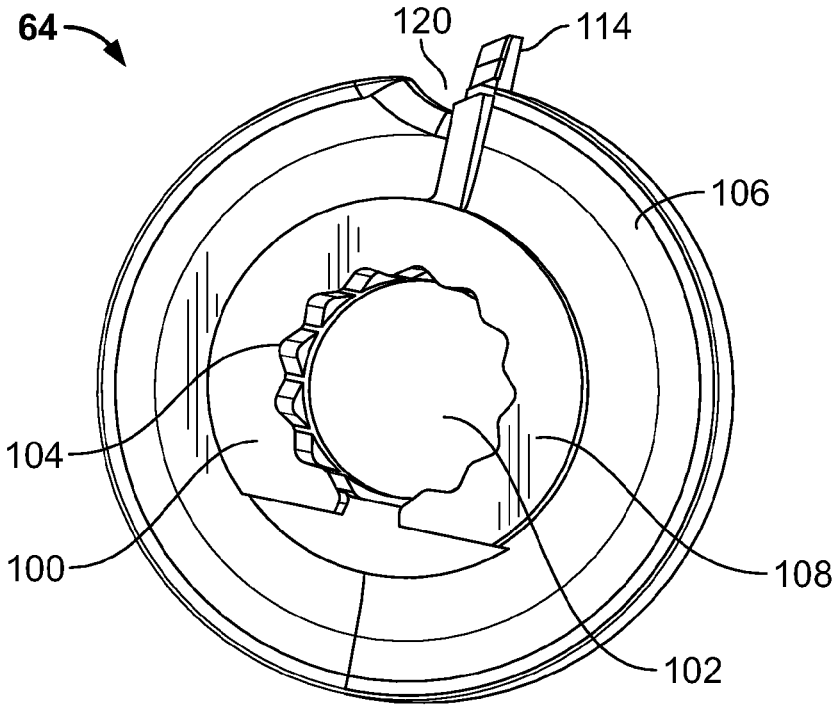
FIG. 7 is a bottom plan view of the valve sleeve of the rotating stream sprinkler of FIG. 1.

As shown in FIGS. 5-7, the valve sleeve 64 also has a generally cylindrical shape. The valve sleeve 64 includes a central hub 100 defining a bore 102 therethrough for insertion of the arc adjustment member 34. The inside of the hub 100 has a surface for engagement with the arc adjustment member 34 to allow rotation of the member 34 to cause rotation of the valve sleeve 64. The engagement surface is preferably a splined surface 104 for engagement with a corresponding splined surface 68 on the arc adjustment member 34. Although splined engagement surfaces are described herein, it should be evident that other conventional engagement surfaces, such as threaded surfaces, may be used to effect simultaneous rotation of the valve sleeve 64 with the arc adjustment member 34. It should be evident that when engagement surfaces are addressed throughout this application, a number of conventional surfaces are available, such as splined, threaded, and other types of surfaces, and the engagement surfaces are not limited to those specifically described herein.

The valve sleeve 64 preferably includes an upper cylindrical portion 106 and a lower cylindrical portion 108 having a smaller diameter than the upper portion 106. The upper portion 106 preferably has ribs 110 that join the central hub 100 to an outer wall 112. The lower cylindrical portion 108 preferably includes the splined surface 104 on the inside of the central hub 100. A fin 114 projects radially outwardly and extends axially along the outside of the valve sleeve, i.e., along the outer wall 112 of the upper portion 106 and along the central hub 100 of the lower portion 108. The lower portion 108 extends upwardly into a gently curved, radiused segment 116 to allow upwardly directed fluid to be redirected slightly through the arcuate slot 20 with a relatively insignificant loss in energy and velocity, as described further below.

Figure 2:
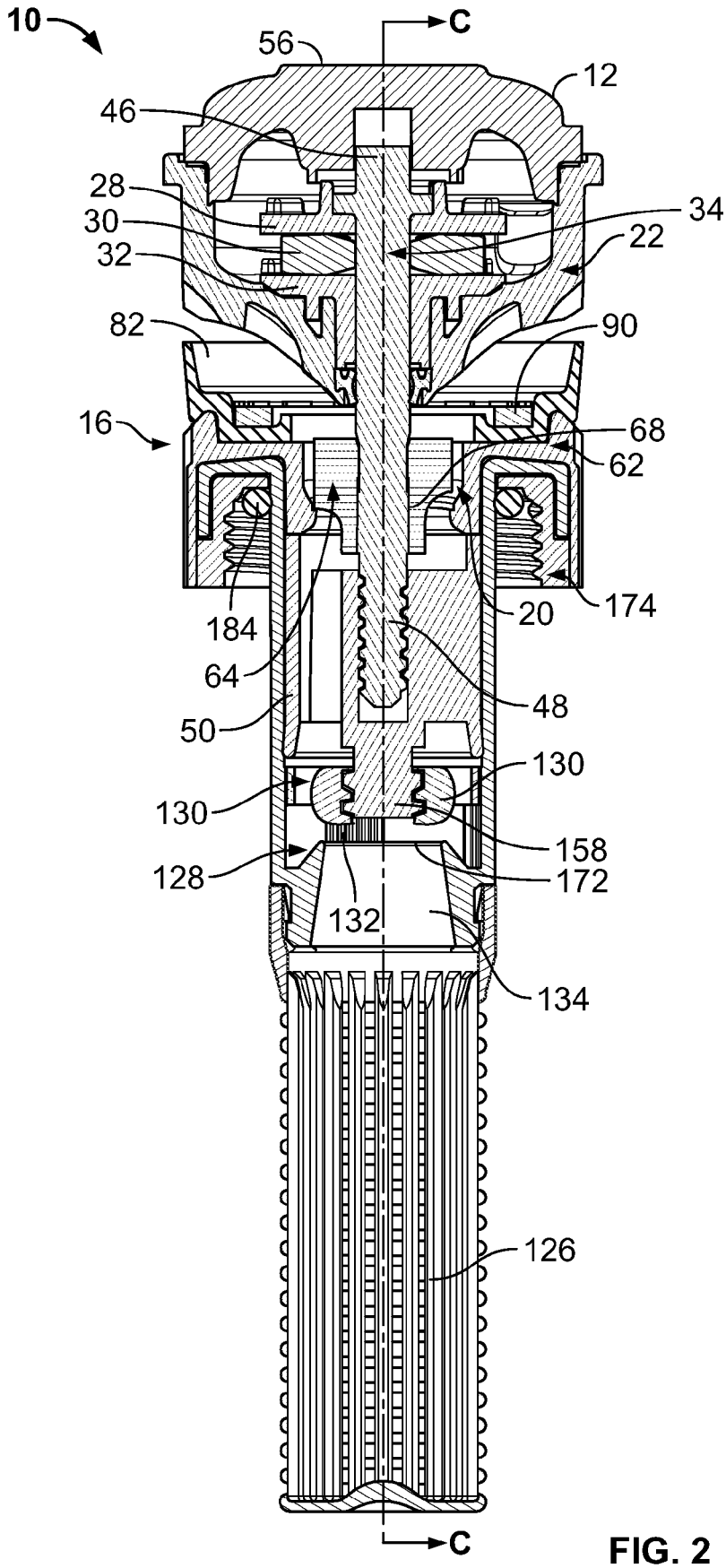
FIG. 2 is a cross-sectional view of the rotating stream sprinkler of FIG. 1.

The arcuate span of the sprinkler 10 is determined by the relative positions of the internal helical surface 94 of the nozzle cover 62 and the complementary external helical surface 118 of the valve sleeve 64, which act together to form the arcuate slot 20. The interaction of the nozzle cover 62 with the valve sleeve 64 forms the arcuate slot 20, as shown in FIG. 2, where the arc is closed on the left of the C-C axis and open on the right of the C-C axis. The size of the arcuate slot 20 is determined by rotation of the arc adjustment member 34 (which in turn rotates the valve sleeve 64) relative to the stationary nozzle cover 62. The valve sleeve 64 may be rotated with respect to the nozzle cover 62 along the complementary helical surfaces through approximately one helical turn to raise or lower the valve sleeve 64. The valve sleeve 64 may be rotated through approximately one 360, degree helical turn with respect to the nozzle cover 62 with the fins 96 and 114 engaging to prevent over-rotation of the valve sleeve 64. The valve sleeve 64 may be rotated relative to the nozzle cover 62 to any arc desired by the user and is not limited to discrete arcs, such as quarter-circle and half-circle. As indicated above, although the arcuate slot 20 is generally adjustable through an entire 360, degree range, water flowing through the slot 20 may not be adequate to impart sufficient force for desired rotation of the deflector 22, when the slot 20 is set at relatively low angles, which may result in the sprinkler 10 being in an inoperable condition at these low angles.

In an initial lowermost position, the valve sleeve 64 is at the lowest point of the helical turn on the nozzle cover 62 and completely obstructs the flow path through the arcuate slot 20. As the valve sleeve 64 is rotated in the clockwise direction, however, the complementary external helical surface 118 of the valve sleeve 64 begins to traverse the helical turn on the internal surface 94 of the nozzle cover 62. As it begins to traverse the helical turn, a portion of the valve sleeve 64 is spaced from the nozzle cover 62 and a gap, or arcuate slot 20, begins to form between the sleeve 64 and the nozzle cover 62. This gap, or arcuate slot 20, provides part of the flow path for water flowing through the sprinkler 10. The angle of the arcuate slot 20 increases as the valve sleeve 64 is further rotated clockwise and the sleeve 64 continues to traverse the helical turn. The sleeve 64 may be rotated clockwise until the rotating fin 114 on the sleeve 64 engages the fixed fin 96 on the cover 62, preventing further rotation of the valve sleeve 64. At this point, the valve sleeve 64 has traversed the entire helical turn and the angle of the arcuate slot 20 is substantially 360 degrees. In this position, water is distributed in a full circle arcuate span from the sprinkler 10. The dimensions of the splined surfaces 68 and 104 of the arc adjustment member 34 and valve sleeve 64 are preferably selected to provide over-rotation protection such that further rotation of the arc adjustment member 34 causes "slippage" of the splined surfaces 68 and 104 allowing the member 34 to continue to rotate without corresponding rotation of the valve sleeve 64. More specifically, as shown in FIG. 7, the lower portion 108 of the valve sleeve 64 is essentially in the form of a split ring, which allows the lower portion 108 to flex outwardly upon continued rotation of the member 34.

When the valve sleeve 64 is rotated counterclockwise, the angle of the arcuate slot 20 is decreased. The complementary external helical surface 118 of the valve sleeve 64 traverses the helical turn in the opposite direction until it reaches the bottom of the helical turn. When the surface 118 of the valve sleeve 64 has traversed the helical turn completely, the arcuate slot 20 is closed and the flow path through the sprinkler 10 is completely or almost completely obstructed. Again, the fins 96 and 114 prevent further rotation of the valve sleeve 64, and continued rotation of the arc adjustment member 34 results in slippage of the splined surfaces 68 and 104.

When the valve sleeve 64 has been rotated to form the open arcuate slot 20, water passes through the arcuate slot 20 and impacts the raised cylindrical wall 98. The wall 98 redirects the water exiting the arcuate slot 20 in a generally vertical direction. Water exits the slot 20 and impinges upon the deflector 22 causing rotation and distribution of water through an arcuate span determined by the angle of the arcuate slot 20. The valve sleeve 64 may be adjusted to increase or decrease the angle and thereby change the arc of the water distributed by the sprinkler 10, as desired. Where the valve sleeve 64 is set to a low angle, however, the sprinkler may be in an inoperable condition in which water passing through the slot 20 is not sufficient to cause desired rotation of the deflector 22.

In the embodiment shown in FIGS. 1-4, the valve sleeve 64 and nozzle cover 62 preferably engage each other to permit water flow with relatively undiminished velocity as water exits the arcuate slot 20. More specifically, the valve sleeve 64 includes a gently curved, radiused segment 116 that is preferably oriented to curve gradually radially outward to reduce the loss of velocity as water impacts the segment 116 and passes through the arcuate slot 20. As water passes through the arcuate slot 20, it impacts the segment 116 obliquely and then the cylindrical wall 98 obliquely, rather than at right angles, thereby reducing the loss of energy to maximize water velocity. The cylindrical wall 98 then redirects the water generally vertically to the underside of the deflector 22, where it is, in turn, redirected to surrounding terrain.

As shown in FIGS. 5-10, the sprinkler 10 employs fins 96 and 114 to enhance and create uniform water distribution at the edges of the angular slot 20. As described above, one fin 96 projects inwardly from the nozzle cover 62 and the other fin 114 projects outwardly from the valve sleeve 64. The valve sleeve fin 114 rotates with the valve sleeve 64 while the nozzle cover fin 62 remains stationary. Each fin 96 and 114 extends both radially and axially a sufficient length to increase the axial flow component and reduce the tangential flow component, producing a well-defined edge to the water passing through the angular slot 20. The fins 96 and 114 are sized to allow for rotatable adjustment of the valve sleeve 64 within the bore 72 of the nozzle cover 62 while maintaining a seal.

The fins 96 and 114 define a relatively long axial boundary to channel the flow of water exiting the arcuate slot 20. This long axial boundary reduces the tangential components of flow along the boundary formed by the fins 96 and 114. Also, as shown in FIGS. 5-10, the fins 96 and 114 extend radially to reduce the tangential flow component. The valve sleeve fin 114 extends radially outwardly so that it preferably engages the inner surface of the nozzle cover hub 70. The nozzle cover fin 96 extends radially inwardly so that it preferably engages the outer surface of the valve sleeve 64. By extending the fins radially, water cannot leak into the gaps that would otherwise exist between the valve sleeve 64 and nozzle cover 62. Water leaking into such gaps would otherwise provide a tangential flow component that would interfere with water flowing in an axial direction to the deflector 22. The fins 96 and 114 therefore reduce this tangential component.

The sprinkler 10 is preferably assembled to provide an interference fit for the fins 96 and 114 to maintain a seal. More specifically, the sprinkler 10 is assembled so that there is an interference fit between the valve sleeve fin 114 and the inner surface of the nozzle cover hub 70. Also, the sprinkler 10 is assembled so that there is an interference fit between the nozzle cover fin 96 and the outer surface of the valve sleeve 64.

These interference fits are preferably accomplished through the use of a channel 120 adjacent to the valve sleeve fin (FIGS. 6 and 7) and through the use of a channel 122 adjacent to the nozzle cover fin 96 (FIG. 9). The valve sleeve channel 120 extends axially along the outer wall 112 adjacent a portion of the valve sleeve fin 114, and the nozzle cover channel 122 extends axially along the cylindrical wall 98 adjacent the nozzle cover fin 96. During assembly, the valve sleeve channel 120 provides sufficient clearance for the inwardly projecting nozzle cover fin 96. Similarly, during assembly, the nozzle cover channel 122 provides sufficient clearance for the outwardly projecting valve sleeve fin 114. Upon rotation, the channels 120 and 122 allow the valve sleeve 64 and nozzle cover 62 to gradually deform the respective fins 96 and 114 into their sealing positions.

The channels 120 and 122 provide other advantages in addition to their use during assembly. More specifically, channels 120 and 122 also help provide well-defined edges for the water stream passing through the arcuate slot 20. The channels 120 and 122 enhance and define the respective edges of the water stream by columnating the water flow and by allowing an additional volume of flow along each of the edges. These fins and channels are described in more detail in Published Application No. 2008/0169363, which application is assigned to the assignee of the present application and which is incorporated herein by reference in its entirety.

The rotating stream sprinkler 10 also preferably includes a flow rate adjustment feature. As shown in FIG. 2, the flow rate adjustment feature is preferably used in conjunction with the rotating stream sprinkler 10. The flow rate adjustment feature, however, may also be used with other types of sprinklers, including non-rotating stream and non-variable arc sprinklers. The flow rate adjustment feature may be used generally with any sprinkler by incorporating in the sprinkler a rotatable outer wall portion, i.e., a rotatable nozzle collar, that has an engagement surface to couple the collar to a corresponding engagement surface of a valve, with rotation of the collar controlling the opening and closing of the valve.

The flow rate adjustment feature can be used to selectively set the water flow rate through the sprinkler 10, for purposes of regulating the range of throw of the projected water streams. It is adapted for variable setting through use of a rotatable segment 124 located on an outer wall portion of the sprinkler 10. It functions as a valve that can be opened or closed to allow the flow of water through the sprinkler 10. Also, a filter 126 is preferably located upstream of the flow rate adjustment feature, so that it obstructs passage of sizable particulate and other debris that could otherwise damage the sprinkler components or compromise desired efficacy of the sprinkler 10.

As shown in FIGS. 12-20, the flow rate adjustment feature preferably includes a nozzle collar 128, a throttle control member 130, and a hub member 50. The nozzle collar 128 is rotatable about the central axis C-C of the sprinkler 10. It has an internal engagement surface 132 and engages the throttle control member 130 so that rotation of the nozzle collar 128 results in rotation of the throttle control member 130. The throttle control member 130 also engages the hub member 50 such that rotation of the throttle control member 130 causes it to move in an axial direction, as described further below. In this manner, rotation of the nozzle collar 128 can be used to move the throttle control member 130 axially closer to and further away from an inlet 134. When the throttle control member 130 is moved closer to the inlet 134, the flow rate is reduced. The axial movement of the throttle control member 130 towards the inlet 134 increasingly pinches the flow through the inlet 134. When the throttle control member 130 is moved further away from the inlet 134, the flow rate is increased. This axial movement allows the user to adjust the effective throw radius of the sprinkler 10 without disruption of the streams dispersed by the deflector 22.

Figure 18:
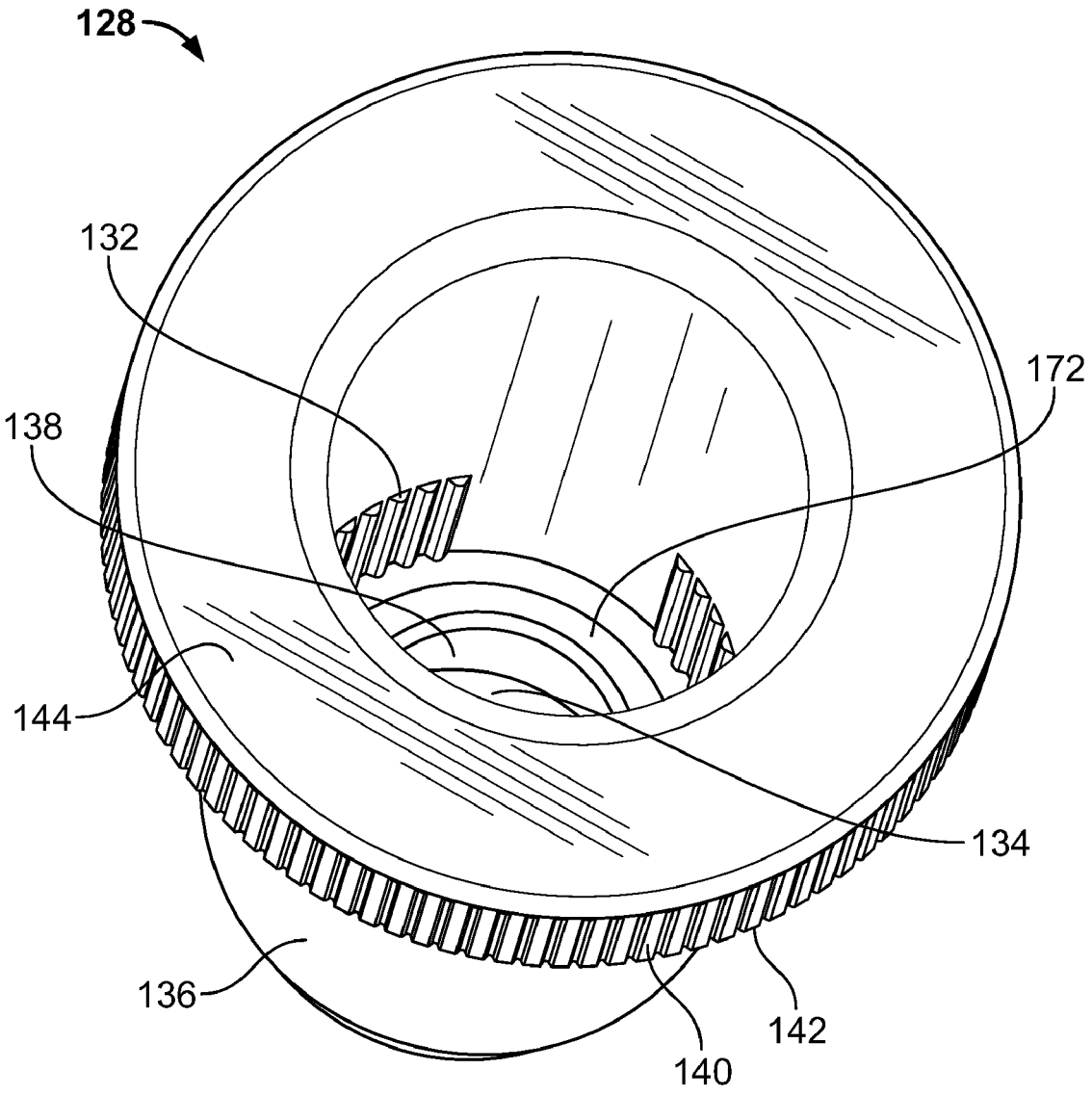
FIG. 18 is a top perspective view of the collar of the rotating stream sprinkler of FIG. 1.
Figure 19:
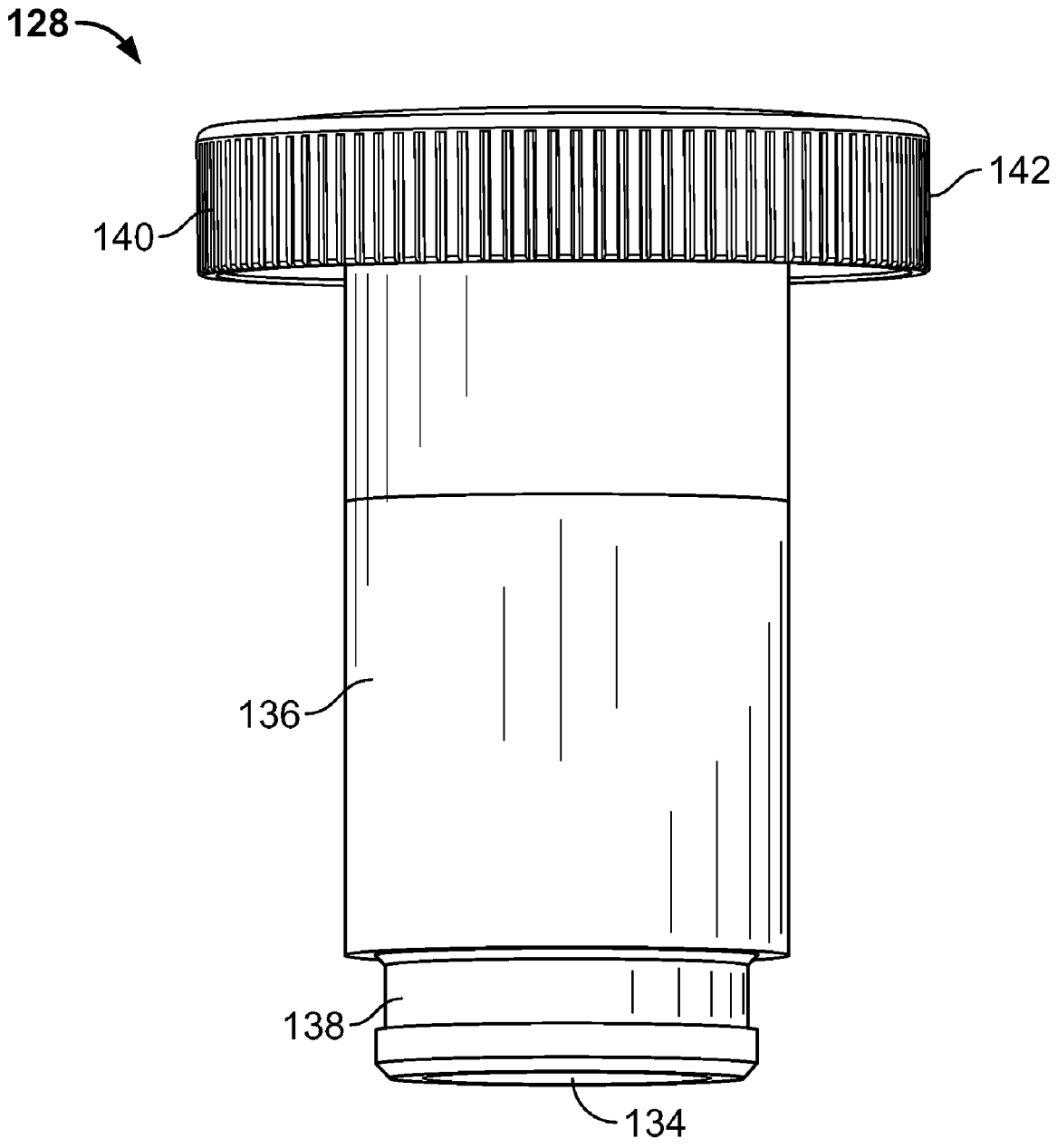
FIG. 19 is a side elevational view of the collar of the rotating stream sprinkler of FIG. 1.
Figure 20:
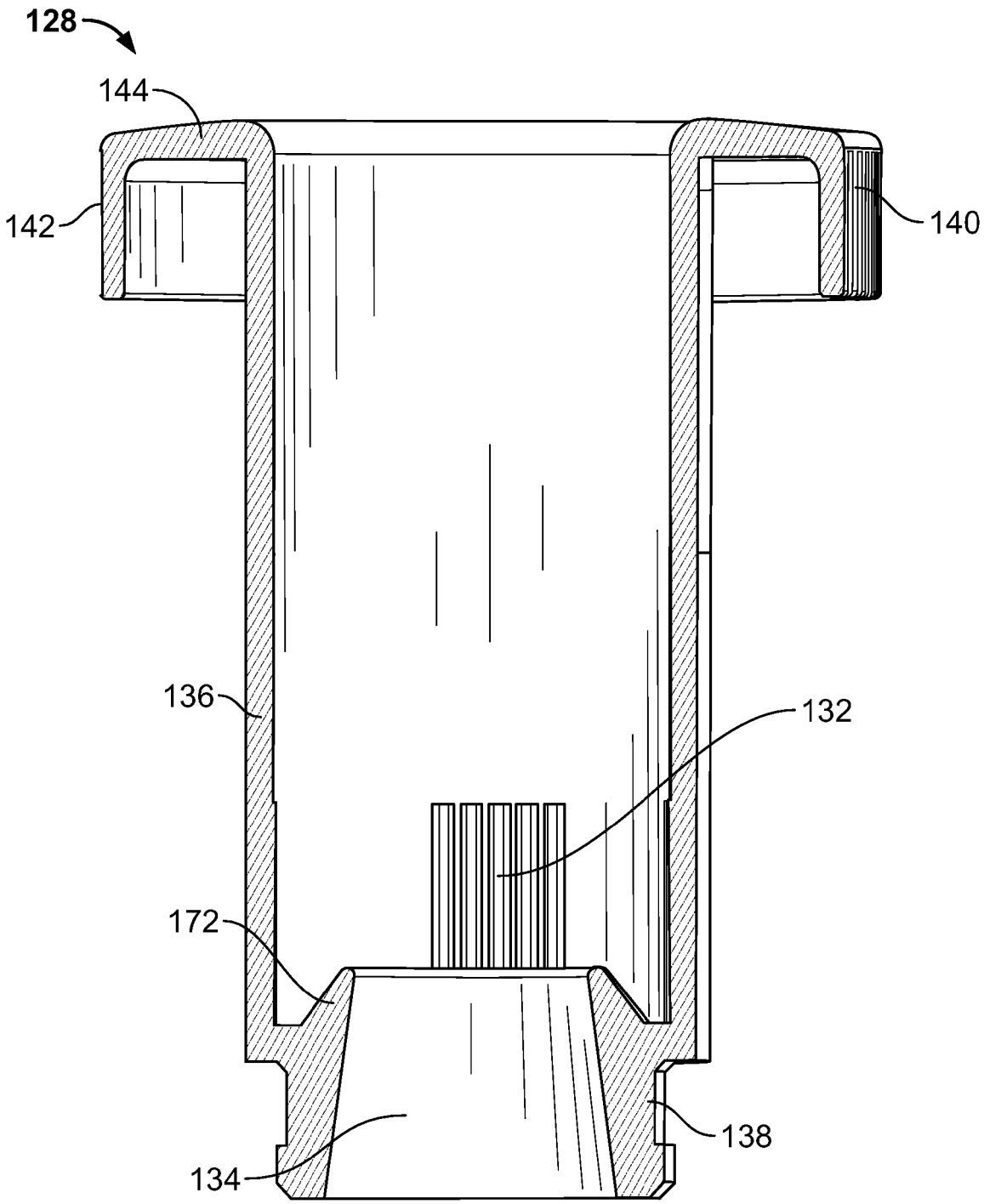
FIG. 20 is a cross-sectional view of the collar of the rotating stream sprinkler of FIG. 1.

As shown in FIGS. 18-20, the nozzle collar 128 preferably includes a first cylindrical portion 136 and a second cylindrical portion 138 having a smaller diameter than the first portion 136. The first portion 136 has an engagement surface 132, preferably a splined surface, on the interior of the cylinder. The nozzle collar 128 preferably also includes an outer wall 140 having an external grooved surface 142 for gripping and rotation by a user that is joined by an annular portion 144 to the first cylindrical portion 136. In turn, the first cylindrical portion 136 is joined to the second cylindrical portion 138, which is essentially the inlet 134 for fluid flow into the nozzle body 16. Water flowing through the inlet 134 passes through the interior of the first cylindrical portion 136 and through the remainder of the nozzle body 16 to the deflector 22. Rotation of the outer wall 140 causes rotation of the entire nozzle collar 128.

Figure 15:
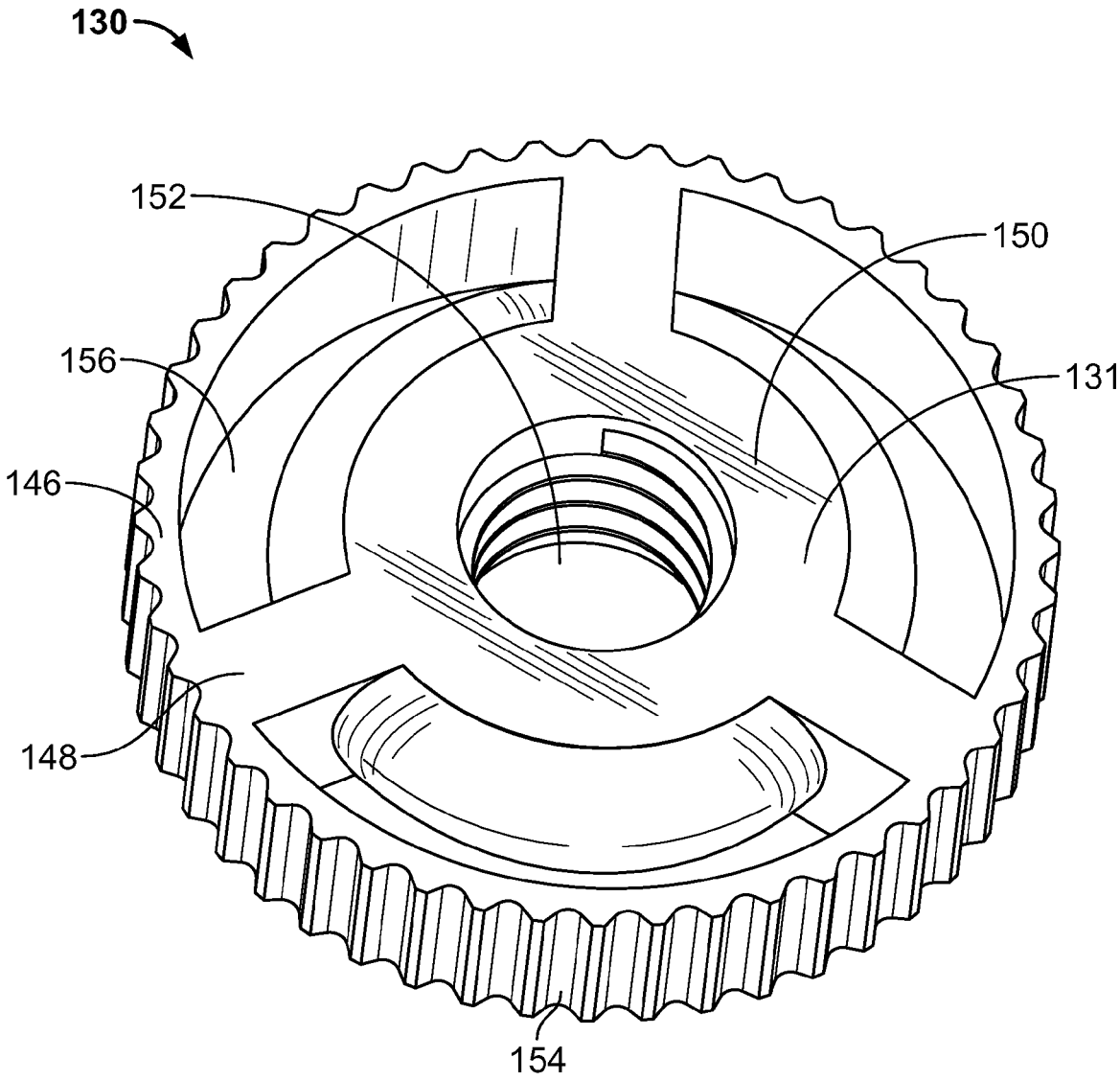
FIG. 15 is a top perspective view of the throttle control member of the rotating stream sprinkler of FIG. 1.
Figure 16:
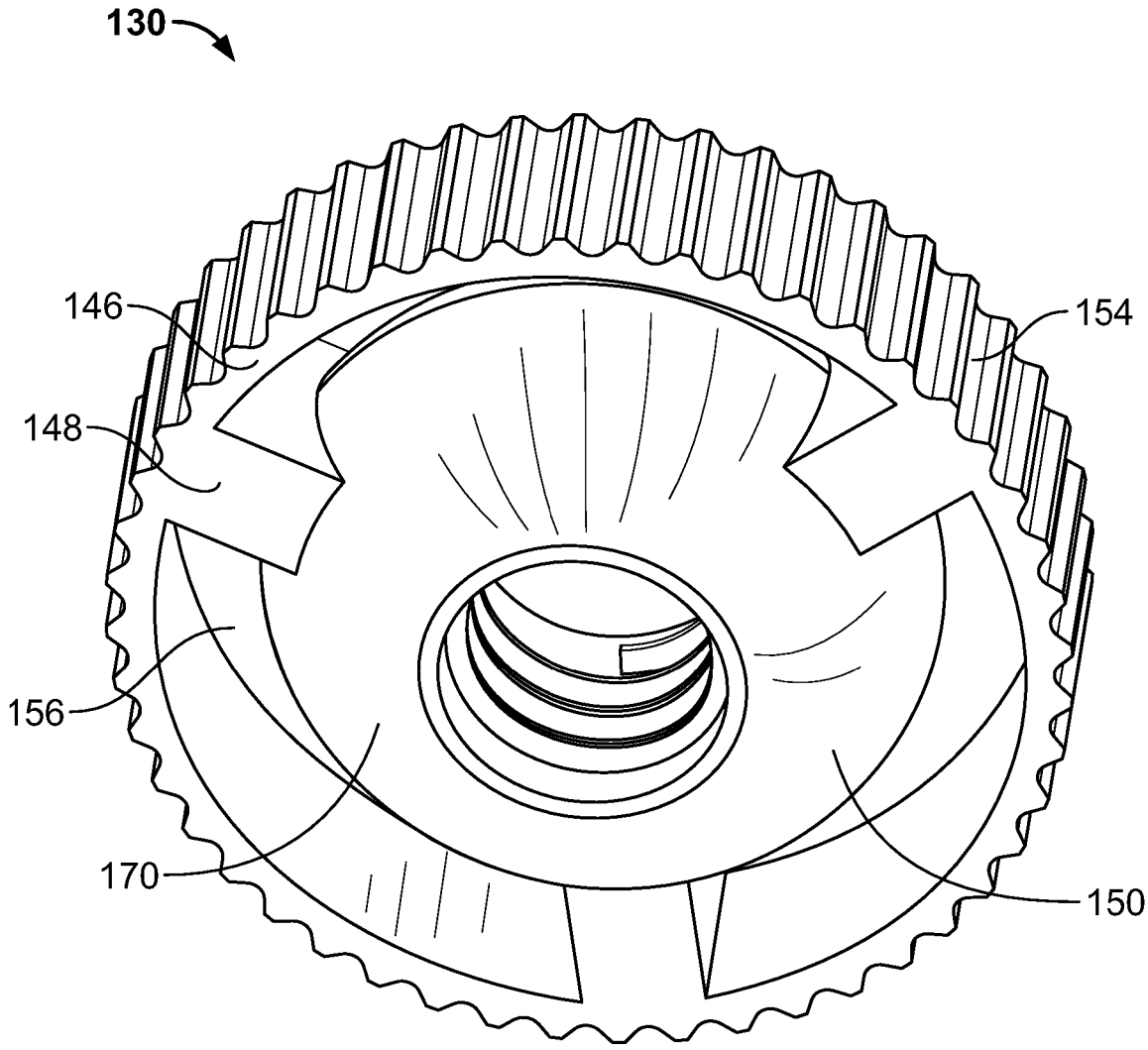
FIG. 16 is a bottom perspective view of the throttle control member of the rotating stream sprinkler of FIG. 1.
Figure 17:
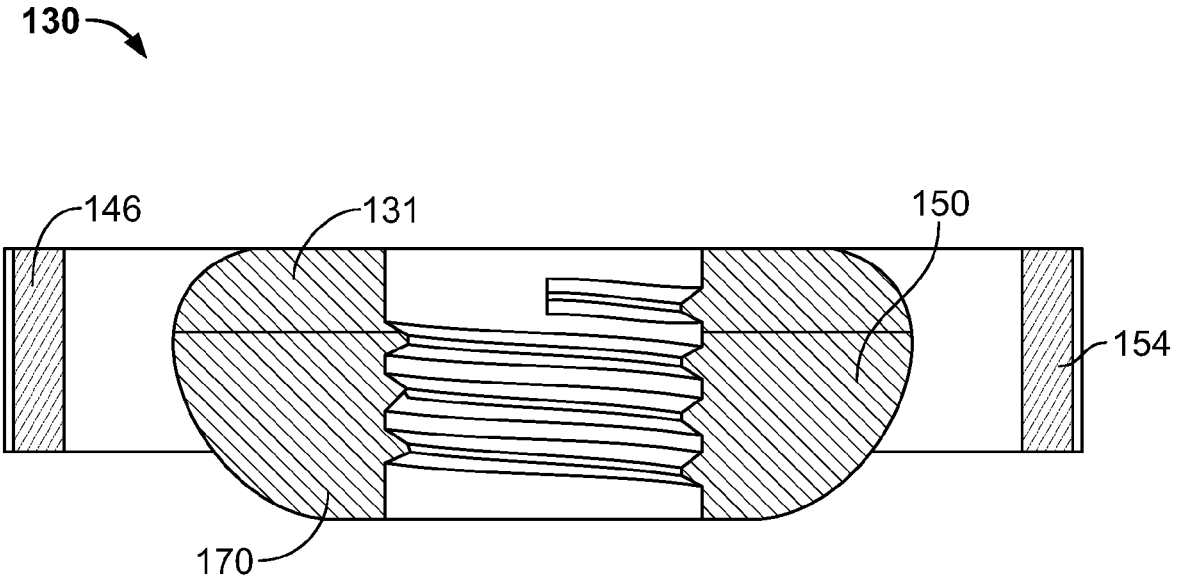
FIG. 17 is a cross-sectional view of the throttle control member of the rotating stream sprinkler of FIG. 1.

The nozzle collar 128 is coupled to a throttle control member 130. As shown in FIGS. 15-17, the throttle control member 130 is preferably an outer ring 146 joined by spoke-like ribs 148 to a central hub 150 defining a central bore 152. The ring 146 has an external surface 154, preferably a splined surface, for engagement to the corresponding internal splined surface 132 of the nozzle collar 128. The splined surfaces 132 and 154 interlock such that rotation of the nozzle collar 128 causes rotation of the throttle control member 130 about central axis C-C. The ribs 148 define flow passages 156 to allow fluid flow through the throttle control member 130. Although splined surfaces are shown in the preferred embodiment, it should be evident that other engagement surfaces, such as threaded surfaces, could be used to cause the simultaneous rotation of the nozzle collar 128 and throttle control member 130.

In turn, the throttle control member 130 is coupled to the hub member 50. More specifically, the throttle control member 130 is internally threaded for engagement with an externally threaded post 158 of the hub member 50. Rotation of the throttle control member 130 causes it to move along the threading in an axial direction. In one preferred form, rotation of the throttle control member 130 in a counterclockwise direction advances the member 130 towards the inlet 134 and away from the deflector 22. Conversely, rotation of the throttle control member 130 in a clockwise direction causes the member 130 to move away from the inlet 134 and towards the deflector 22. Although threaded surfaces are shown in the preferred embodiment, it is contemplated that other engagement surfaces could be used to effect axial movement, such as splined engagement surfaces.

Figure 12:
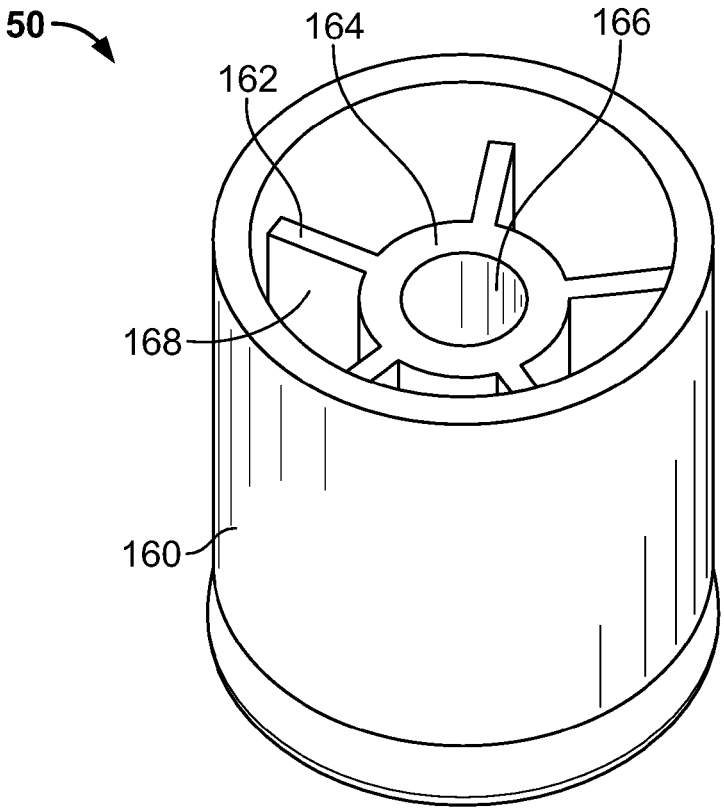
FIG. 12 is a top perspective view of the hub member of the rotating stream sprinkler of FIG. 1.
Figure 13:
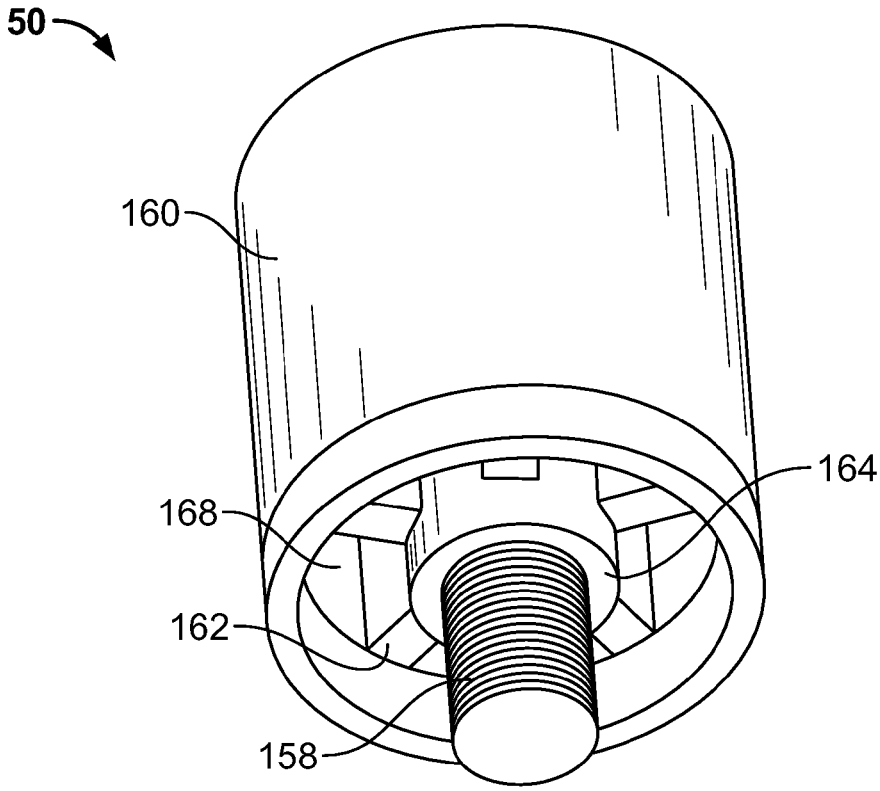
FIG. 13 is a bottom perspective view of the hub member of the rotating stream sprinkler of FIG. 1.
Figure 14:
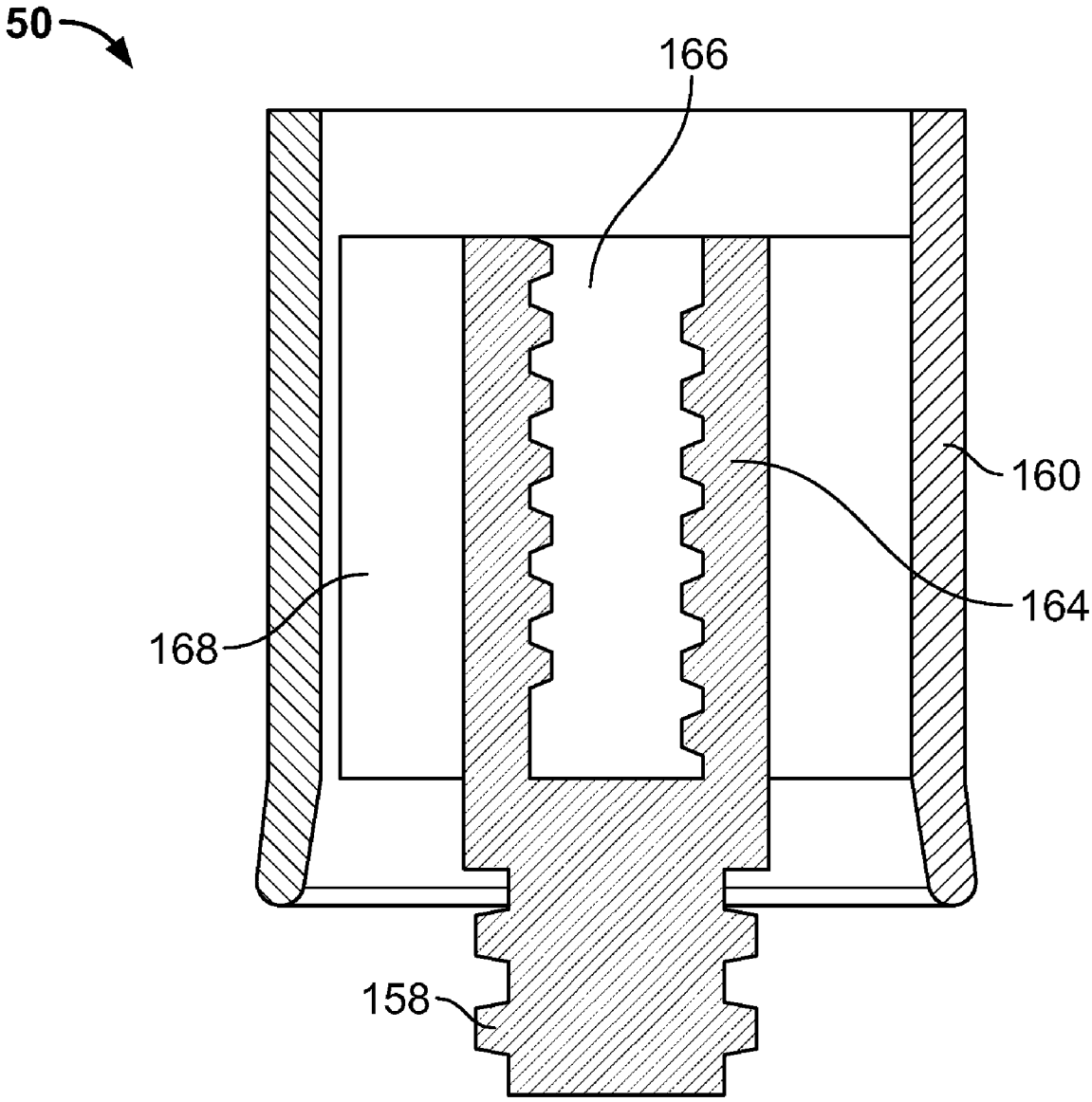
FIG. 14 is a cross-sectional view of the hub member of the rotating stream sprinkler of FIG. 1.

As shown in FIGS. 12-14, the hub member 50 preferably includes an outer cylindrical wall 160 joined by spoke-like ribs 162 to a central hub 164. The central hub 164 preferably defines a bore 166 at an upper end to accommodate insertion of the arc adjustment member 34 therein. The central hub 164 also preferably includes internal threading for engagement with external threading of the arc adjustment member 34. The pitch of the threading is preferably equivalent to the pitch of the helical engagement surfaces that define the angular slot 20. The lower end of the central hub 164 preferably defines a threaded post 158 for insertion in the bore 152 of the throttle control member 130, as discussed above. The ribs 162 define flow passages 168 to allow fluid flow through the hub member 50 to the remainder of the sprinkler 10.

In operation, a user may rotate the outer wall 140 of the nozzle collar 128 in a clockwise or counterclockwise direction. As shown in FIG. 10, the nozzle cover 62 preferably includes two cut-out portions 63 to define one or more access windows to allow rotation of the nozzle collar outer wall 140. Further, as shown in FIG. 2, the nozzle collar 128, throttle control member 130, and hub member 50 are oriented and spaced to allow the throttle control member 130 and hub member 50 to essentially block fluid flow through the inlet 134 or to allow a desired amount of fluid flow through the inlet 134. As can be seen in FIGS. 15-17, the throttle control member 130 preferably has a flat top surface 131 for engagement with the hub member 50 when fully retracted and a rounded bottom surface 170 for engagement with the inlet 134 when fully extended.

Rotation in a counterclockwise direction results in axial movement of the throttle control member 130 toward the inlet 134. Continued rotation results in the throttle control member 130 advancing to a valve seat 172 formed at the inlet 134 with the central hub 150 and the post 158 blocking fluid flow. The dimensions of the splined surfaces 132 and 154 of the nozzle collar 128 and throttle control member 130 are preferably selected to provide over-rotation protection. More specifically, the outer ring 146 of the throttle control member 130 is sufficiently thin, or a split ring may be used, such that the ring 146 flexes inwardly upon over-rotation. Once the inlet 134 is blocked, further rotation of the nozzle collar 128 causes slippage of the splined surfaces 132 and 154, allowing the collar 128 to continue to rotate without corresponding rotation of the throttle control member 130.

Rotation in a clockwise direction causes the throttle control member 130 to move axially away from the inlet 134. Continued rotation allows an increasing amount of fluid flow through the inlet 134, and the nozzle collar 128 may be rotated to the desired amount of fluid flow. When the valve is open, fluid flows through the sprinkler along the following flow path: through the inlet 134, through the flow passages 156 of the throttle control member 130, through the flow passages 168 of the hub member 50, through the arcuate slot 20 (if set to an angle greater than 0 degrees), upwardly along the cylindrical wall 98 of the nozzle cover 62, to the underside surface of the deflector 22, and radially outwardly from the deflector 22. As noted above, water flowing through the slot 20 may not be adequate to impart sufficient force for desired rotation of the deflector 22, when the slot 20 is set at relatively low angles.

The rotating stream sprinkler 10 illustrated in FIGS. 2-4 also includes a nozzle base 174 of generally cylindrical shape with internal threading 176 for quick and easy thread-on mounting onto a threaded upper end of a riser with complementary threading (not shown). The nozzle base 174 preferably includes an upper cylindrical portion 178, a lower cylindrical portion 180 having a larger diameter than the upper portion 178, and a top annular surface 182. As can be seen in FIGS. 2-4, the top annular surface 182 and upper cylindrical portion 178 provide support for corresponding features of the nozzle cover 62. The nozzle base 174 and nozzle cover 62 are attached to one another by welding, snap-fit, or other fastening method such that the nozzle cover 62 is stationary when the base 174 is threadedly mounted to a riser. The sprinkler 10 also preferably includes a seal member 184, such as an o-ring, at the top of the internal threading 176 of the nozzle base 174 and about the outer cylindrical wall 140 of the nozzle collar 128 to reduce leaking when the sprinkler 10 is threadedly mounted on the riser.

Figure 21:
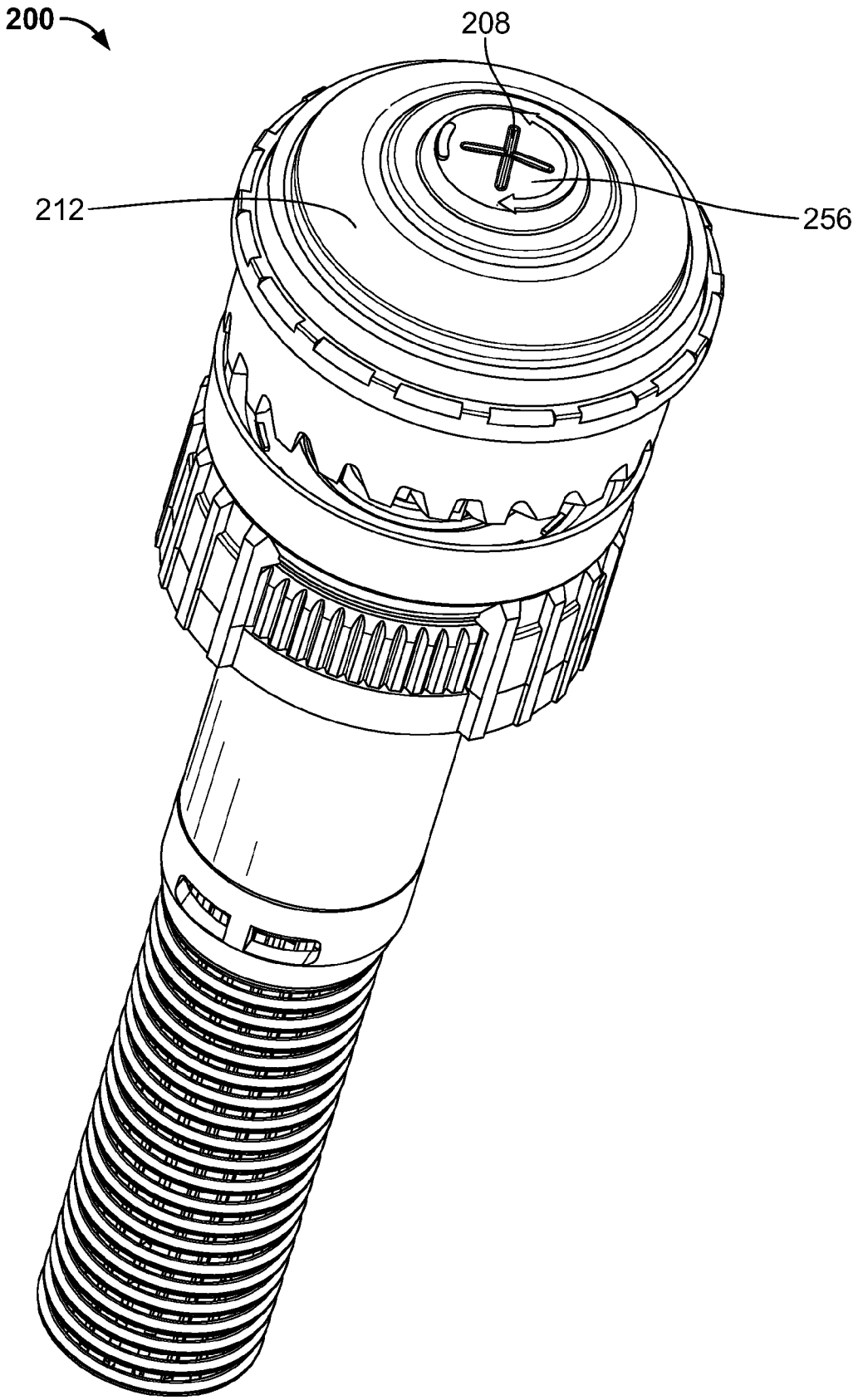
FIG. 21 is a perspective view of a second embodiment of a rotating stream sprinkler embodying features of the present invention.
Figure 22:
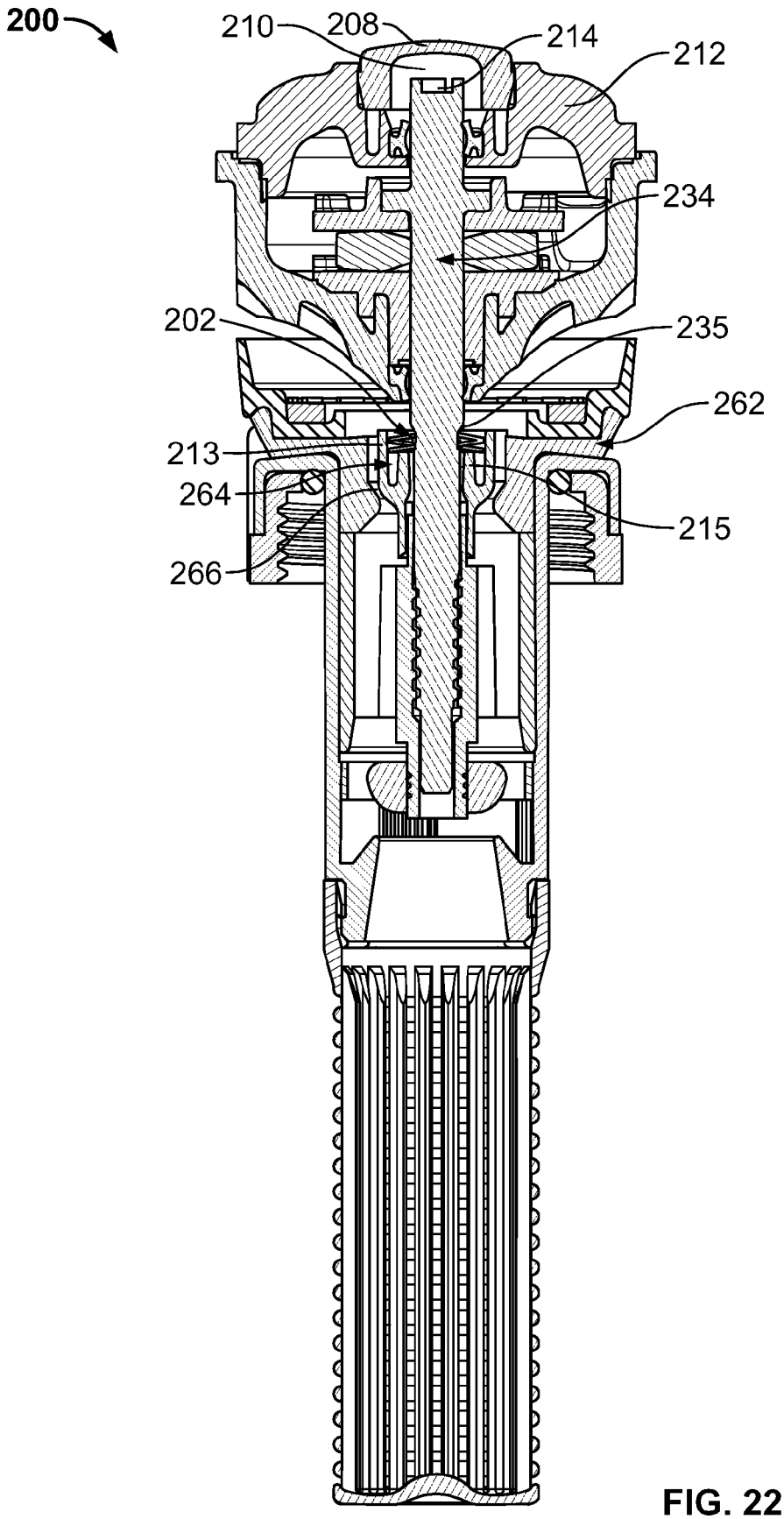
FIG. 22 is a cross-sectional view of the rotating stream sprinkler of FIG. 21.
Figure 23:
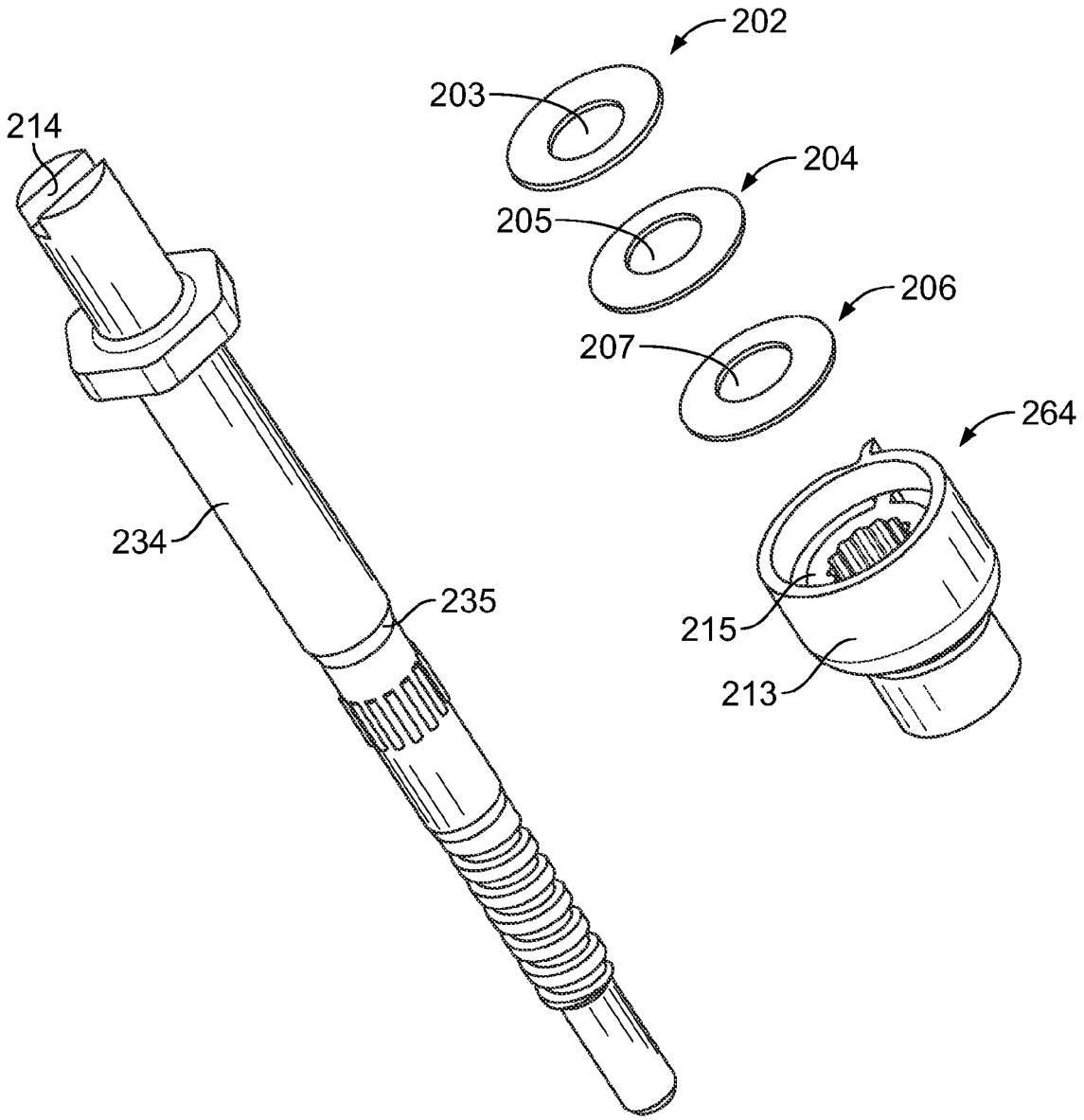
FIG. 23 is a perspective view of the arc adjustment member, springs, and valve sleeve of the rotating stream sprinkler of FIG. 21.

A second preferred embodiment 200 is shown in FIGS. 21-23. The second preferred embodiment of the rotating stream sprinkler 200 is similar to the one described above but includes two different features. First, the sprinkler 200 is operable through the use of a hand tool, rather than the hexagonal interface of the first embodiment. Second, the sprinkler 200 includes springs 202, 204, and 206 that provide a pre-load force to urge the valve sleeve 264 against the nozzle cover 262 to ensure a tight seal. It should be understood that the structure of the second embodiment of the sprinkler 200 is generally the same as that described above for the first embodiment, except to the extent described as follows.

First, as can be seen in FIG. 21, the cap 212 includes slots 208 in its top surface 256. The slots 208 allow access of the hand tool, preferably a screwdriver, into a chamber 210 beneath the cap 212 for engagement with a slotted top surface 214 of the arc adjustment member 234. A user may use the hand tool to rotate the arc adjustment member 234 to the desired arcuate span. The sprinkler 200 may include an additional seal about the top end of the arc adjustment member to limit the entry of grit and other debris past the top end. Rotation of the arc adjustment member 234 causes rotation of the valve sleeve 264 and controls the desired arcuate span in the same manner as described above for the first embodiment. An example of such a cap used in conjunction with a rotatable member having a slotted top surface is shown and described in U.S. Pat. No. 6,814,304. Other conventional methods may also be used to rotate the arc adjustment member 234.

Second, as can be seen in FIGS. 22 and 23, the sprinkler 200 includes one or more biasing elements, i.e., springs 202, 204, and 206, to bias the valve sleeve 264 against the nozzle cover 262 to maintain a tight seal for the closed portion of the arcuate slot 266. In the second preferred embodiment, three Belleville spring washers have been stacked vertically atop one another for use as springs 202, 204, 206. The springs 202, 204, and 206 shown in FIG. 23 each define a truncated conical portion with the top and bottom springs 202 and 206 oriented in an upright position and with the intermediate spring 204 oriented in an inverted position. Further, the springs 202, 204, and 206 shown in FIG. 23 define orifices 203, 205, and 207 having centers located along the central axis and that accommodate the insertion of the arc adjustment member 234 therethrough.

The top spring 202 engages a shoulder 235 of the arc adjustment member 234 while the bottom spring 206 engages the valve sleeve 264. More specifically, as can be seen in FIG. 23, the valve sleeve 264 has been modified so that it includes an outer cylindrical wall 213 and an inner annular portion 215 with the outer wall 213 having a greater height than the inner portion 215. This modified structure allows for the insertion of the Belleville washers in the space defined within the outer wall 213 such that the bottom spring 206 engages the inner portion 215. The springs 202, 204, and 206 bias the valve sleeve 264 downwardly against the nozzle cover 262. The amount of downward force, or pre-load force, may be easily tailored through the selection of springs 202, 204, and 206 having an appropriate spring constant. If the pre-load force is too small, the seal between the valve sleeve 264 and the nozzle cover 262 will not be tight enough, allowing leakage. If the pre-load force is too great, the user may experience difficulty rotating the valve sleeve 264 because of the high frictional engagement between the valve sleeve 264 and nozzle cover 262.

Other numbers and types of springs, washers, and combinations thereof may be used. The springs 202, 204, and 206 may be one integral component, i.e., form one integral body, or may be two or more discrete components operatively coupled together. Other forms of biasing, such as for example, a flexible rubber or plastic cylinder supported with a metal disk placed at the shoulder of the shaft, may also be used. For purposes of this description, the term "spring" is used to refer to all such conventional forms of biasing.

Figure 24:
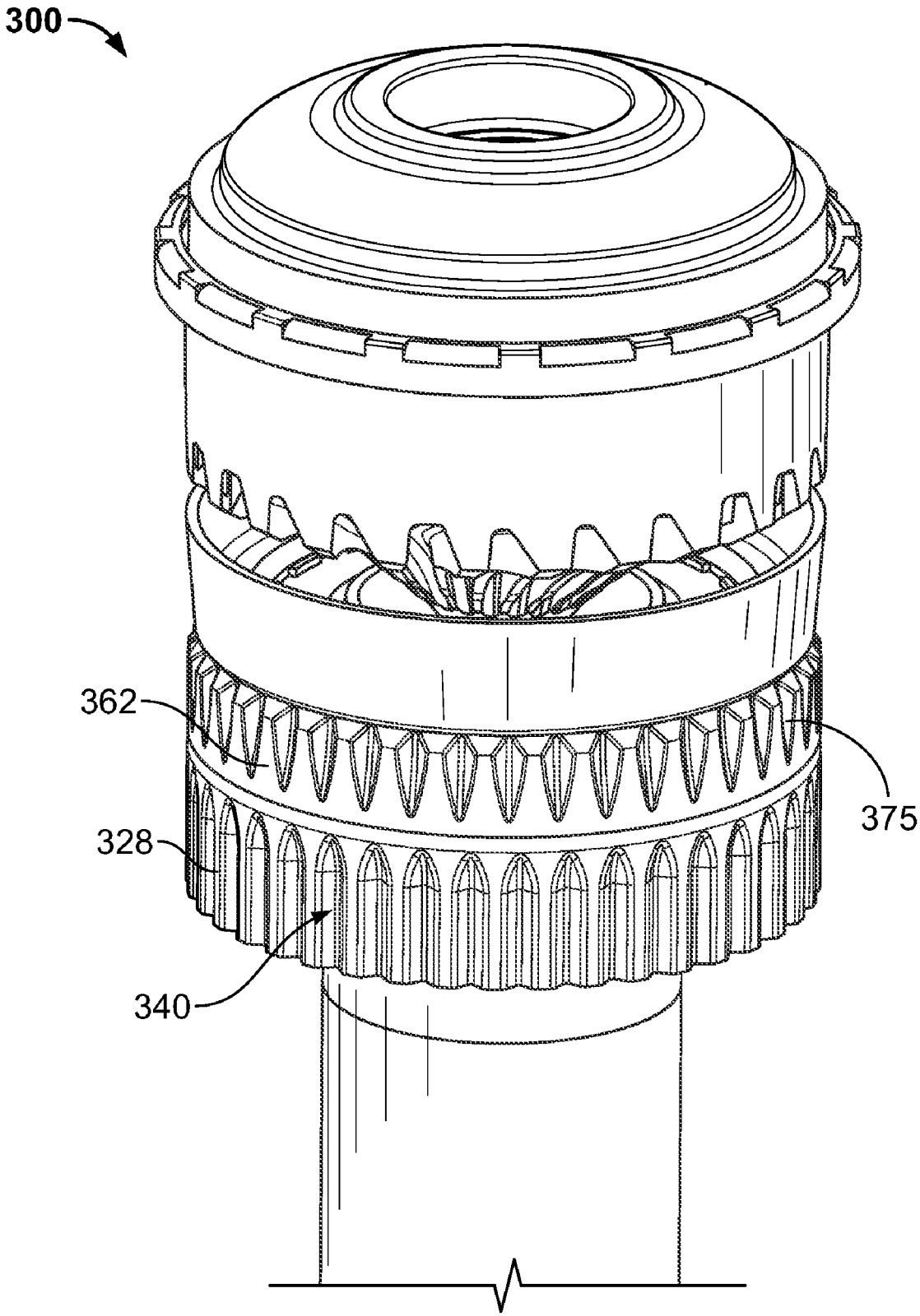
FIG. 24 is a perspective view of a third embodiment of a rotating stream sprinkler embodying features of the present invention.
Figure 25:
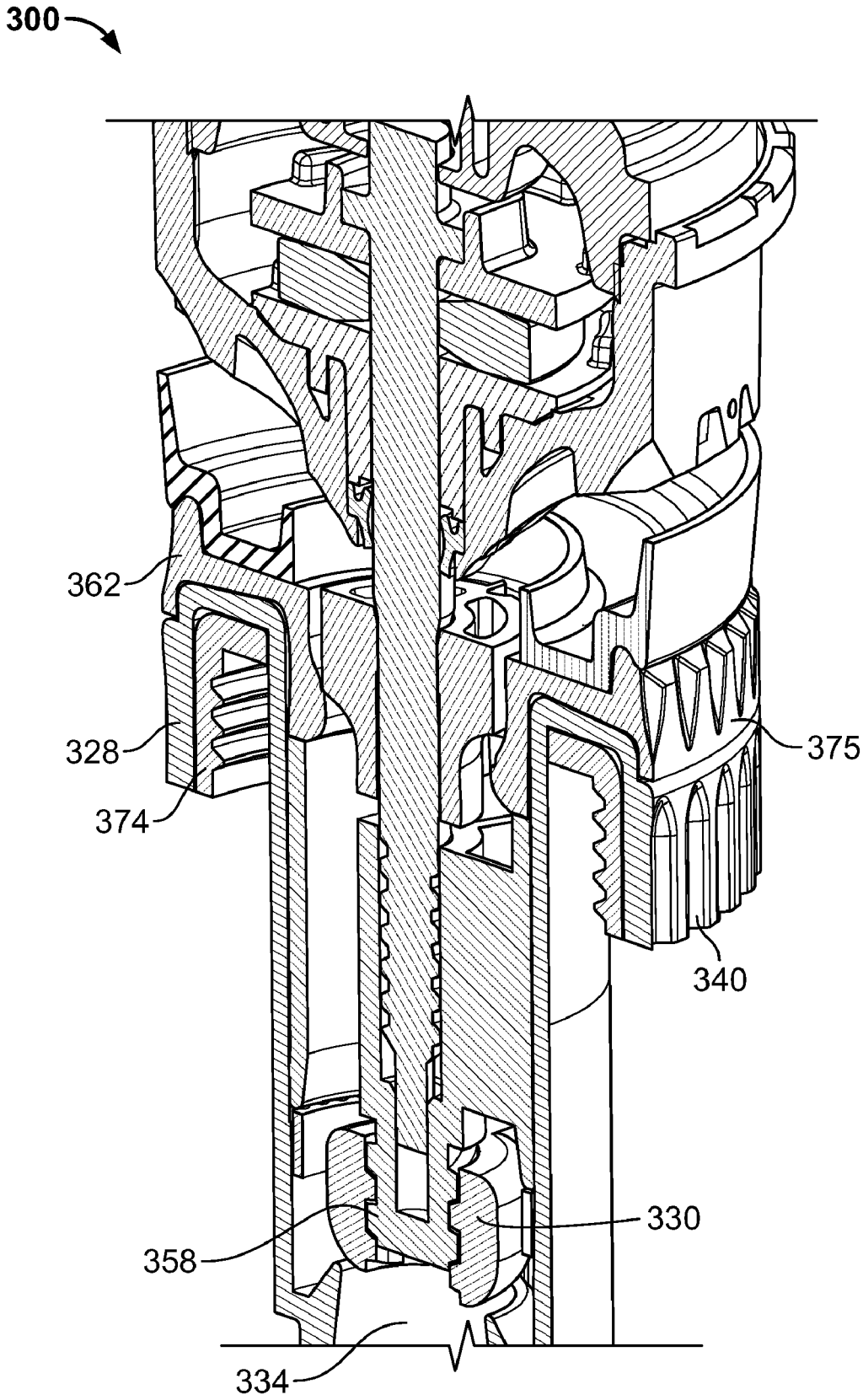
FIG. 25 is a partial cross-sectional view of the rotating stream sprinkler of FIG. 24.
Figure 26:
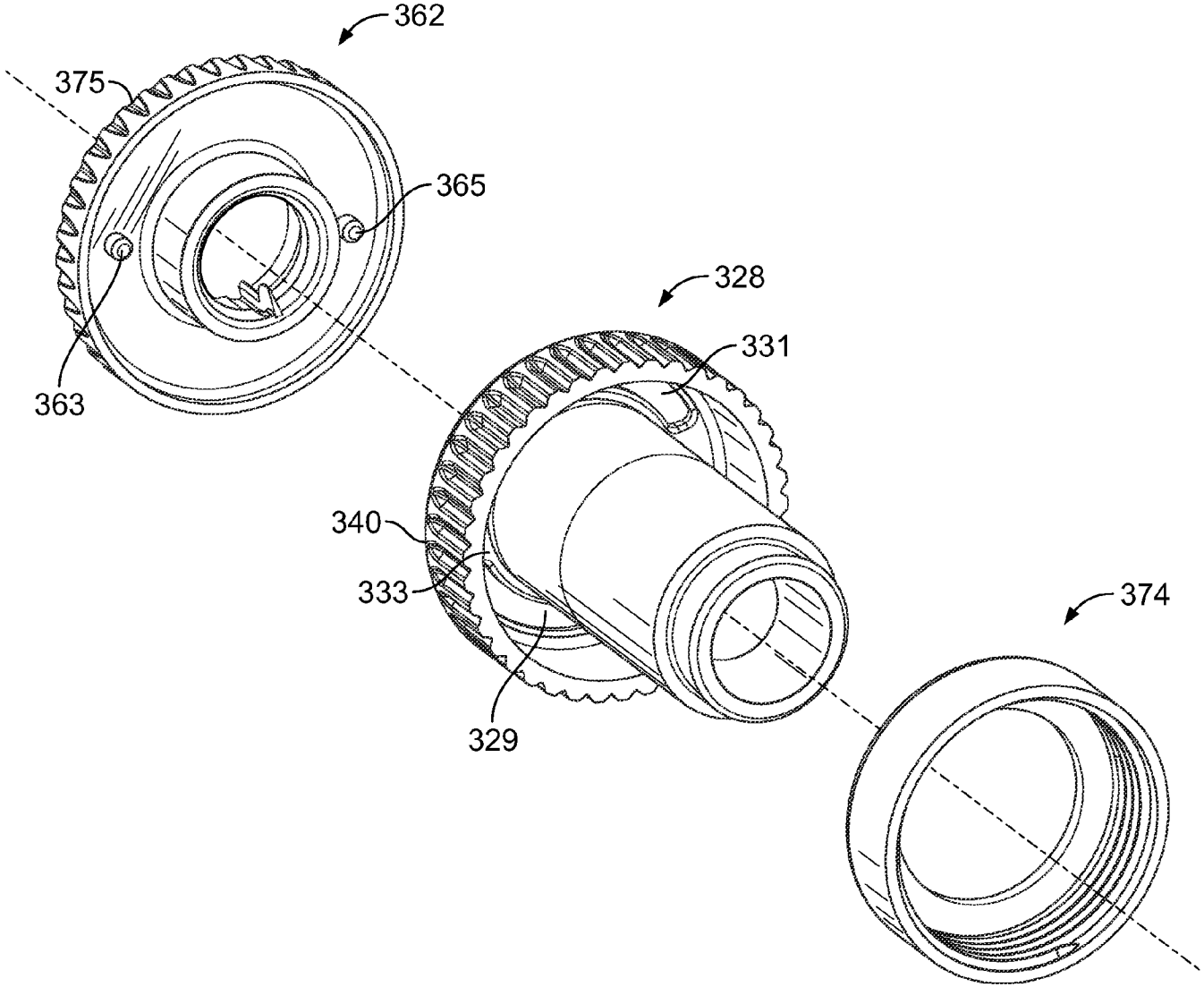
FIG. 26 is a perspective view of the nozzle cover, collar, and base of the rotating stream sprinkler of FIG. 24.

A third preferred embodiment 300 is shown in FIGS. 24-26. The third preferred embodiment of the rotating stream sprinkler 300 is similar to the first embodiment described above but includes a full grip collar, as described below. It should be understood that the structure of the third embodiment of the sprinkler 300 is generally otherwise the same as that described above for the first embodiment, except to the extent described below.

In the first embodiment, as seen in FIG. 10, the nozzle cover 62 included two cut-out portions 166 to define two access windows. The access windows exposed the outer wall 140 of the nozzle collar 128 to allow a user to rotate the nozzle collar 128. Rotation of the nozzle collar 128 caused axial movement of the throttle control member 130 to regulate fluid flow through the sprinkler.

In the third embodiment, as seen in FIGS. 24-26, the structures of the nozzle cover 362 and nozzle collar 328 have been modified. Each has an outer wall: the nozzle cover 362 has an upper outer wall 375 and the nozzle collar 328 has a lower outer wall 340. The lower outer wall 340 can be rotated by the user to effect rotation of the nozzle collar 328. The nozzle collar 328 therefore has its own full, circumferential outer wall 340 having a grip surface, and cut-out portions and access windows in the nozzle cover 362 are no longer necessary.

As shown in FIG. 26, the structure of the nozzle collar 328 is further modified so that it preferably includes two arcuate slots 329 and 331 in its top surface 333. The nozzle base 374 and nozzle cover 362 are held stationary with respect to one another by welding, screws, rivets, or other fastening methods through the two arcuate slots in the nozzle collar top surface 333. As can be seen from FIG. 26, the nozzle cover 362 is in rigid engagement with the nozzle base 374 through the use of two pins 363 and 365 that extend through the slots 329 and 331.

By using these two slots 329 and 331, the full range of axial movement of the throttle control member 330 is accomplished by less than 180, degree rotation of the nozzle collar outer wall 340. In other words, the full throw radius adjustment of the sprinkler 300 is accomplished by less than a ½ turn of the nozzle collar gripping surface. The thread pitch of the post 358 is increased to allow the throttle control member 330 to move axially the complete distance toward and away from the inlet 334 within a ½ turn. This modified structure and full grip feature limits debris that might otherwise become lodged in access windows and provides a convenient circumferential gripping surface for the user.

Figure 27:
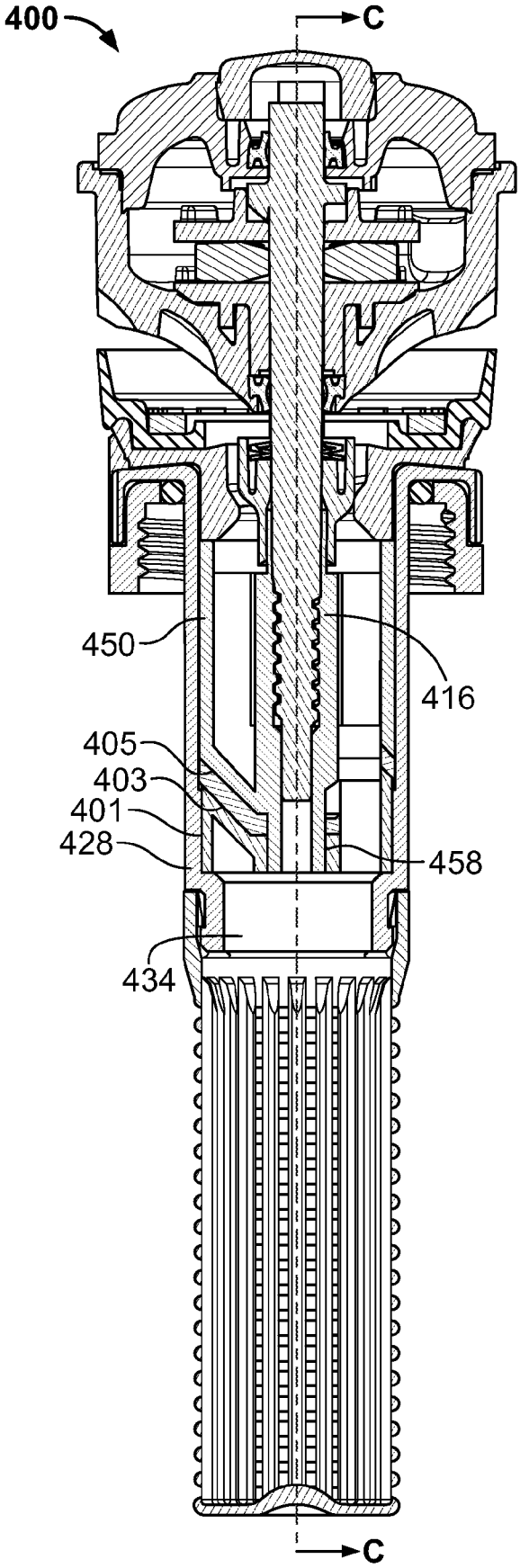
FIG. 27 is a cross-sectional view of a fourth embodiment of a rotating stream sprinkler embodying features of the present invention.

A fourth preferred embodiment 400 is shown in FIG. 27. The fourth preferred embodiment of the rotating stream sprinkler 400 is similar to the second embodiment described above and includes a slotted arc adjustment member for engagement with a hand tool and springs that provide a pre-load force to bias the valve sleeve against the nozzle cover. The fourth preferred embodiment also includes an alternative flow rate adjustment mechanism, as described in detail below. It should be understood that the structure of the fourth embodiment of the sprinkler 400 is generally otherwise the same as that described above for the first and second embodiments, except to the extent described below.

With regard to the alternative flow rate adjustment mechanism, a restrictor/shutter mechanism is used to control fluid flow through the inlet 434. The mechanism preferably includes one or more restrictor elements 401, 403, and 405 that can be opened to increase fluid flow through the inlet 434 and that can be closed to decrease fluid flow through the inlet 434. This mechanism replaces the throttle control member 130 shown and described with respect to the first embodiment.

The flow rate adjustment mechanism preferably includes three restrictor elements 401, 403, and 405 for adjustably selecting and regulating the inflow of water through the nozzle body 416. Two of the restrictor elements 401 and 403 each have a central hub defining a bore 407 and 409 to allow insertion of the post 458 therethrough. These two restrictor elements 401 and 403 are axially retained about the post 458 and are rotatable around the central axis C-C relative to one another for selectively varying the collective flow rate through the sprinkler 400. The third restrictor element 405 is formed as part of the hub member 450. The restrictor elements 401, 403, and 405 are stacked on top of one another and are shiftable with respect to one another so that shutters 411, 413, and 415 can be adjusted to increase or decrease the size of a collective flow opening through the device.

Figure 28:
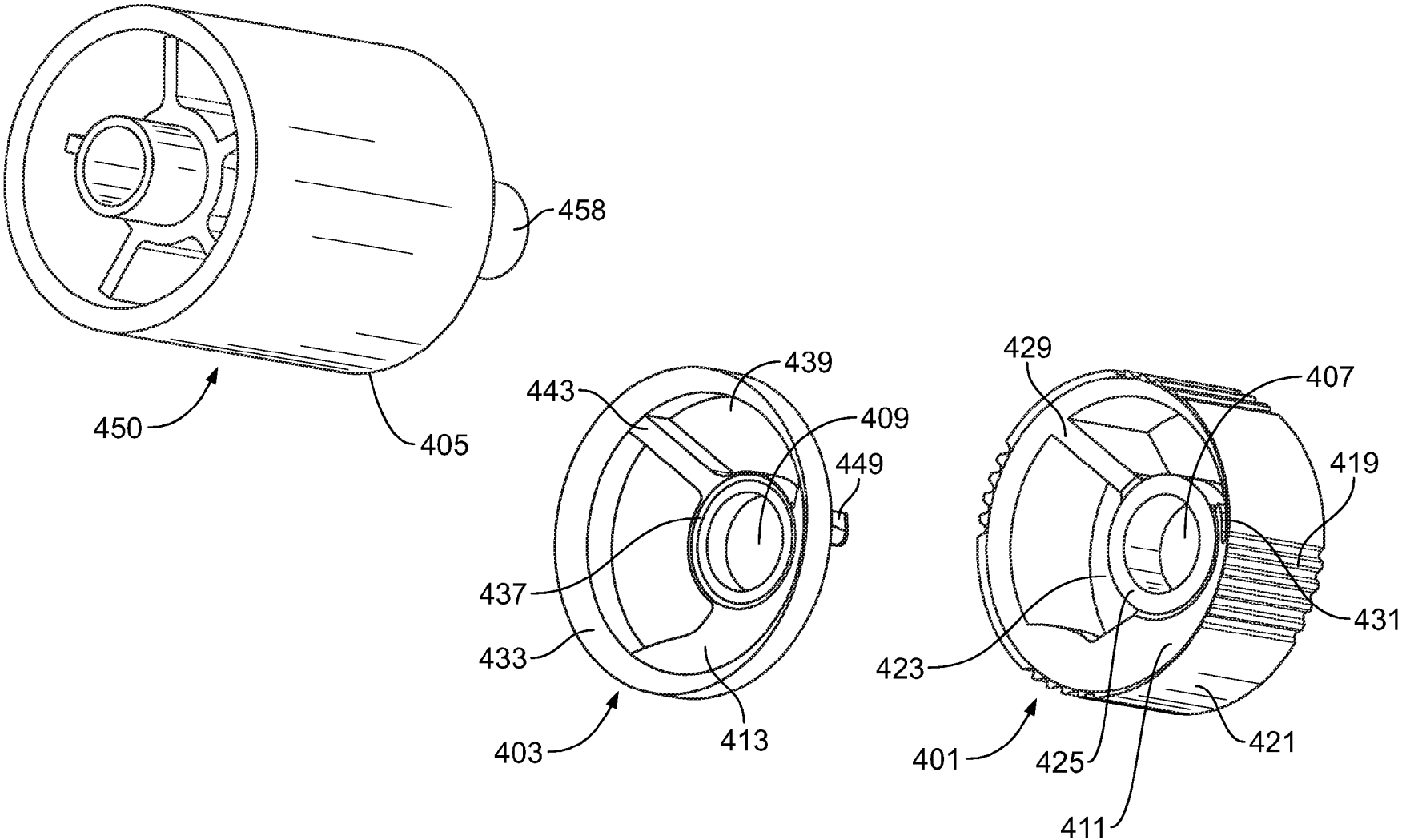
FIG. 28 is a top perspective view of the hub member with first restrictor element, second restrictor element, and third restrictor element of the rotating stream sprinkler of FIG. 27.
Figure 29:
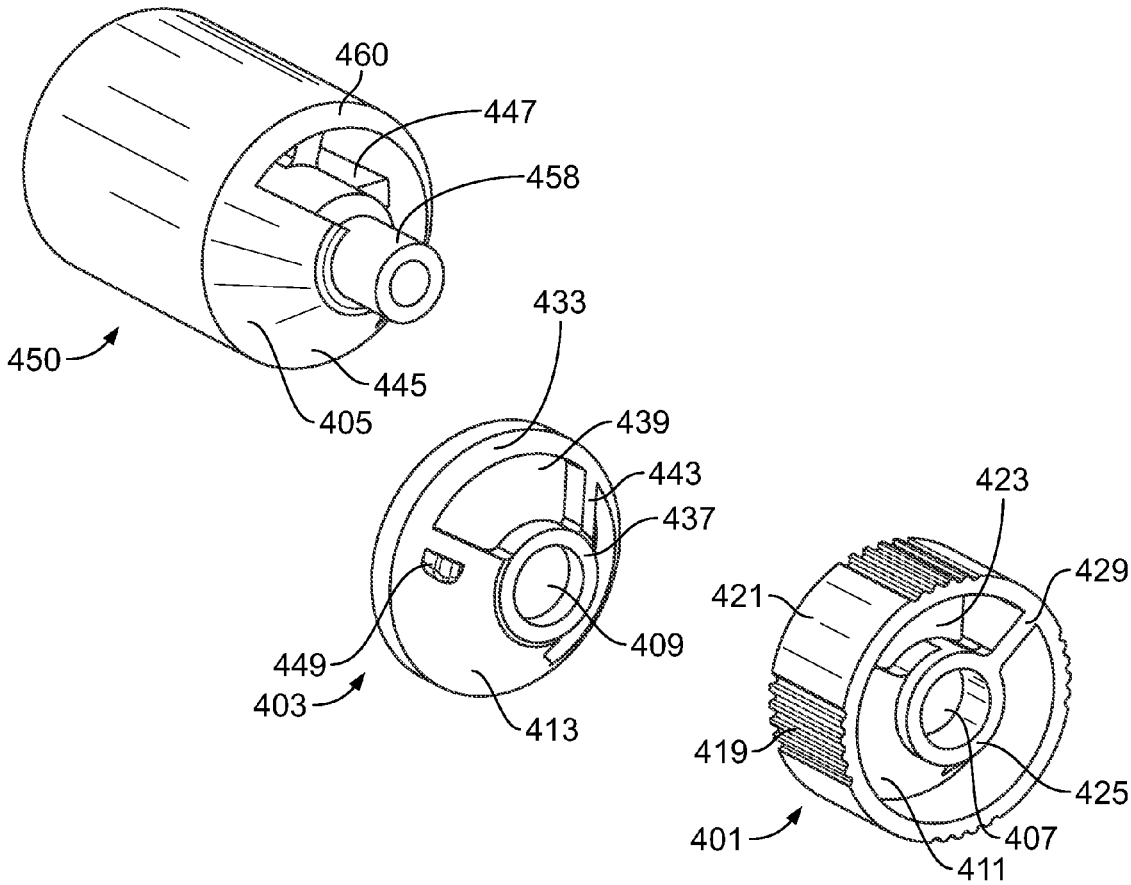
FIG. 29 is a bottom perspective view of the hub member with first restrictor element, second restrictor element, and third restrictor element of the rotating stream sprinkler of FIG. 27.

As can be seen from FIGS. 27-29, the first restrictor element 401 is positioned near the inlet 434 and has one or more splined portions 419 spaced about an outer cylindrical wall 421. More specifically, it preferably includes four splined portions 419 spaced equidistantly about the outer wall 421. The splined portions 419 engage a corresponding splined surface on the interior of the nozzle collar 428, such that the first restrictor element 401 is rotatable with the nozzle collar 428. The first restrictor element 401 defines an arcuate flow aperture 423 that may be shifted with respect to the flow apertures defined by the other two restrictor elements 403 and 405, as described below. The arcuate flow aperture 423 through the first restrictor element 401 extends about the central hub 425. In the preferred form, the arcuate flow aperture 423 extends for approximately 240 degrees, or two-thirds, about the central hub 425, while the remaining 120 degrees, or one-third, is obstructed by a shutter 411. The flow aperture 423 is defined by the central hub 425, the outer wall 421, and the shutter 411. Further, the flow aperture 423 is preferably divided into roughly two halves by a rib 429. The first restrictor element 401 also includes a stop 431 for engagement with the second restrictor element 403.

As shown in FIGS. 28 and 29, the second restrictor element 403 is roughly the shape of a truncated cone, is positioned in substantial mating relationship with the first restrictor element 401, and has a bore 409 through which the post 458 extends. The second restrictor element 403 is preferably stacked on the first element 401. The second restrictor element 403 includes an outer ring 433 and a shutter 413 that combine with the central hub 437 to define an arcuate flow aperture 439. The flow aperture 439 extends about 240 degrees, or two-thirds, of the way around the central hub 437 with the remaining section obstructed by the shutter 413. The flow aperture 439 is preferably divided roughly into two halves by a rib 443. The upper surface of the second restrictor element 403 is defined by a truncated conical seat for engagement with a complementary seat portion of the third restrictor element 405.

As shown in FIGS. 28 and 29, the third restrictor element 405 is formed as part of the hub member 450. Thus, unlike the other two restrictor elements, it is stationary. The hub member 450 is preferably stacked atop the second restrictor element 403 and is positioned in substantial mating relationship with the second element 403. The third restrictor element 405 defines a shutter 415 that extends circumferentially approximately 120 degrees about the post 458. As seen in FIG. 29, the flow aperture 447 through the third restrictor element 405 is defined by the post 458, the outer wall 460, and the shutter 415. The flow aperture 447 extends approximately 240 degrees, or two thirds, of the way about the post 458.

As can be seen from FIGS. 27-29, the three restrictor elements 401, 403, and 405 cooperate and are shiftable to form a collective and variable flow opening that is adjustable between maximum closed and open positions. The collective flow opening is adjustable between a maximum open position of about 240 degrees (about two-thirds) and a maximum closed position of approximately 0 degrees (nearly completely obstructed). The orientation of the three restrictor elements 401, 403, and 405 with respect to each other, i.e., the closed or open positions of the flow rate adjustment device, is controlled by rotation of the nozzle collar 428.

More specifically, rotation of the nozzle collar 428 results in rotation of the first restrictor element 401 about the central axis C-C. During rotation, the rib 429 of the first restrictor element 401 cooperates with a downwardly projecting tab 449 of the second restrictor element 403. The tab 449 is engaged when the first restrictor element 401 is rotated in one direction, i.e., clockwise. As should be evident, the restrictor elements 401, 403, and 405 may be designed to cooperate with one another in a number of ways other than through the specific use of tabs and stops, such as through the use of cooperating grooves, slots, catches, etc.

Initially, the three shutters 411, 413, and 415 overlap vertically such that approximately 240 degrees of the collective flow opening is open. When the nozzle collar 428 is rotated clockwise, however, the first restrictor element 401 rotates and the shutters 411, 413, and 415 increasingly block more and more of the collective flow opening. Rotation of about 120 degrees causes the rib 429 of the first restrictor element 401 to engage the tab 449 of the second restrictor element 403, causing the second restrictor element 403 to rotate. Continued rotation of about another 120 degrees will result in the collective flow opening being completely blocked, or almost completely blocked, by the non-overlapping shutters 411, 413, and 415.

The nozzle collar 428 may then be rotated in a counter-clockwise direction, causing the first restrictor element 401 to rotate in the opposite direction. As the rotation continues, the shutters 411, 413, and 415 will overlap one another more and more. After about 120 degrees of rotation, the stop 431 of the first restrictor element 401 engages the tab 449 of the second restrictor element 405, causing it to rotate. After another 120 degrees of rotation, the shutters 411, 413, and 415 are again spaced vertically atop one another, i.e., stacked, such that approximately 240 degrees of the collective flow opening is again open.

As should be evident, a number of alternative arrangements are possible. For example, the second restrictor element 403 may have splined portions, instead of the first restrictor element 401. In such an arrangement, the nozzle collar 428 may be rotated to drive the second restrictor element 403, which in turn causes rotation of the first restrictor element 401 through the use of appropriate tabs, stops, or ribs. Alternatively, as another example, tabs and stops may be disposed on the second and third restrictor elements 403 and 405 to prevent rotation of the restrictor elements 401 and 403 beyond the fully open and fully closed positions. Further, in such example, the dimensions of the engaging splined surfaces of the nozzle collar 428 and first restrictor element 401, respectively, could be selected such that over-rotation of the nozzle collar 428 causes "slippage" of the splined surfaces, in the manner described above for the other embodiments, thereby reducing the likelihood of damage to the components.

The variability of the throw radius may be increased by adding additional restrictor elements. For example, four cooperating restrictor elements may be used, each having an arcuate flow aperture defined by a central hub, a shutter, and an outer wall. The flow aperture extends approximately 270 degrees, or three-fourths, of the way about the central hub. The restrictor elements preferably cooperate with one another through the use of appropriately positioned tabs and stops, in similar fashion to that described above. Rotation of the nozzle collar allows adjustment of the cooperating four restrictor elements between a maximum open position (about one-fourth of the opening of the device is obstructed) and a maximum closed position (nearly completely obstructed).

As is evident, five and more elements may be used, and the use of such additional elements will result in additional variability in the throw radius of the sprinkler. In general, for a given number of restrictor elements, n, each element has a shutter that extends approximately 1/n of the way about the hub to obstruct the aperture of the flow rate adjustment device. The flow aperture of the device may be adjusted between a fully open position, where the shutters overlay one another completely, and a closed position, where the shutters are staggered with respect to one another. The maximum flow opening of the device is given by the following mathematical expression: 360−360/n degrees. Restrictor elements may be added, as desired, depending on the costs and benefits resulting from the use of such additional elements.

Figure 30:
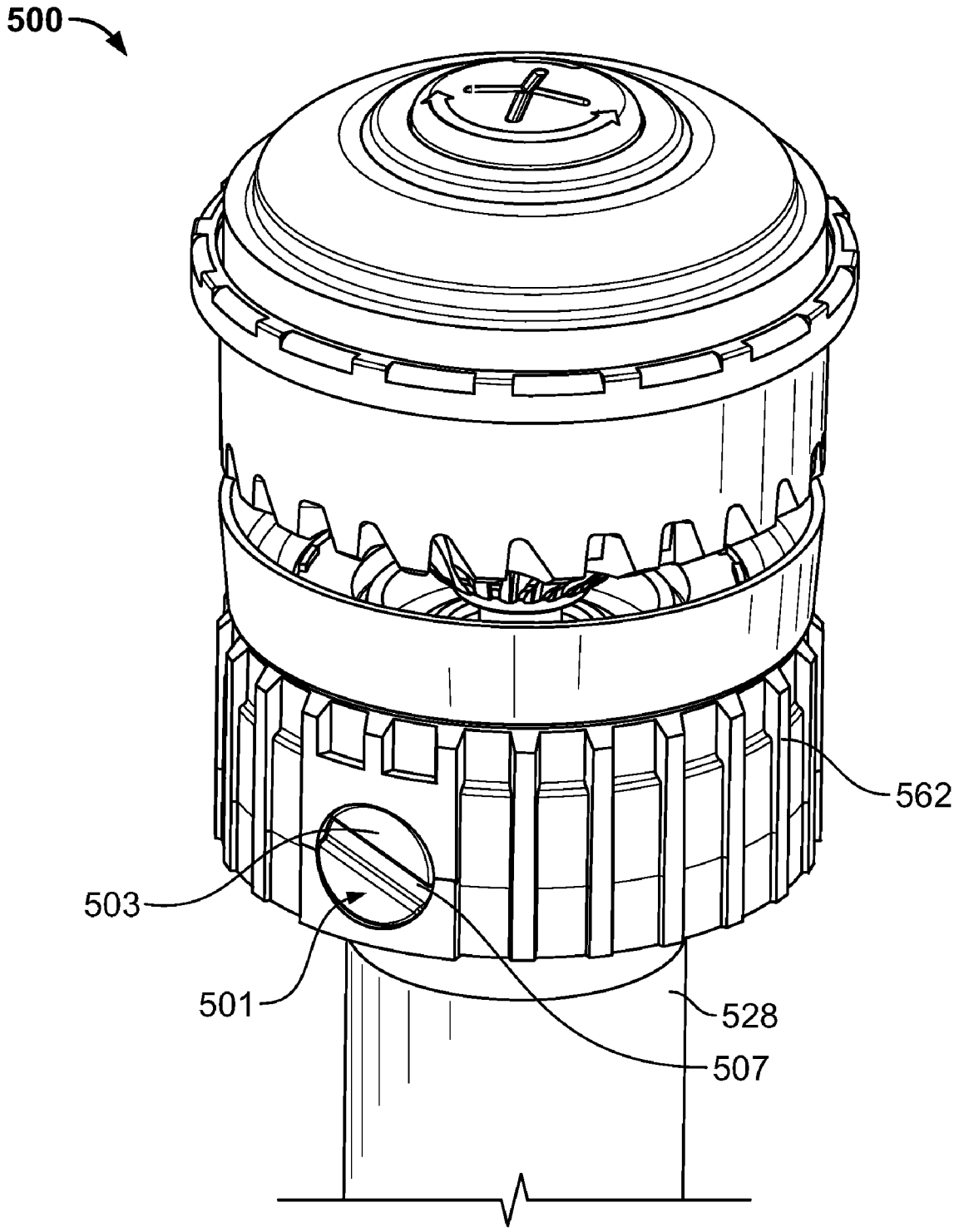
FIG. 30 is a partial perspective view of a fifth embodiment of a rotating stream sprinkler embodying features of the present invention.
Figure 31:
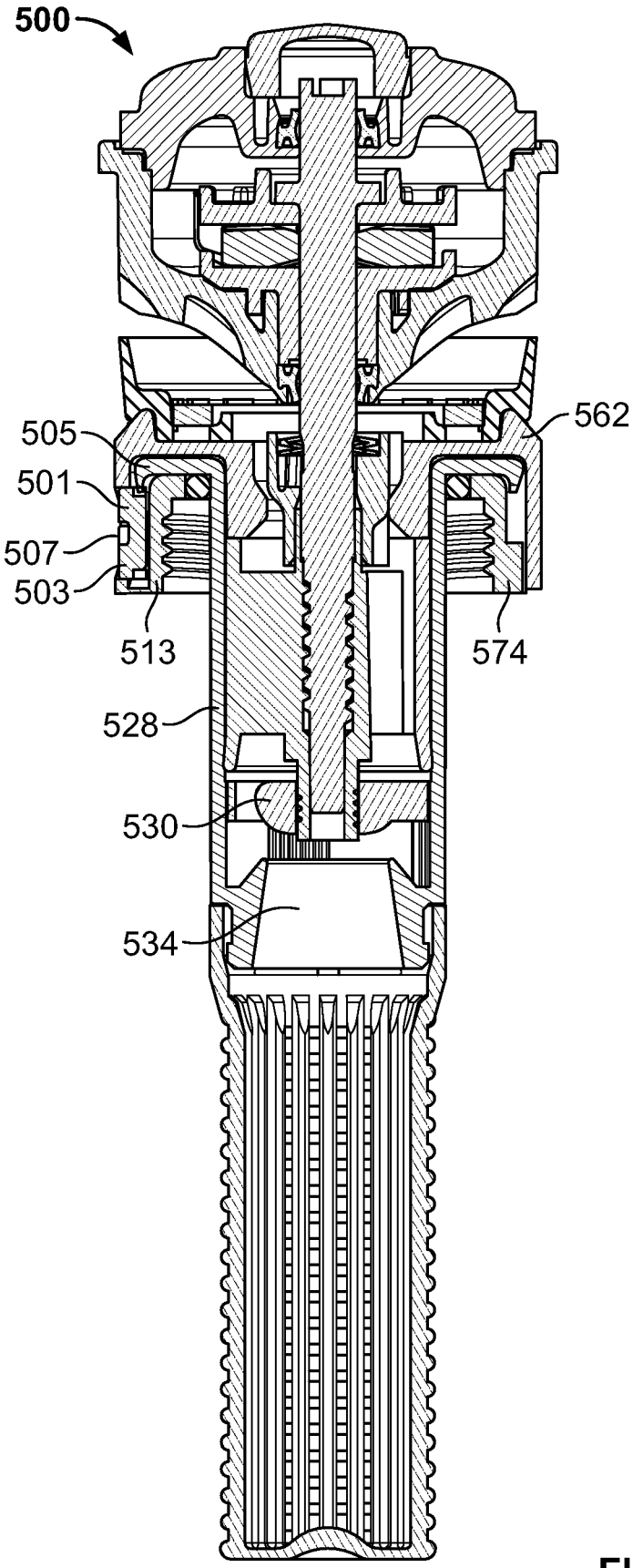
FIG. 31 is a cross-sectional view of the rotating stream sprinkler of FIG. 30.

A fifth preferred embodiment 500 is shown in FIGS. 30-31. The fifth preferred embodiment of the rotating stream sprinkler 500 is similar to the second embodiment described above and includes a slotted arc adjustment member for engagement with a hand tool and springs that provide a pre-load force to bias the valve sleeve against the nozzle cover. The fifth preferred embodiment also includes an alternative interface 501 for adjusting the throw radius, as described in detail below. It should be understood that the structure of the fifth embodiment of the sprinkler 500 is generally otherwise the same as that described above for the first and second embodiments, except to the extent described below.

Figure 32:
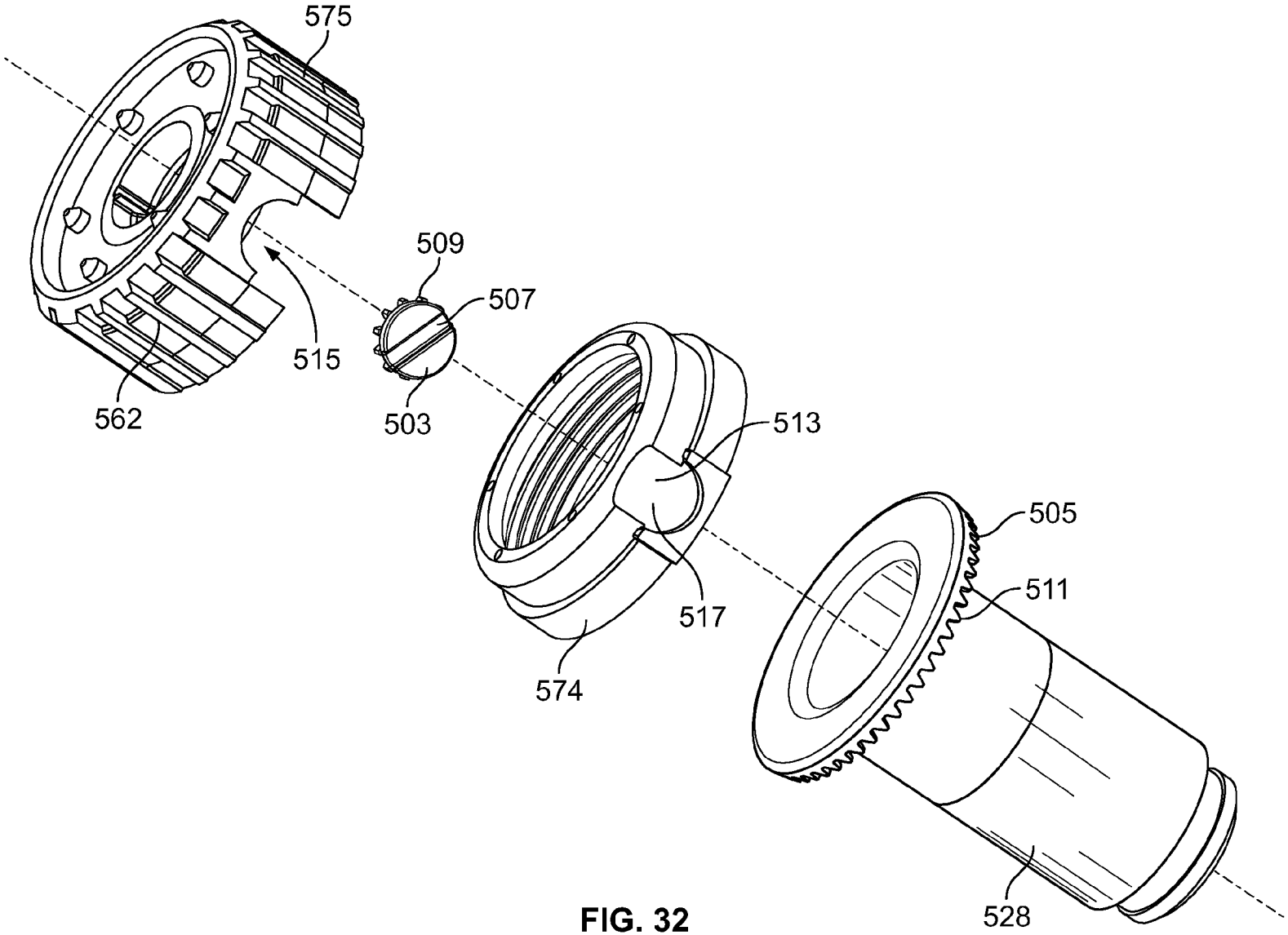
FIG. 32 is a perspective view of the gear, nozzle collar, nozzle cover, and nozzle base of the rotating stream sprinkler of FIG. 30.

As can be seen from FIGS. 31-32, the interface 501 essentially includes two engaging gear portions 503 and 505 that are driven by the user to rotate the nozzle collar 528. More specifically, the first gear portion 503, preferably a pinion gear, is held between the nozzle base 574 and the nozzle cover 562, whose structures have been modified to accommodate the pinion gear 503. Both have cut-out portions 515 and 517 that fit together to form a pocket 513 shaped to hold the pinion gear 513 therein. The teeth 509 of the pinion gear 503 are disposed inside the outer wall 575 of the nozzle cover 562 for engagement with teeth of the second gear portion 505.

The pinion gear 503 has a slot 507 to allow the use of a hand tool to rotate the pinion gear 503. The teeth 509 of the pinion gear 503 engage the teeth 511 of the second gear portion 505, preferably in the form of a crown gear, which forms part of the nozzle collar 528. In this manner, rotation of the pinion gear 503 effects rotation of the nozzle collar 528.

The user can rotate the pinion gear 503 a desired amount to set the desired radius of throw of the sprinkler 500. Rotation of the pinion gear 503 causes the throttle control member 530 to move axially toward or away from the inlet 534 to regulate fluid flow. In one form, rotation of the pinion gear 503 induces rotation of the nozzle collar 528 at an approximate 4:1, gear ratio. The location of the pinion gear 503 in an enclosed pocket 513 formed by the nozzle cover 562 and the nozzle base 574 limits the amount of grit and debris intrusion into the sprinkler 500. Additionally, this embodiment provides more gripping surface area than some of the other embodiments for convenient installation or removal of the sprinkler 500.

A sixth preferred embodiment 600 is shown in FIGS. 33-36. The sixth preferred embodiment of the rotating stream sprinkler 600 is similar to the second embodiment described above and includes a slotted arc adjustment member 634 for engagement with a hand tool and two cut-out portions 663 to define one or more access windows in the nozzle cover 662 to allow adjustment of the throw radius. The sixth preferred embodiment further includes inverted application of a pre-load force, as described in detail below. It should be understood that the structure of the sixth embodiment of the sprinkler 600 is generally otherwise the same as that described above for the first and second embodiments, except to the extent described below.

As shown in FIGS. 33-36, the sprinkler 600 includes an arc adjustment member 634 that is similar in shape to arc adjustment member 34. More specifically, arc adjustment member 634 is generally in the shape of a shaft having one end 646 that is slotted to engage a hand tool. The member 634 has a splined surface 668 intermediate along its length for engagement with a corresponding splined surface of the valve sleeve 664 to effect rotation of the valve sleeve 664. The member 634, however, preferably does not include a threaded lower end like the threaded lower end of member 34 of the first embodiment. The member 634 preferably includes an undercut groove 601 at its lower end 648 for engagement of a retaining ring 603. The retaining ring 603 locks onto the end 648 of the member 634 in the groove 601 to prevent axial displacement of the components carried by the member 634.

As with the other preferred embodiments, the variable arc capability of sprinkler 600 results from the interaction of the nozzle cover 662 and valve sleeve 664. More specifically, the nozzle cover 662 and the valve sleeve 664 have corresponding helical engagement surfaces that may be rotatably adjusted with respect to one another to form an arcuate slot 620. The arcuate slot 620 may be adjusted to any desired water distribution arc by the user through rotation of the arc adjustment member 634. The nozzle cover 662 and valve sleeve 664 also each have fins 692 and 614 to define the edges of the water stream exiting the arcuate slot 620.

As addressed further below, however, the nozzle cover 662 and valve sleeve 664 engage in a different manner than in the other preferred embodiments. In the other embodiments, the valve sleeve had a radially outwardly projecting portion that was spaced vertically above a radially inwardly projecting portion of the nozzle cover. In the sprinkler 600, however, the vertical positions of these structures are reversed. In other words, the valve sleeve 664 has an outwardly projecting portion 605 that is spaced vertically below a radially inwardly projecting portion 607 of the nozzle cover 662.

As can be seen in FIGS. 33-36, the nozzle cover 662 has a modified structure that is different than the cover of the other preferred embodiments. Like the other embodiments, the nozzle cover 662 is generally cylindrical in shape and includes a central hub 670 that defines a bore 672 for insertion of the valve sleeve 664. Unlike the other embodiments, however, the hub 670 has an upper portion 609 that extends radially inward and a relatively thin and lengthy lower portion 611 that does not extend radially inward. It can be seen from a comparison of FIG. 2 and FIG. 34 that the lower portion 611 of the hub 670 is longer than the corresponding lower portion of the other embodiments.

As shown in FIGS. 33-36, the valve sleeve 664 has a generally cylindrical shape and includes a central hub 613 defining a bore 602 therethrough for insertion of the arc adjustment member 634. The valve sleeve 664, however, has a modified structure relative to the other preferred sprinkler embodiments. The valve sleeve 664 preferably includes an outer cylindrical portion 615 and an inner cylindrical portion 617 defining the hub 613 and splined engagement surface. A fin 614 projects radially outwardly and extends axially along the outside of the valve sleeve 664 to define an edge of the water stream through the arcuate slot 620.

The valve sleeve 664 also includes a relatively thick upper annular portion 665, in comparison to previous embodiments such as valve sleeve 264 in FIG. 22. The relative thickness of this upper portion 665 provides an advantage in that its annular shape experiences less distortion from forces acting against it, such as spring forces, assembly loads, and forces arising from rotation of the fins 614 and 692, than would a thinner upper portion. The thick upper portion 665 therefore holds its shape and position well, which helps maintain a consistent shape for the arcuate slot 620. The relative thicknesses of the upper portions of the nozzle cover 662 and valve sleeve 664 are selected to define the annular geometry of the arcuate slot 620 and to provide a consistent spray pattern.

The arcuate slot 620 is defined by the upper portion 609 of the nozzle cover 662 and the outer cylindrical portion 615 of the valve sleeve 664. These respective portions include helical engagement surfaces to allow the slot 620 to be adjusted to the desired angle for water distribution. For example, in FIG. 34, the slot 620 is shown closed on the left hand side and open on the right hand side. These respective portions are also gently curved to provide relatively little loss of velocity for water flowing through the arcuate slot 620.

Figure 33:
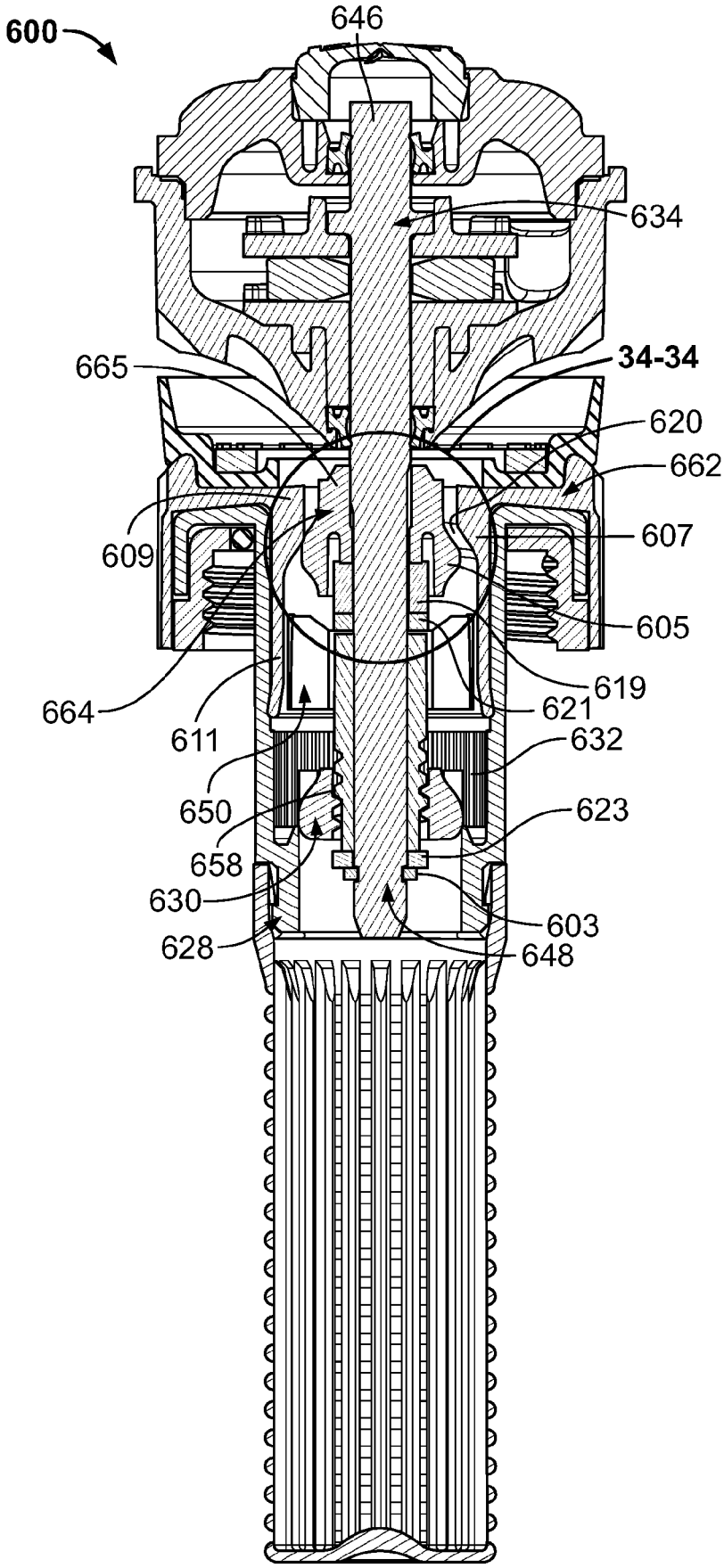
FIG. 33 is a cross-sectional view of a sixth embodiment of a rotating stream sprinkler embodying features of the present invention.
Figure 34:
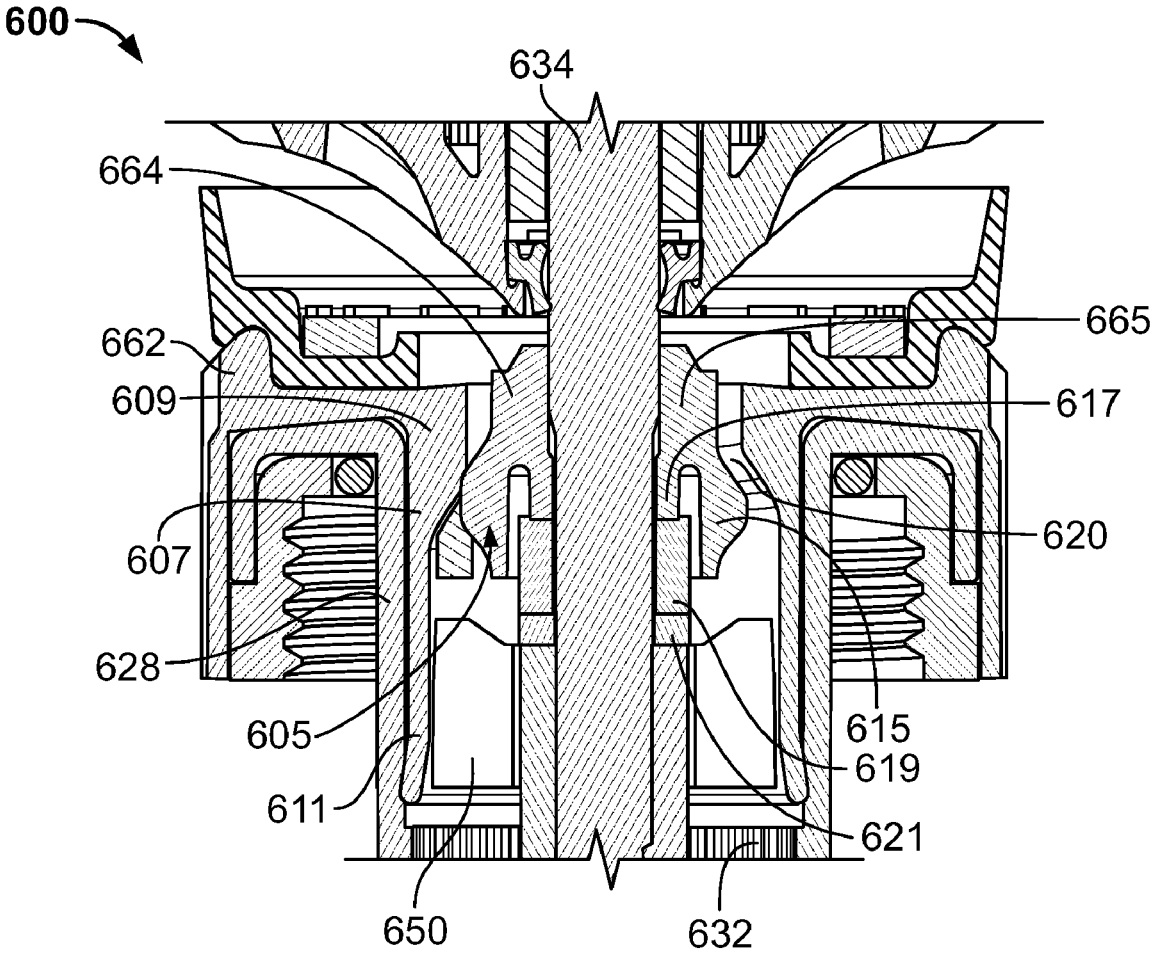
FIG. 34 is an enlarged cross-section view of area 34-34 of FIG. 33.
Figure 35:
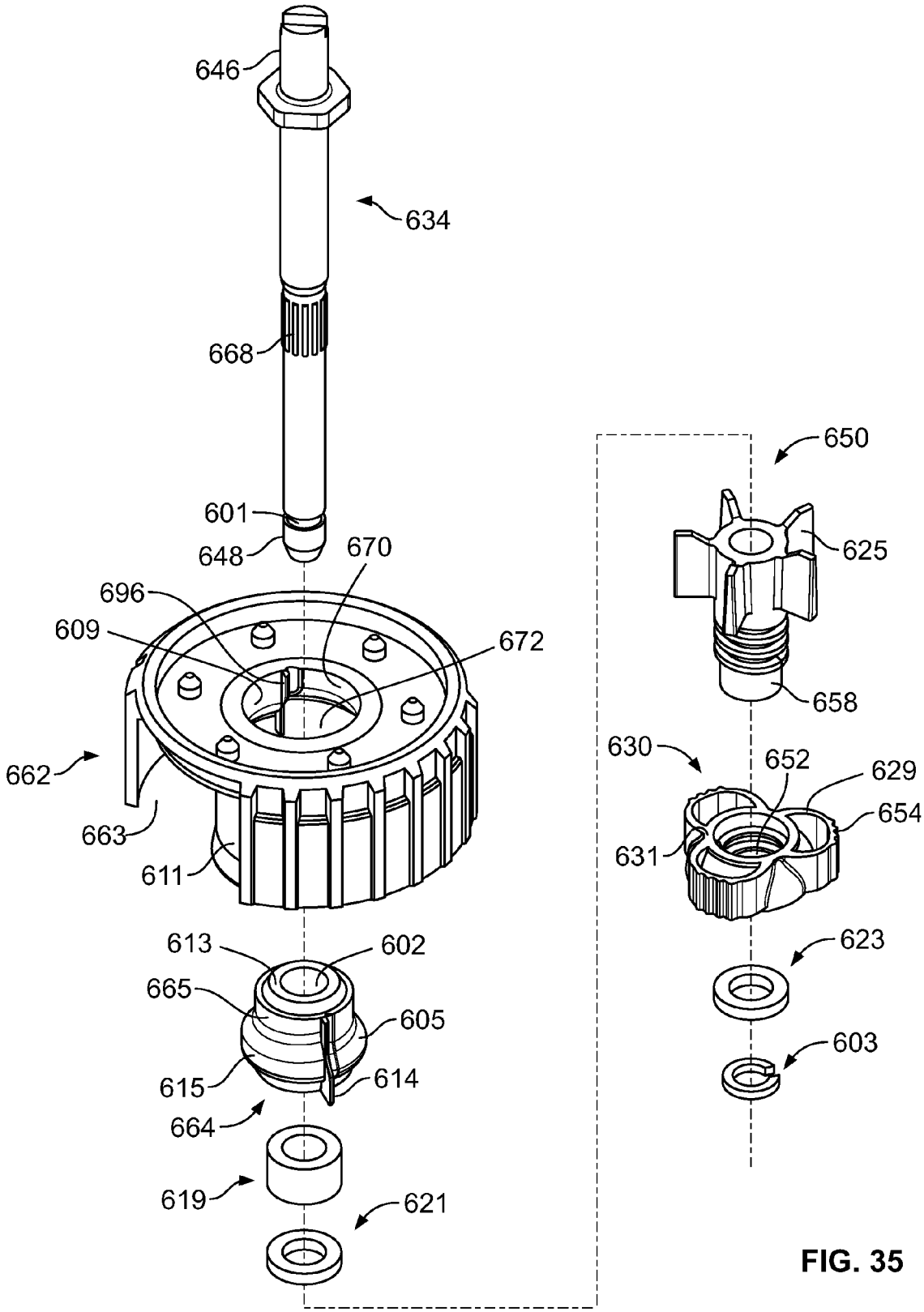
FIG. 35 is a top exploded view of the arc adjustment member, nozzle cover, valve sleeve, rubber spring, washers, hub member, throttle control member, and retaining ring of the rotating stream sprinkler of FIG. 33.
Figure 36:
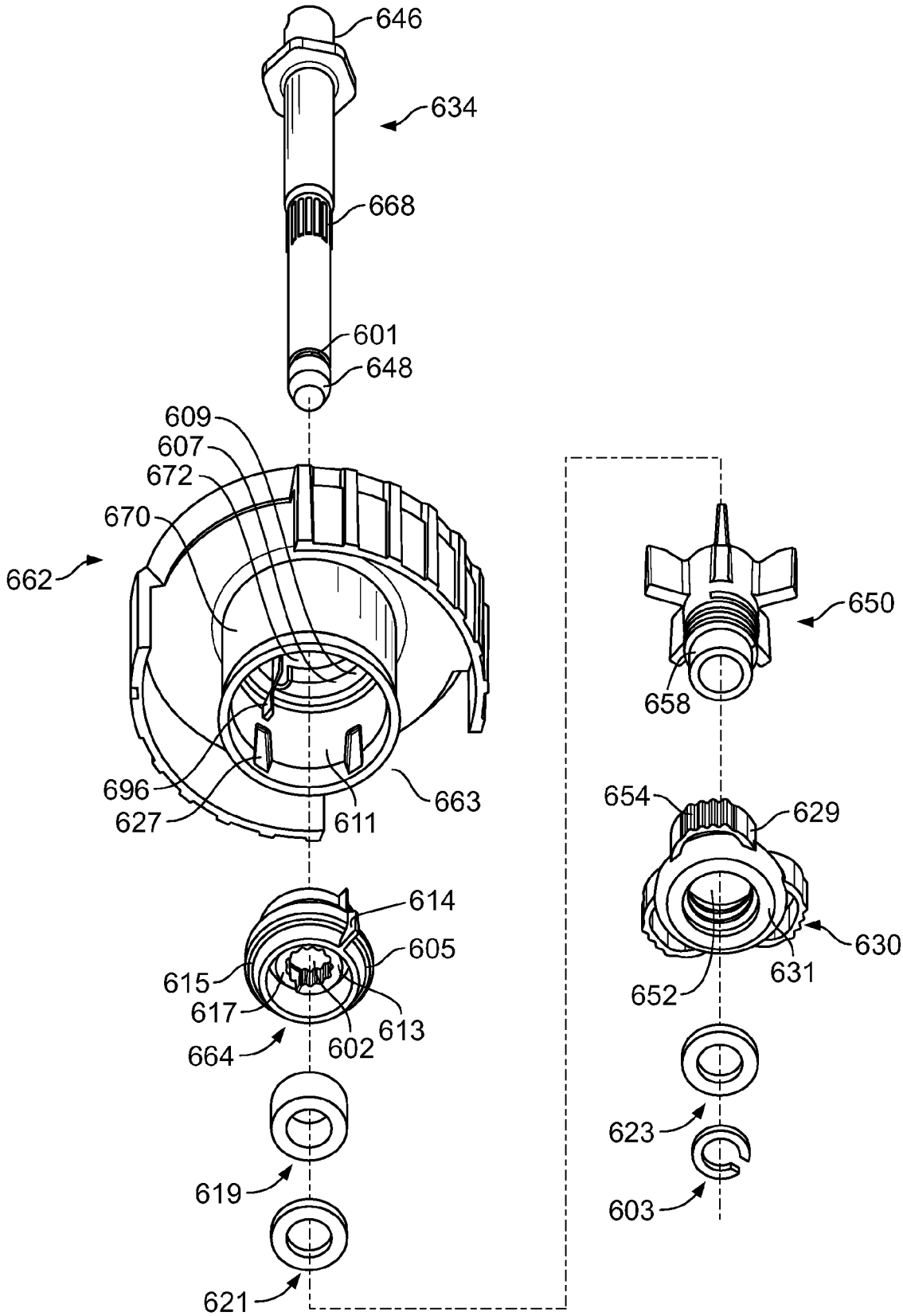
FIG. 36 is a bottom exploded view of the arc adjustment member, nozzle cover, valve sleeve, rubber spring, washers, hub member, throttle control member, and retaining ring of the rotating stream sprinkler of FIG. 33.

An advantage of this modified nozzle cover and valve sleeve structure is that a pre-load force is applied in the upward direction of water flow. More specifically, as shown in FIG. 33, the inner cylindrical portion 617 of the valve sleeve 664 is preferably seated on a rubber spring 619, first washer 621, hub member 650, second washer 623, and retaining ring 603, respectively, all of which are carried by the arc adjustment member 634. The rubber spring 619 provides the pre-load force to seal the closed portion of the arcuate slot 620, or valve, when compressed in the component assembly and absorbs the axial movement of the valve sleeve 664 during arc adjustment. The washers 621 and 623 provide structural support for the member 634 to prevent axial displacement of the assembly and to protect the hub member 650 from damage during rotation of the arc adjustment member 634. This arrangement allows for the upward application of a predetermined amount of pre-load force against the inner cylindrical portion 617 of the valve sleeve 664. In other words, the valve sleeve 664 is urged upwardly into direct spring loaded and water pressurized contact with the nozzle cover 662.

This upward application of pre-load force provides an improved seal for the closed portion of the arcuate slot 620. In this sixth preferred embodiment, the seal for the arcuate slot 620 is on the bottom side of the nozzle cover 662, which allows water pressure to provide for a better seal. In other words, the upward water pressure and upward pre-load force cooperate to maintain a tight seal for the closed portion of the arcuate slot 620.

As shown in FIGS. 33-36, the sprinkler 600 preferably includes a hub member 650 that is modified in structure relative to the other preferred embodiments. The hub member 650 preferably includes a number of outwardly extending ribs 625, such as the five ribs shown in FIG. 35, that engage a corresponding number of grooves 627 formed in the hub 670 of the nozzle cover 662 and that fix the hub member 650 against rotation and axial displacement. The ribs 625 are preferably fixed in the grooves 627 by welding, although other attachment methods may also be used.

When assembled with the nozzle cover 662, the ribs 625 define flow passages for the flow of water through the hub member 650. The hub member 650 is carried by the arc adjustment member 634. One advantage of this preferred embodiment is that the hub member 650 does not require internal threading for engagement with external threading of the arc adjustment member 634, i.e., component design is simplified. The hub member 650 also includes a lower threaded cylindrical post 658, which is used to adjust flow rate and throw radius by threaded engagement with a modified throttle control member 630, as described below.

As shown in FIG. 33, the throttle control member 630 is threadedly coupled to the hub member 650. The throttle control member 630 preferably includes a number of outer wall segments 629, such as the three outer wall segments shown in FIGS. 35 and 36, that project outwardly from an internally threaded hub 631 that defines a central bore 652. The segments 629 each have an external surface 654, preferably a splined surface, for engagement to the corresponding internal splined surface 632 of the nozzle collar 628. The segments 629 are preferably relatively thin such that over-rotation of the nozzle collar 628 results in slippage of the splined surfaces of the nozzle collar 628 and throttle control member 630. Alternatively, the throttle control member 630 may use an outer ring having an external splined surface for engagement with the nozzle collar 628. As described above with reference to other preferred embodiments, rotation of the nozzle collar 628 causes axial movement of the throttle control member 630 to adjust flow rate and throw radius.

A seventh preferred embodiment 700 is shown in FIGS. 37-40. The seventh preferred embodiment of the rotating stream sprinkler 700 is similar to the sixth embodiment described above and preferably includes a slotted arc adjustment member 734 for engagement with a hand tool for adjustment of the water distribution arc and preferably cut-out portions to define access windows in the nozzle cover 762 to allow adjustment of the throw radius. The seventh preferred embodiment, however, preferably includes an overmolded elastomeric portion of the valve sleeve that acts as the helical engagement surface of the valve sleeve, as described further below. It should be understood that the structure of the seventh embodiment of the sprinkler 700 is generally otherwise the same as that described above for the sixth embodiment, except to the extent described below.

Figure 37:
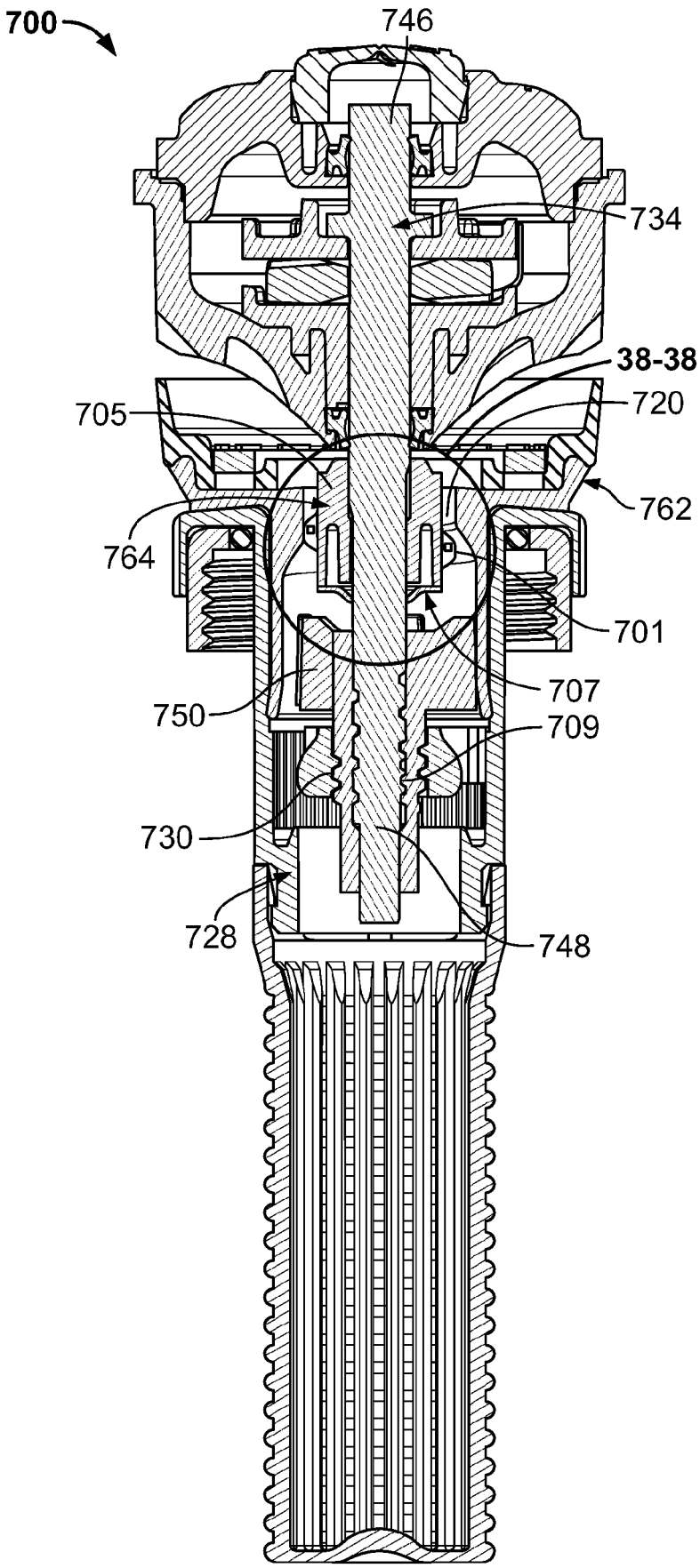
FIG. 37 is a cross-sectional view of a seventh embodiment of a rotating stream sprinkler embodying features of the present invention.

As shown in FIGS. 37-40, the sprinkler 700 includes an arc adjustment member 734 that is the same as arc adjustment member 234. It preferably includes a slotted upper end 746, a splined intermediate surface 768, and a threaded lower end 748. As can be seen, the member 734 is different than the one preferably used with the sixth embodiment. More specifically, the lower end 748 is threaded and it preferably does not include an undercut groove for engagement with a retaining ring. As can be seen in FIG. 37, the seventh embodiment preferably does not include a retaining ring, rubber spring, or washers, as were included for the sixth embodiment.

As with the other preferred embodiments, the variable arc capability of sprinkler 700 results from the interaction of the nozzle cover 762 and valve sleeve 764. With respect to sprinkler 700, as discussed further below, the valve sleeve 764 preferably includes a flexible overmolded portion that is the helical engagement surface of the valve sleeve 764. The nozzle cover 762 is preferably the same as the nozzle cover 662 described and shown for the sixth embodiment. The nozzle cover 762 has a helical engagement surface 794 for engaging the overmolded portion 701 of the valve sleeve 764 for rotatably adjusting the angle of the arcuate slot 720. As with previous embodiments, the nozzle cover 762 and valve sleeve 764 also each preferably have fins to define edges of the water stream passing through the slot 720.

As shown in FIGS. 37-40, the valve sleeve 764 has a generally cylindrical shape, but it has a modified structure relative to the other preferred embodiments. The valve sleeve 764 preferably includes an outer cylindrical portion 715 with a fin 714 and an inner cylindrical portion 717 defining a hub 713 with splined internal engagement surface. The inner cylindrical portion 717 is preferably in the form of a split ring to allow over-rotation protection, i.e., to prevent damage to the sprinkler components upon attempted over-rotation of the arc adjustment member 734. As described above with regard to other preferred embodiments, upon over-rotation, the member 734 and valve sleeve 764 "slip" with respect to one another such that the valve sleeve 764 does not rotate with the member 734.

The valve sleeve 764 preferably includes a helical ridge 703 upon which an elastomeric portion 701 is overmolded. More specifically, the elastomeric portion 701, preferably formed of a thermoplastic elastomer (TPE), is preferably overmolded onto a thermoplastic substrate valve sleeve body 705 along the helical ridge 703. Thus, a two-shot molding process is preferably used for molding and overmolding the valve sleeve 764. The TPE material provides elasticity to provide a good sealing engagement between the overmolded portion 701 and nozzle cover 762. Because of this elasticity, this sealing engagement induces little side load, i.e., force directed radially, that could misalign the valve sleeve 764 and the arc adjustment member 734. When the valve sleeve 764 and/or member 734 become misaligned, the annular gap formed by the arcuate slot 720 is not of uniform thickness, which results in an inconsistent spray pattern.

Figure 38:
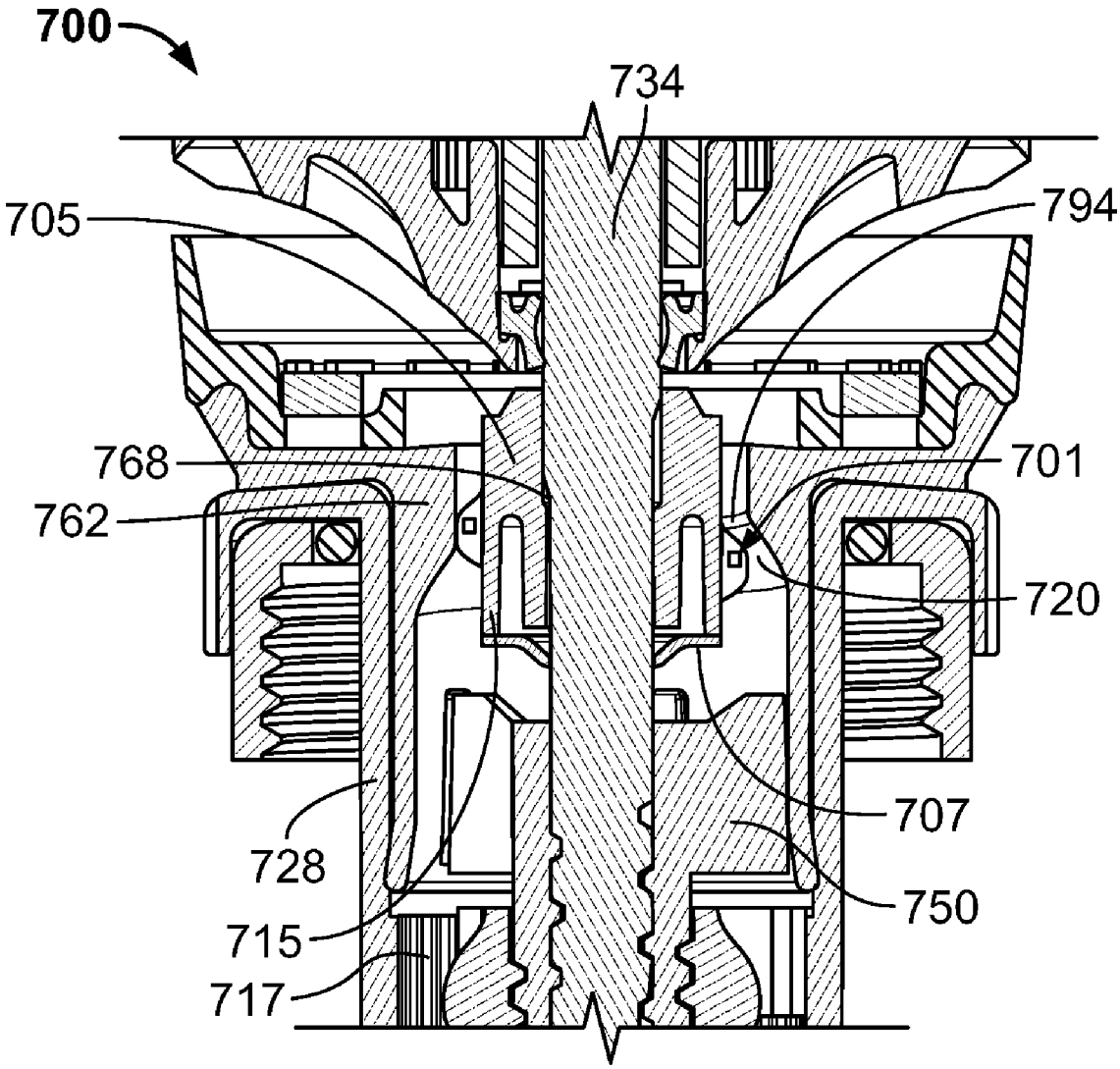
FIG. 38 is an enlarged cross-sectional view of area 38-38 of FIG. 37.
Figure 39:
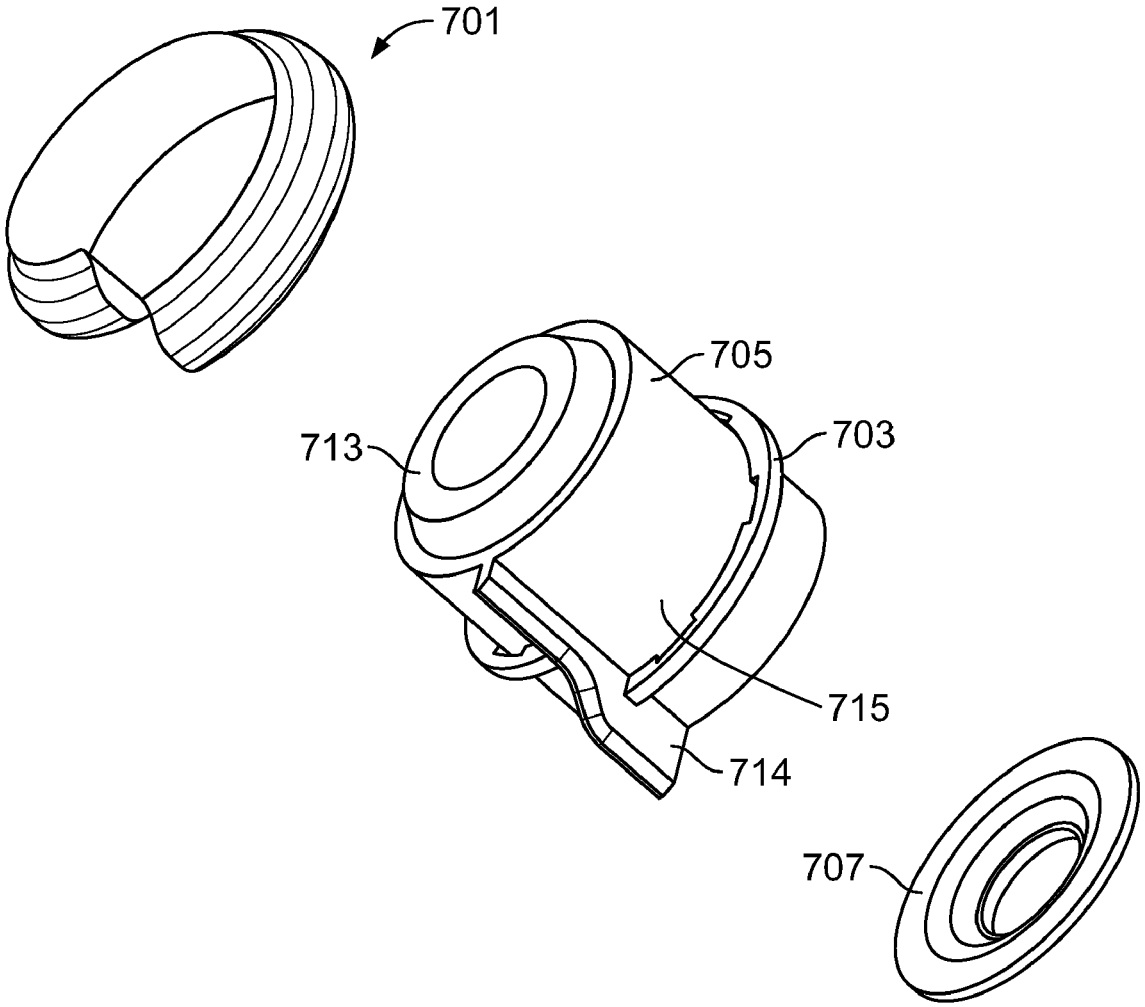
FIG. 39 is a top exploded view of the valve sleeve without overmolding, the overmolded portion of the valve sleeve, and the push nut of the rotating stream sprinkler of FIG. 37.
Figure 40:
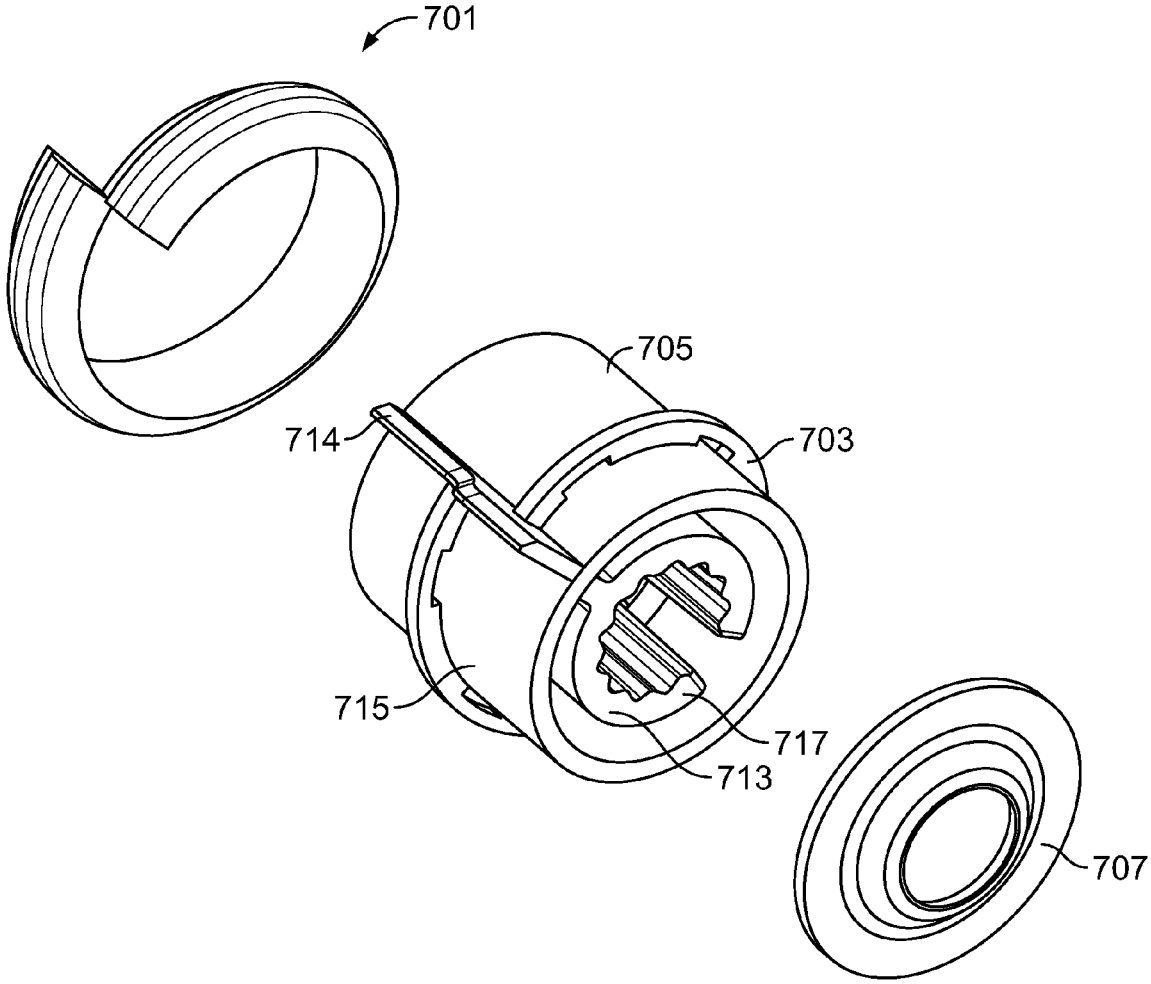
FIG. 40 is a bottom exploded view of the valve sleeve without overmolding, the overmolded portion of the valve sleeve, and the push nut of the rotating stream sprinkler of FIG. 33.

In the preferred form shown in FIGS. 37 and 38, the sprinkler 700 does not involve the application of a spring-loaded pre-load to the valve sleeve 764, as with the sixth embodiment. In the preferred form, the sprinkler 700 does not include a rubber spring, washers, or retaining ring, but instead includes a push nut 707 for keeping the valve sleeve 764 retained by the member 734. The lower end 748 of the member 734 threadedly engages the hub member 750, and the valve sleeve 764 preferably moves in an axial direction upon rotation of the arc adjustment member 734. The hub member 750 is generally the same as that described above for the sixth preferred embodiment (hub member 650), but it includes an inner threaded portion 709 for receipt of the arc adjustment member 734. The hub member 750 and throttle control member 730 are otherwise preferably the same as for the sixth embodiment and operate in the same manner. Rotation of the nozzle collar 728 causes rotation of the throttle control member 730 and axial movement of the throttle control member 730 to adjust the flow rate and throw radius.

One advantage of the seventh preferred embodiment is that the overmolded portion 701 seals against a substantially vertical wall of the nozzle cover 762, rather than against an inclined wall. This engagement provides a wide and stable band of contact between the overmolded portion 701 and the nozzle cover 762, which provides an excellent seal. This orientation also helps maintain the alignment of the valve sleeve 764 with respect to the nozzle cover 762 and limits misalignment that might result in an irregular annular slot 720. In addition, the use of elastomeric material, or other elastic material, for the overmolded portion 701 absorbs side loads that might otherwise disrupt the sealing engagement or misalign the valve sleeve 764.

It should be evident that there are other features and other components that may be overmolded. For example, the overmolded portion 701 need not define just a helical shape but may also include a fin. In other words, the fin 714 shown in FIGS. 39 and 40 need not form part of the valve sleeve body 705 but may instead form part of the overmolded portion 701. In addition, the nozzle cover 762 may have some of its features overmolded, such as, for instance, its fin or its internal helical surface. Because of the elastic properties of the overmolded material, the overmolding of various features and components may reduce side load that might otherwise affect sealing of the components or might cause misalignment of the components.

The foregoing relates to preferred exemplary embodiments of the invention. It is understood that other embodiments and methods are possible, which lie within the spirit and scope of the invention as set forth in the following claims. It is understood that elements and features shown and described for a specific preferred embodiment can be combined with other preferred embodiments. Further, it is understood that features and elements from a specific preferred embodiment may be used with other sprinkler embodiments not specifically shown herein as set forth in the following claims.

What is claimed is:

1. A rotating stream sprinkler comprising:

a deflector having an underside surface contoured to deliver a plurality of fluid streams generally radially outwardly therefrom through an arcuate span, the deflector defining a bore; and a nozzle body defining an inlet, an outlet, a central hub, and a valve sleeve, the inlet capable of receiving fluid from a source, the outlet capable of delivering fluid to the underside surface of the deflector, the central hub defining a bore and an internal helical surface; and the valve sleeve defining an external helical surface that adjustably engages the internal helical surface of the central hub to form an arcuate slot that is adjustable in size to determine the arcuate span;

wherein the valve sleeve is rotatable through at least 180 degrees, rotation causing the external helical surface of the valve sleeve to traverse the internal helical surface of the central hub and adjust the size of the arcuate slot by at least 180 degrees; and wherein the valve sleeve is rotatable through substantially 360 degrees for adjustment of the size of the arcuate slot by substantially 360 degrees.

2. The rotating stream sprinkler of claim 1 further comprising an arc adjustment member extending through the deflector bore and engaging the valve sleeve for rotation of the valve sleeve to adjust the size of the arcuate slot.

3. The rotating stream sprinkler of claim 2 wherein the deflector, valve sleeve, and arc adjustment member are rotatable about a central axis.

4. The rotating stream sprinkler of claim 2 wherein the deflector includes an open upper end and wherein the sprinkler further comprises a cap for mounting to the upper end of the deflector, the cap having an interface configured to engage the arc adjustment member for rotation of the member to adjust the size of the arcuate slot.

5. The rotating stream sprinkler of claim 2 further comprising at least one biasing element for applying a predetermined pre-load force to urge the valve sleeve against the central hub.

6. The rotating stream sprinkler of claim 5 wherein the at least one biasing element has a first end and a second end, the first end operatively coupled to the arc adjustment member and the second end operatively coupled to the valve sleeve.

7. The rotating stream sprinkler of claim 6 wherein the at least one biasing element each define an orifice therethrough for insertion of the arc adjustment member.

8. The rotating stream sprinkler of claim 5 wherein the at least one biasing element applies the predetermined pre-load force in the direction of fluid flow through the nozzle body.

9. The rotating stream sprinkler of claim 1 wherein the internal and external helical surfaces each define approximately one helical revolution with axially offset ends.

10. The rotating stream sprinkler of claim 1 wherein the valve sleeve comprises a molded cylindrical valve sleeve body and an overmolded portion, the overmolded portion defining the external helical surface.

11. The rotating stream sprinkler of claim 10 wherein the overmolded portion sealingly engages a vertical wall of the central hub of the nozzle body.

12. The rotating stream sprinkler of claim 10 wherein the overmolded portion further defines a fin projecting radially outwardly from the valve sleeve body for channeling fluid flow to define an edge of fluid flowing through the arcuate slot.

13. The rotating stream sprinkler of claim 1 wherein the central hub of the nozzle body comprises an overmolded portion defining the internal helical surface.

14. The rotating stream sprinkler of claim 1 wherein the central hub of the nozzle body includes a substantially cylindrical wall for redirecting fluid flow from the adjustable arcuate slot to the underside surface of the deflector, the cylindrical wall having sufficient axial length to increase the axial flow component and reduce the tangential flow component.

15. The rotating stream sprinkler of claim 1 wherein the valve sleeve is oriented to allow fluid flowing from the source to impact the valve sleeve and to be redirected toward the cylindrical wall.

16. The rotating stream sprinkler of claim 1 further comprising a flow rate adjustment device positioned downstream of the inlet to regulate flow to the deflector.

17. The rotating stream sprinkler of claim 16 wherein the nozzle body further comprises an outer wall portion and wherein the flow rate adjustment device comprises a throttle control member located downstream of the inlet, the outer wall portion operatively coupled to the throttle control member for axial movement of the throttle control member toward and away from the inlet.

18. The rotating stream sprinkler of claim 16 wherein the flow rate adjustment device comprises:

a collar rotatable about a central axis and defining an internal engagement surface;

a throttle control member having an external engagement surface for coupling to the internal engagement surface of the collar, the throttle control member rotatable about the central axis and having a central hub defining an internal bore; and a post for engagement with the central hub of the throttle control member;

wherein rotation of the collar causes rotation of the throttle control member and movement of the throttle control member in a direction substantially parallel to the central axis.

19. The rotating stream sprinkler of claim 18 wherein the central hub of the throttle control member and the post are each threaded for threaded engagement with each other.

20. The rotating stream sprinkler of claim 16 wherein the flow rate adjustment device defines an opening and has at least a first flow restrictor element and a second flow restrictor element, the elements cooperating to variably adjust the opening between a closed position, wherein the opening is almost completely obstructed, and an open position, wherein less than half of the opening is obstructed.

21. The rotating stream sprinkler of claim 20 wherein each restrictor element has a central hub and a shutter, and the shutters shift relative to one another to increase or decrease the size of the opening.

22. The rotating stream sprinkler of claim 21 wherein the second restrictor element is coupled to and moveable by the first restrictor element to increase or decrease the size of the opening of the flow rate adjustment device.

23. The rotating stream sprinkler of claim 22 wherein the maximum area of the opening of the flow rate adjustment device is set by aligning the shutters of the flow restrictor elements to substantially overlap one another.

24. The rotating stream sprinkler of claim 20 comprising a total number of restrictor elements, n, wherein n is greater than two, such that the flow restrictor elements shift relative to one another to increase or decrease the size of the opening of the flow rate adjustment device, each restrictor element having a shutter and a central hub that define at least in part an arcuate flow aperture therethrough, the shutter extending approximately 1/n of the way about the hub to obstruct the opening.

25. The rotating stream sprinkler of claim 1 wherein the underside surface of the deflector includes spiral vanes for rotation of the deflector by fluid exiting the arcuate slot.

26. The rotating stream sprinkler of claim 1 further comprising a speed control brake coupled to the deflector for regulating the rotational speed of the deflector.

27. A rotating stream sprinkler comprising:

a deflector having an underside surface contoured to deliver a plurality of fluid streams generally radially outwardly therefrom through an arcuate span, the deflector defining a bore; and a nozzle body defining an inlet, an outlet, a central hub, and a valve sleeve, the inlet capable of receiving fluid from a source, the outlet capable of delivering fluid to the underside surface of the deflector, the central hub defining a bore and an internal helical surface; and the valve sleeve defining an external helical surface that adjustably engages the internal helical surface of the central hub to form an arcuate slot that is adjustable in size to determine the arcuate span;

wherein the valve sleeve comprises a first fin projecting radially outwardly from the valve sleeve and wherein the nozzle body comprises a second fin projecting radially inwardly from the central hub, the first and second fins channeling fluid flow to define first and second edges of fluid flowing through the arcuate slot.

28. The rotating stream sprinkler of claim 27 wherein the valve sleeve comprises a first channel adjacent the first fin and wherein the nozzle body comprises a second channel adjacent the second fin, the first and second channels allowing for increased fluid flow at the first and second edges.

29. A rotating stream sprinkler comprising:

a deflector having an underside surface contoured to deliver a plurality of fluid streams generally radially outwardly therefrom through an arcuate span, the deflector defining a bore; and a nozzle body defining an inlet, an outlet, a central hub, and a valve sleeve, the inlet capable of receiving fluid from a source, the outlet capable of delivering fluid to the underside surface of the deflector, the central hub defining a bore and an internal helical surface; and the valve sleeve defining an external helical surface that adjustably engages the internal helical surface of the central hub to form an arcuate slot that is adjustable in size to determine the arcuate span;

an arc adjustment member extending through the deflector bore and engaging the valve sleeve for rotation of the valve sleeve to adjust the size of the arcuate slot;

wherein the valve sleeve defines a bore and includes an internal splined segment for interlockably engaging a corresponding splined segment of the arc adjustment member.

30. The rotating stream sprinkler of claim 29 wherein the valve sleeve and arc adjustment member are configured such that rotation of the arc adjustment member beyond a predetermined position causes the arc adjustment member to continue to rotate without corresponding rotation of the valve sleeve.

31. A rotating stream sprinkler comprising:

a deflector rotatable about a central axis and having an underside surface contoured to deliver a plurality of fluid streams generally radially outwardly therefrom;

a collar rotatable about the central axis and defining an internal engagement surface; and a valve having an external engagement surface for coupling to the internal engagement surface of the collar;

wherein rotation of the collar causes opening and closing of the valve for adjusting the amount of fluid flow through the sprinkler;

wherein the valve comprises a throttle control member rotatable about the central axis and wherein rotation of the collar causes rotation of the throttle control member and movement of the throttle control member in a direction substantially parallel to the central axis;

wherein the internal engagement surface of the collar defines a first splined surface and wherein the external engagement surface of the throttle control member defines a second splined surface for interlocking engagement with the first splined surface of the collar.

32. The rotating stream sprinkler of claim 31 wherein the throttle control member has a central hub defining an internal bore and wherein the sprinkler further comprises a post for engagement with the central hub of the throttle control member.

33. The rotating stream sprinkler of claim 32 wherein the sprinkler comprises an inlet upstream of the throttle control member, rotation of the collar causing the throttle control member to move axially to or away from the inlet.

34. The rotating stream sprinkler of claim 33 wherein the central hub of the throttle control member is internally threaded for engagement with corresponding threads of the post, rotation of the throttle control member causing it to move along the threads in an axial direction to or away from the inlet.

35. The rotating stream sprinkler of claim 33 wherein the collar, throttle control member, and post are oriented such that axial movement of the throttle control member toward the inlet reduces fluid flow through the sprinkler, the throttle control member being moveable to substantially block the flow of fluid through the inlet.

36. The rotating stream sprinkler of claim 33 wherein the collar, throttle control member, and post are oriented such that axial movement of the throttle control member away from the inlet increases fluid flow through the sprinkler.

37. The rotating stream sprinkler of claim 31 wherein the collar comprises a cylindrical portion having the internal engagement surface for engagement with the external engagement surface of the throttle control member.

38. The rotating stream sprinkler of claim 31 further comprising a nozzle body for adjusting an arcuate span of water distribution, a portion of the nozzle body mounted about the collar and having one or more cut-out windows to allow a user to rotate the collar.

39. The rotating stream sprinkler of claim 31 wherein the nozzle collar defines a substantially circumferential outer wall, the outer wall rotatable for opening and closing the valve.

40. The rotating stream sprinkler of claim 31 wherein the throttle control member comprises one or more arcuate segments, each having a splined surface on the outside circumference thereof, the one or more arcuate segments projecting radially outwardly from the central hub.

41. The rotating stream sprinkler of claim 31 wherein the collar and throttle control member are configured such that rotation of the collar beyond a predetermined position causes the collar to continue to rotate without corresponding rotation of the throttle control member.

42. The rotating stream sprinkler of claim 31 further comprising a hub member downstream of the inlet, the hub member including a cylindrical portion, a central hub, and a plurality of ribs joining the cylindrical portion to the central hub, the central hub having a post for insertion into the bore of the throttle control member for engagement with the throttle control member and the ribs defining flow passages for the flow of fluid therethrough.

43. The rotating stream sprinkler of claim 31 further comprising a nozzle cover having grooves on an internal surface and further comprising a hub member, the hub member including a cylindrical portion, a central hub, and a plurality of ribs extending radially outwardly from the cylindrical portion for engagement with the grooves, the central hub having a post for insertion into the bore of the throttle control member for engagement with the throttle control member.

44. The rotating stream sprinkler of claim 31 further comprising a first gear portion and wherein the nozzle collar comprises a second gear portion, the first and second gear portions engaging one another such that rotation of the first gear portion effects rotation of the nozzle collar.

45. A rotating stream sprinkler comprising:

a deflector rotatable about a central axis and having an underside surface contoured to deliver a plurality of fluid streams generally radially outwardly therefrom;

a collar rotatable about the central axis and defining an internal engagement surface; and a valve having an external engagement surface for coupling to the internal engagement surface of the collar;

wherein rotation of the collar causes opening and closing of the valve for adjusting the amount of fluid flow through the sprinkler;

wherein the valve comprises a throttle control member rotatable about the central axis and wherein rotation of the collar causes rotation of the throttle control member and movement of the throttle control member in a direction substantially parallel to the central axis;

wherein the throttle control member comprises a ring having the external engagement surface on the outside circumference thereof and a plurality of ribs joining the ring to the central hub, the ribs defining flow passages for the flow of fluid therethrough.

46. A variable arc sprinkler comprising:

a deflector having an underside surface contoured to deliver a plurality of fluid streams generally radially outwardly therefrom through an arcuate span, the deflector defining a bore; and a nozzle body defining an inlet, an outlet, a central hub, and a valve sleeve, the inlet capable of receiving fluid from a source, the outlet capable of delivering fluid to the underside surface of the deflector, the central hub defining a bore and an internal helical surface; and the valve sleeve defining an external helical surface that adjustably engages the internal helical surface of the central hub to form an arcuate slot that is adjustable in size to determine the arcuate span;

wherein the valve sleeve is rotatable through at least 180 degrees, rotation causing the external helical surface of the valve sleeve to traverse the internal helical surface of the central hub and adjust the size of the arcuate slot by at least 180 degrees; and wherein the valve sleeve is rotatable through substantially 360 degrees for adjustment of the size of the arcuate slot by substantially 360 degrees.

47. The variable arc sprinkler of claim 46 further comprising an arc adjustment member extending through the deflector bore and engaging the valve sleeve for rotation of the valve sleeve to adjust the size of the arcuate slot.

48. A sprinkler with a flow rate adjustment feature comprising:

a deflector rotatable about a central axis and having an underside surface contoured to deliver a plurality of fluid streams generally radially outwardly therefrom;

a collar rotatable about the central axis and defining an internal engagement surface; and a valve having an external engagement surface for coupling to the internal engagement surface of the collar;

wherein rotation of the collar causes opening and closing of the valve for adjusting the amount of fluid flow through the sprinkler;

wherein the valve comprises a throttle control member rotatable about the central axis and wherein rotation of the collar causes rotation of the throttle control member and movement of the throttle control member in a direction substantially parallel to the central axis;

wherein the internal engagement surface of the collar defines a first splined surface and wherein the external engagement surface of the throttle control member defines a second splined surface for interlocking engagement with the first splined surface of the collar.

49. The sprinkler of claim 48 wherein the sprinkler comprises an inlet upstream of the throttle control member, rotation of the collar causing the throttle control member to move axially to or away from the inlet.

* * * * *